US005766822A

United States Patent [19]

Inoue et al.

[11] Patent Number: 5,766,822

[45] Date of Patent: *Jun. 16, 1998

[54] SILVER HALIDE PHOTOGRAPHIC MATERIAL

[75] Inventors: Nobuaki Inoue; Toshihide Ezoe; Takashi Hoshimiya; Kazumi Nii; Kazunobu Katoh; Tetsuo Yamaguchi; Hisashi Okamura, all of Kanagawa, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 733,450

[22] Filed: Oct. 18, 1996

Related U.S. Application Data

[63] Continuation of Ser. No. 222,398, Mar. 31, 1994, abandoned.

[30] Foreign Application Priority Data

| | | | |
|---|---|---|---|
| Mar. 31, 1993 | [JP] | Japan | 5-074232 |
| Mar. 31, 1993 | [JP] | Japan | 5-094897 |
| Mar. 31, 1993 | [JP] | Japan | 5-094905 |
| Mar. 31, 1993 | [JP] | Japan | 5-094919 |
| Jun. 3, 1993 | [JP] | Japan | 5-133591 |

[51] Int. Cl.[6] ..... G03C 1/08

[52] U.S. Cl. ..... 430/264; 430/592; 430/593

[58] Field of Search ..... 430/264, 592, 430/593, 957

[56] References Cited

U.S. PATENT DOCUMENTS

| | | | |
|---|---|---|---|
| 5,030,546 | 7/1991 | Takamuki et al. | 430/264 |
| 5,130,226 | 7/1992 | Sambei et al. | 430/264 |
| 5,204,213 | 4/1993 | Okada et al. | 430/264 |
| 5,230,983 | 7/1993 | Inoue et al. | 430/264 |
| 5,279,919 | 1/1994 | Okamura et al. | 430/264 |
| 5,284,732 | 2/1994 | Nii et al. | 430/264 |
| 5,286,598 | 2/1994 | Inoue et al. | 430/264 |

*Primary Examiner*—Hoa Van Le

*Attorney, Agent, or Firm*—Sughrue, Mion, Zinn, Macpeak & Seas, PLLC

[57] ABSTRACT

A silver halide photographic material comprising a support having thereon at least one light-sensitive silver halide hydrophilic colloid emulsion layer, at least one light-insensitive hydrophilic colloid layer interposed between the support and at least one silver halide emulsion layer, and at least one hydrazine derivative selected from the group consisting of compounds represented by the general formula (1) and (2) contained in the at least one of hydrophilic colloid layers provided in the same side of the support as that coated with the light-sensitive silver halide hydrophilic colloid emulsion layer:

(1)

(2)

wherein their substituents are defined in the specification.

27 Claims, No Drawings

SILVER HALIDE PHOTOGRAPHIC MATERIAL

This application is a continuation of application Ser. No. 08/222,398 filed on Mar. 31, 1994 now abandoned.

FIELD OF THE INVENTION

The present invention relates to a silver halide photographic material and more particularly to a silver halide photographic material which can rapidly form an ultrahard image for use in the field of photomechanical process with a processing solution having a high stability.

BACKGROUND OF THE INVENTION

In the field of photomechanical process, it has been desired to use photographic light-sensitive materials excellent in original reproducibility, stable processing solutions or simplified replenishment methods to cope with diversification and complexity of printed matters.

In particular, originals to be subjected to the process of taking line pictures normally comprise photo-composed letters, handwritten letters, illustration, dot photograph, etc. put thereon. Thus, line originals are normally formed of images having different densities and line widths in admixture. Therefore, it has been keenly desired to provide plate-making cameras, photographic light-sensitive materials or image formation methods which can give an excellent reproduction of these originals. On the other hand, enlargement or reduction of dot photograph is widely conducted to make plates for catalogues or large-sized posters. In the dot enlargement process, the number of lines per inch is reduced, giving an unsharp dot picture. In the dot reduction process, the number of lines per inch becomes greater than that of the original, giving a fine picture. Accordingly, an image formation method which provides an wider latitude to maintain an excellent reproducibility of dot gradation has been desired.

In a known method for meeting the demand for wide latitude, a lithographic silver halide photographic material comprising silver bromochloride (at least having a silver chloride content of 50% or more) is processed with a hydroquinone developer having an extremely low effective concentration of sulfurous ions (normally 0.1 mol/l or less) so that line originals or dot images having a high contrast and blackened density on which the image portion and the nonimage portion are definitely distinguished from each other can be obtained. However, this method is disadvantageous in that the development is extremely unstable to air oxidation due to the low sulfurous acid concentration of the developer. In order to stabilize the activity of the developer, various efforts and measures must be made. Further, this method provides a markedly low processing speed, lowering the working efficiency.

Thus, an image formation method has been desired which comprises development with a processing solution having an excellent storage stability to provide an ultrahigh contrast while eliminating the instability in the formation of images by the above mentioned development method (lithographic development system). In a system as proposed in U.S. Pat. Nos. 4,166,742, 4,168,977, 4,221,857, 4,224,401, 4,243,739, 4,272,606, and 4,311,781, a surface latent image type silver halide photographic material comprising a specific hydrazine compound is processed with a developer with a pH value of 11.0 to 12.3 containing 0.15 mol/l of a sulfurous acid preservative and having an excellent storage stability to form an ultrahigh contrast negative image having γ of more than 10 thereon. The above mentioned image formation system is excellent in view of dot sharpness, processing stability and rapidity, and original reproducibility.

The above mentioned image formation system exhibits an excellent processing stability as compared with lithographic system. Nevertheless, it is disadvantageous in that as a large amount of a film is processed, the pH value of the developer is lowered or the bromine ion concentration is raised, causing a drop in sensitivity, γ or maximum density. On the other hand, it is also disadvantageous in that while the number of sheets of film which has been processed is still small, as the developer becomes fatigued with time, the concentration of sulfurous acid introduced as a preservative is markedly reduced or the pH value of the developer is raised, causing the occurrence of many black peppers with a drop in the maximum density. In order to overcome these difficulties, the replenishment rate of the developer may be increased. However, this approach is disadvantageous in that the developer takes an increased cost and gives a problem of waste. Thus, a system has been keenly desired which is less subject to sensitivity fluctuations, Dmax drop or black peppers without increasing the replenishment rate of the developer.

On the other hand, if the problem of poor processing stability is solved by the use of a certain kind of a hydrazine compound, it tends to aggravate black peppers (i.e., to increase the number of black peppers and/or grow up the area of each of black peppers). Black peppers are black spots formed by finely divided grains of developed silver on an unexposed area which is to be a nonimage area. Black peppers present a problem in the photomechanical process. Black peppers frequently occur due to the decrease of the concentration of sulfurous ions generally used in the developer as a preservative or the rise of the pH value of the developer, remarkably marring the commercial value of the photomechanical light-sensitive material. Thus, a system which provides an excellent processing stability and is improved with respect to black peppers has been keenly desired.

On the other hand, as light source for plate-making cameras there has been employed halogen lamp or xenon lamp. In order to obtain photographing sensitivity to these light sources, light-sensitive materials are normally subjected to orthochromatic sensitization. However, it has been found that photographic light-sensitive materials thus orthochromatically sensitized are more susceptible to effects of chromatic aberration of lens which can deteriorate the picture quality, particularly when a xenon lamp is used. In addition, in order to cope with the modern diversification of printed matters, an image system which provides a further improvement in the original reproducibility has been desired. Further, if the problem of poor processing stability is solved by the use of a certain kind of a hydrazine compound, it tends to deteriorate the original reproducibility. Thus, a system which exhibits an excellent processing stability and original reproducibility has been keenly desired.

Examples of a hydrazine compound-containing system comprising a hydrophilic colloid layer provided interposed between a silver halide emulsion layer and a support are disclosed in JP-A-2-124558, JP-A-3-39952, and JP-A-4-34430 (The term "JP-A" as used herein means an "unexamined published Japanese patent application"). However, these patents do not disclose any photographic material containing hydrazine compounds as specified herein.

Examples of a hydrazine compound-containing system containing a finely solid-dispersed dye are described in U.S. Pat. No. 4,904,565.

Examples of a hydrazine compound-containing system containing a redox compound which undergoes oxidation to release a development inhibitor are disclosed in JP-A-61-213847, and JP-A-64-72140.

SUMMARY OF THE INVENTION

It is therefore an object of the present invention to provide a silver halide photographic material which exhibits photographic characteristics of a high sensitivity, a high contrast (not less than 10 in terms of γ) and a high Dmax, which exhibits less variation of sensitivity, γ and Dmax even when processed with a fatiqued (aged) developer having a reducted concentration of sulfurous acid introduced as a preservative and a changed pH, and which forms reduced black peppers.

It is another object of the present invention to provide a silver halide photographic material which exhibits a high sensitivity, a high contrast, a high Dmax, reduced black peppers and an excellent original reproducibility and is less susceptible to the variation of sensitivity, γ and Dmax with time.

These and other objects of the present invention will become more apparent from the following detailed description and examples.

The foregoing objects of the present invention are accomplished with a silver halide photographic material comprising a support having thereon at least one silver halide hydrophilic colloid emulsion layer, at least one light-insensitive layer comprising a hydrophilic colloid interposed between the support and said at least one silver halide emulsion layer, and at least one hydrazine derivative selected from the group consisting of compounds represented by the following general formulae (1) and (2) in at least one of hydrophilic colloid layers provided on the same side of the support as that coated with the silver halide hydrophilic colloid emulsion layer:

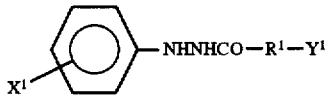

(1)

wherein $X^1$ represents an alkyl group, an alkoxy group, a substituted amino group or an alkylthio group; $Y^1$ represents an alkoxy group, an aryloxy group, a substituted amino group, an alkylthio group or an arylthio group; and $R^1$ represents an alkylene group;

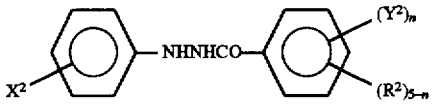

(2)

wherein $X^2$ has the same meaning as $X^1$ in the general formula (1); $Y^2$ represents an electron withdrawing group; $R^2$ represents a hydrogen atom, an alkyl group, an aryl group, an alkoxy group, an aryloxy group, a substituted amino group, an alkylthio group or an arylthio group which may be further substituted; and n represents an integer from 1 to 5, with the proviso that the plurality groups of $Y^2$ and/or $R^2$ may be the same or different.

DETAILED DESCRIPTION OF THE INVENTION

The present invention will be further described hereinafter.

Firstly, the hydrazine derivative represented by the general formula (1) or (2) used in the present invention will be described hereinafter.

In the general formula (1), the alkyl group represented by $X^1$ or the alkyl group contained in the alkoxy group or alkylthio group represented by $X^1$ is a straight-chain, branched or cyclic alkyl group. Typical examples of such an alkyl group include an ethyl group, a butyl group, an isopropyl group, an isobutyl group, a t-amyl group, and a cyclohexyl group. Examples of substituents on the substituted amino group represented by $X^1$ include an alkyl group, and an aryl group. Further examples of such substituents include an acyl group (R—CO— group in which R is an alkyl or aryl group), an alkoxycarbonyl group, an aryloxycarbonyl group, a substituted or unsubstituted carbamoyl group, a substituted or unsubstituted hydrazinocarbonyl group, an alkylsulfonyl group, an arylsulfonyl group, and a substituted or unsubstituted sulfamoyl group. In the latter case, a carbonamido group, a urethane group (e.g., alkoxycarbonylamino group), a ureido group, a semicarbazido group, a sulfonamido group, etc. are formed. $X^1$ may also be substituted so as to form 2-methoxyethoxy group, 3,3-bis (2-hydroxyethyl)ureido group or the like. The total number of carbon atoms in $X^1$, including its substituents, is preferably from 1 to 6, more preferably from 2 to 6, particularly from 3 to 6.

$X^1$ preferably represents a substituted amino group, most preferably an amino group which is substituted so as to form a carbonamido group, a ureide group or a sulfonamido group.

The position on which $X^1$ is attached to the phenyl group may be any of the ortho-position, the meta-position and the para-position, preferably the meta-position or the para-position, most preferably the para-position on the hydrazine moiety. The phenylene group via which $X^1$ is connected to the hydrazine moiety may be substituted, with the proviso that the total number of carbon atoms contained in these substituents on the phenylene group and $X^1$ is preferably from 1 to 6.

In the general formula (1), the alkoxy group contained in the alkoxy or alkylthio group represented by $Y^1$ is a straight-chain, branched or cyclic alkyl group. Typical examples of such an alkyl group include a methyl group, a dodecyl group, an isobutyl group, and a 2-ethylhexyl group. The aryl group contained in the aryloxy or arylthio group represented by $Y^1$ is a monocyclic or bicyclic unsaturated carbon ring or unsaturated heterocyclic group. Typical examples of such an aryl group include a benzene ring, a naphthalene ring, a pyridine ring, and a quinoline ring.

Examples of substituents on the substituted amino group represented by $Y^1$ include an alkyl group, and an aryl group. Further examples of such substituents include an acyl group (R—CO— group in which R is an alkyl or an aryl group), an alkoxycarbonyl group, an aryloxycarbonyl group, a substituted or unsubstituted carbamoyl group, a substituted or unsubstituted hydrazinocarbonyl group, an alkylsulfonyl group, an arylsulfonyl group, and a substituted or unsubstituted sulfamoyl group. In the latter case, a carbonamido group, a urethane group (e.g., alkoxycarbonylamino group), a ureido group, a semicarbazido group, a sulfonamido group, etc. are formed.

$Y^1$ preferably represents an alkoxy group or an aryloxy group, most preferably aryloxy group.

The group represented by $Y^1$ may be substituted. Typical examples of substituents of the substituted group include an alkyl group, an aralkyl group, an alkenyl group, an alkinyl group, an alkoxy group, an aryl group, a substituted amino group, a ureide group, a urethane group (e.g., alkoxycarbonylamino group), an aryloxy group, a sulfamoyl group, a carbamoyl group, an alkylthio group, an arylthio group, an alkylsulfonyl group, an arylsulfonyl group, an alkylsulfinyl group, an arylsulfinyl group, a hydroxyl group, a halogen atom, a cyano group, a sulfo group (i.e., —$SO_3M$ wherein M represents a hydrogen atom or an alkali metal atom), an aryloxycarbonyl group, an acyl group, an alkoxycarbonyl group, an acyloxy group, a carbonamido group, a sulfonamide group, a carboxyl group (i.e., —COOM wherein M represents a hydrogen atom or an alkali metal atom), a phosphonamido group, a diacylamino group, and imido group. Preferred examples of such substituents include an alkyl group (preferably having 1 to 20 carbon atoms), an aralkyl group (preferably having 7 to 30 carbon atoms), an alkoxy group (preferably having 1 to 20 carbon atoms), a substituted amino group (preferably amino group substituted by $C_{1-20}$ alkyl group), an acylamino group (preferably having 2 to 30 carbon atoms), sulfonamido group (preferably having 1 to 30 carbon atoms), a ureido group (preferably having 1 to 30 carbon atoms), and phosphoamido group (preferably having 1 to 30 carbon atoms). These groups may be further substituted.

In the general formula (1), the alkylene group represented by $R^1$ may be substituted. Typical examples of substituents on the substituted alkylene group include those described with reference to $Y^1$. $R^1$ preferably represents a $C_{1-20}$ alkylene group (an alkylene group having from 1 to 20 carbon atoms), more preferably a $C_{1-8}$ alkylene group, most preferably substituted or unsubstituted methylene group. The total number of carbon atoms contained in $Y^1$ and $R^1$ is preferably from 6 to 30, particularly from 8 to 20.

In the general formula (2), the group represented by $X^2$ has the same meaning as $X^1$ in the general formula (1). The same description of preferred embodiments as $X^1$ applies to $X^1$.

In the general formula (2), the electron withdrawing group represented by $Y^2$ is a group having a substituent constant σm or σp defined by Hammett et al of not less than 0.2, preferably not less than 0.3. The position on which $Y^2$ having am of not less than 0.2 (preferably not less than 0.3) is attached to the phenyl group is the meta-position with respect to carbonyl group. The position on which $Y^2$ having up of not less than 0.2 (preferably not less than 0.3) is attached to the phenyl group is the para-position with respect to carbonyl group. The position on which $Y^2$ having am and up of not less than 0.2, respectively (preferably not less than 0.3) is the meta-position and/or the para-position with respect to carbonyl group. Typical examples of the group represented by $Y^2$ include a sulfamoyl group, a carbamoyl group, an alkylsulfonyl group, an arylsulfonyl group, an alkylsulfinyl group, an arylsulfinyl group, a halogen atom, a cyano group, an alkyloxycarbonyl group, an aryloxycarbonyl group, an acyl group, a polyfluoroalkyl group, and polyfluoroaryl group.

$Y^2$ may be substituted. Typical examples of substituents of the substituted group include those described with reference to $Y^1$ in the general formula (1). $Y^2$ preferably represents a halogen atom, alkoxycarbonyl group, and cyano group.

In the general formula (2), the alkyl group represented by $R^2$ or the alkyl group contained in the alkoxy or the alkylthio group represented by $R^2$ is a straight-chain, branched or cyclic alkyl group. Typical examples of such an alkyl group include a methyl group, a dodecyl group, an isobutyl group, and a 2-ethylhexyl group. The aryl group represented by $R^2$ or the aryl group contained in the aryloxy or the arylthio group represented by $R^2$ is preferably a monocyclic or a bicyclic unsaturated carbon ring or an unsaturated heterocyclic group. Typical examples of such an aryl group include a benzene ring, a naphthalene ring, a pyridine ring, and a quinoline ring.

Examples of substituents of the substituted amino group represented by $R^2$ include an alkyl group, and an aryl group. Further examples of such substituents include acyl group (R—CO— group in which R is an alkyl or aryl group), an alkoxycarbonyl group, an aryloxycarbonyl group, a substituted or unsubstituted carbamoyl group, a substituted or unsubstituted hydrazinocarbonyl group, an alkylsulfonyl group, an arylsulfonyl group, and a substituted or unsubstituted sulfamoyl group. In the latter case, a carbonamido group, a urethane group (e.g., alkoxycarbonylamino), a ureido group, a semicarbazido group, a sulfonamido group, etc. are formed.

$R^2$ may be substituted. Typical examples of substituents of the substituted group include those described with reference to $Y^1$ in the general formula (1).

$R^2$ is preferably a hydrogen atom. The total number of carbon atoms contained in all $Y^2$'s and $R^2$'s in the general formula (2) is preferably from 6 to 30, particularly from 8 to 20.

Examples of the compound employable in the present invention will be given below, but the present invention should not be construed as being limited thereto.

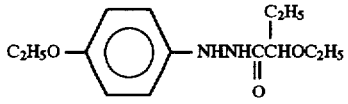

Compound 1

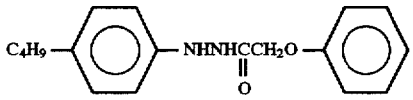

Compound 2

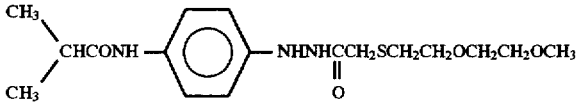

Compound 3

-continued
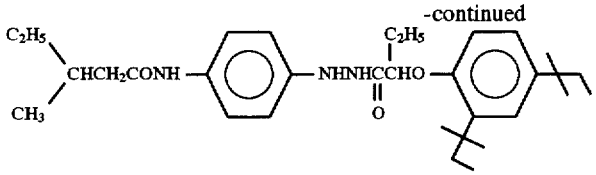
Compound 4
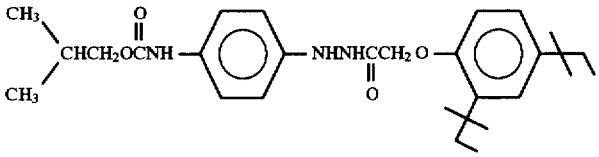
Compound 5
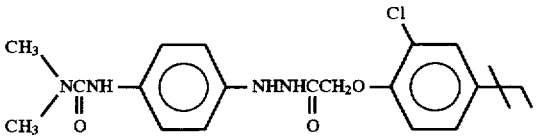
Compound 6
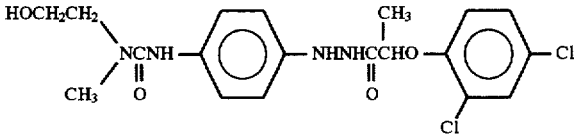
Compound 7
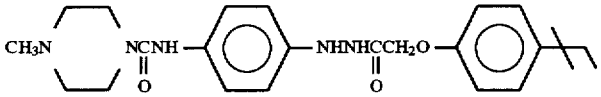
Compound 8
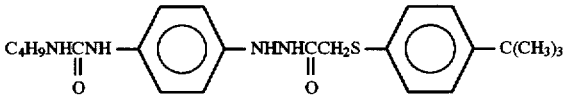
Compound 9
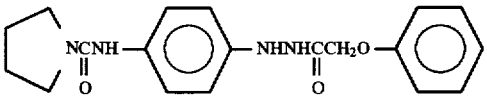
Compound 10
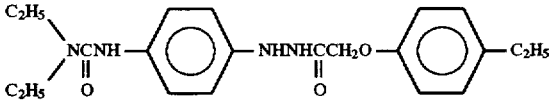
Compound 11
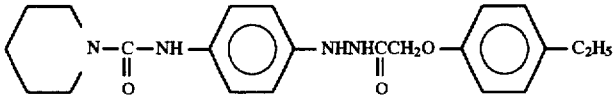
Compound 12
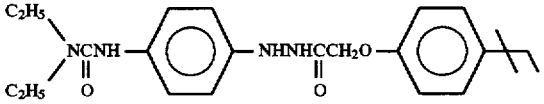
Compound 13
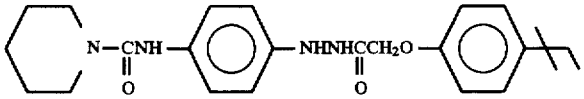
Compound 14
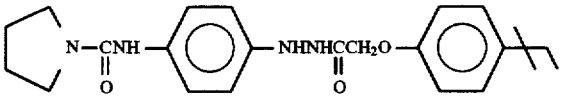
Compound 15
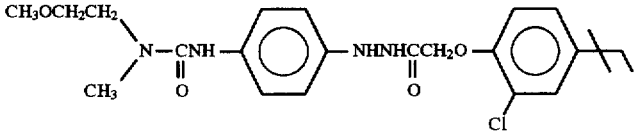
Compound 16

-continued
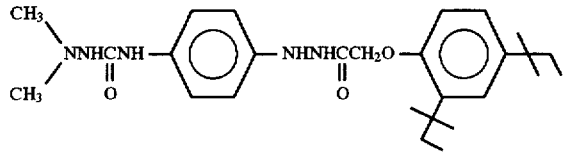
Compound 17
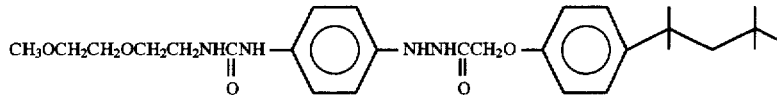
Compound 18
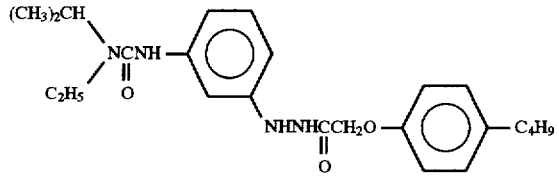
Compound 19
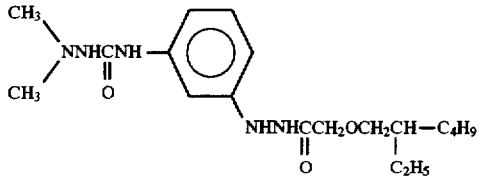
Compound 20
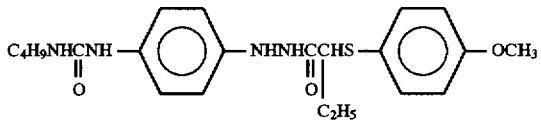
Compound 21
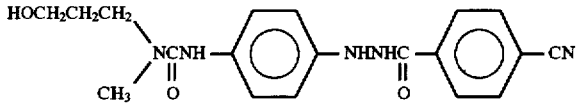
Compound 22
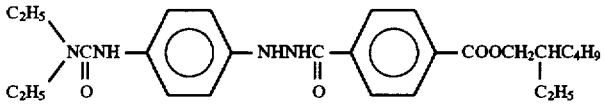
Compound 23
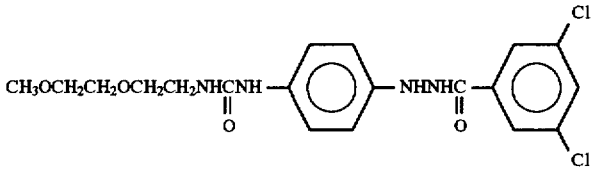
Compound 24
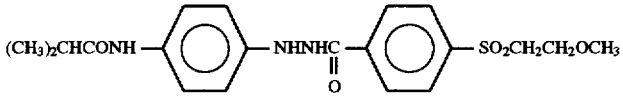
Compound 25
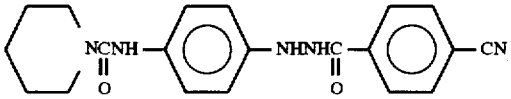
Compound 26
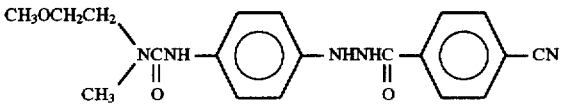
Compound 27

-continued
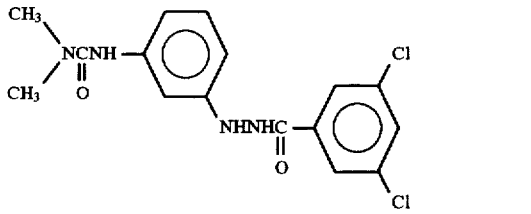
Compound 28
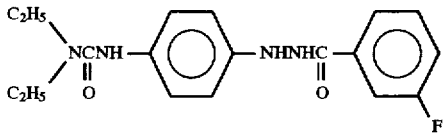
Compound 29
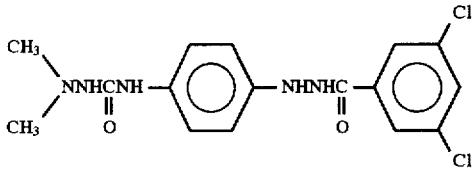
Compound 30
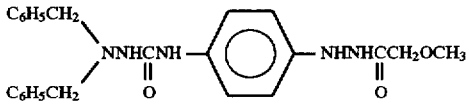
Compound 31
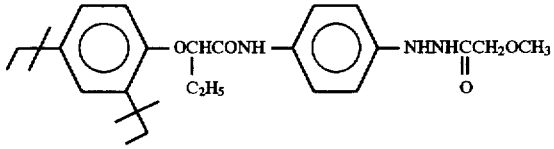
Compound 32
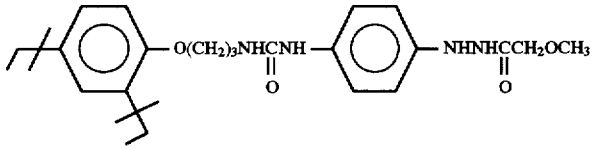
Compound 33
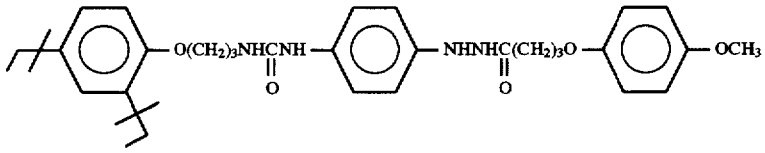
Compound 34
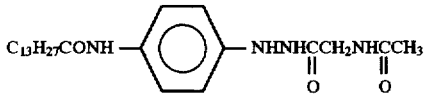
Compound 35
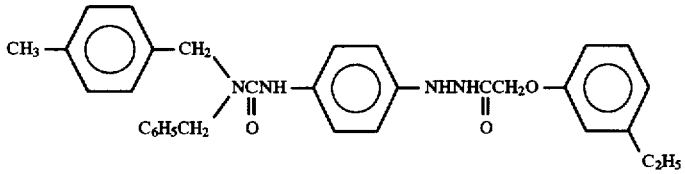
Compound 36
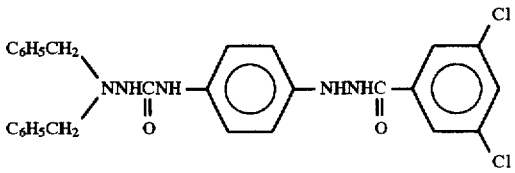
Compound 37

-continued

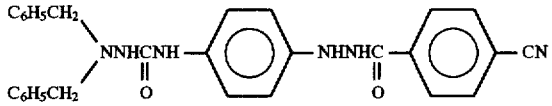

Compound 38

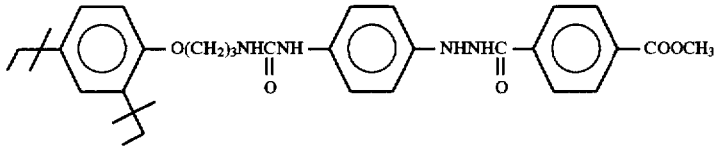

Compound 39

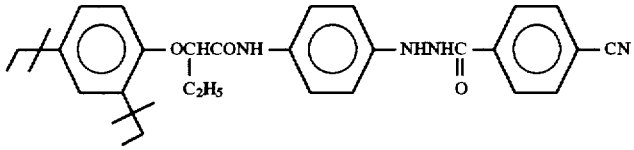

Compound 40

The hydrazine compounds used in the present invention are synthesized using the methods as disclosed in JP-A-61-213847, JP-A-62-260153, U.S. Pat. No. 4,684,604, JP-A-01-269936, U.S. Pat. Nos. 3,379,529, 3,620,746, 4,377,634 and 4,332,878, JP-A-49-129536, JP-A-56-153336, JP-A-56-153342, U.S. Pat. Nos. 4,988,604 and 4,994,365, and so on.

Specifically, the syntheses thereof are described below by taking the following two compounds as examples.

Synthesis Example 1

Synthesis of Compound 13 exemplified above

Into a solution containing imidazole (157 g) dissolved in tetrahydrofuran (1.5 l) was added Starting Material A (300 g) as illustrated below under cooling to 0° C. with stirring in an atmosphere of nitrogen. After the temperature of the resulting solution was raised to room temperature, the solution was stirred for 2 hours. Tereafter, p-nitrophenylhydrazine (153 g) dissolved in tetrahydrofuran (200 ml) was added to the reaction solution. The reaction solution was allowed to stand for one night, and then poured into water (3 l). The thus precipitated crystals were filtered off, washed successively with water and acetonitrile, and then dried under reduced pressure. Thus, an Intermediate A (346 g) illustrated below was obtained.

Starting Material A

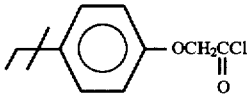

Intermediate A

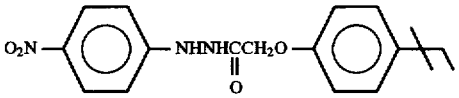

A mixture of Intermediate A (150 G), ammonium chloride (15 g), isopropyl alcohol (1.5 l) and water (150 ml) was heated under reflux in an atmosphere of nitrogen. To the refluxing mixture, reduced iron (150 g) was added gradually. After 1 hour heating under reflux, the resulting mixture was filtered with Celite to remove the insoluble matter. Upon cooling the obtained filtrate with stirring, crystals were deposited. These crystals were filtered off, and dried under reduced pressure to give Intermediate B (98 g) illustrated below.

Intermediate B

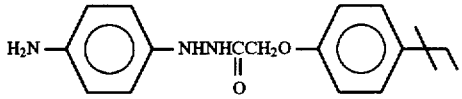

Triethylamine (8.0 ml) was added to a mixture of Intermediate B (18.0 g) with dimethylacetamide (100 ml) under cooling to 0° C. and stirring the solution, and subsequently thereinto was dropped N,N-dimethylcarbamoyl chloride (5.9 g). The temperature of resulting mixture was raised to room temperature and allowed to stand for one night. After completion of the reaction, the obtained reaction solution was poured into 0.5N aqueous solution of hydrochloric acid, extracted with ethyl acetate, washed with saturated brine, and dried over anhydrous magnesium sulfate. Then, the ethyl acetate was removed by distillation. The thus obtained matter was subjected to column chromatography on silica gel to isolate and to purify the product. Thus, the desired Compound 13 (9.2 g) was obtained. The chemical structure of the obtained product was ascertained by the measurements of NMR and IR spectra. m.p. 138°–139 ° C.

Synthesis Example 2

Synthesis of Compound 27 exemplified above

P-cyanobenzoyl chloride (310 g) was added to a solution of imidazole (256 g) dissolved in tetrahydrofuran (1.2) under cooling to 0° C. with stirring in an atmosphere of nitrogen. The temperature of the resulting solution was raised to room temperature and stirred for 1 hour. Thereafter, p-nitrophenylhydrazine (250 g) dissolved in tetrahydrofuran (300 ml) was further added. The reaction solution was allowed to stand for one night, and then poured into 0.1N aqueous solution of hydrochloric acid (3 l). The thus precipitated crystals were filtered off, washed successively with water and acetonitrile, and then dried under reduced pressure. Thus, Intermediate C (430 g) illustrated below was obtained.

Intermediate C

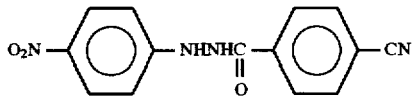

A mixture of Intermediate C (50 g), ammonium chloride (5 g), isopropyl slcohol (500 ml) and water (50 ml) was heated under reflux in an atmosphere of nitrogen. To the refluxing mixture, reduced iron (50 g) was added gradually. After 2 hours' heating under reflux, the resulting mixture was filtered with Celite to remove the insoluble matter. The obtained filtrate was cooled with stirring, and thereby crystals were precipitated. These crystals were filtered off, and dried under reduced pressure to give Intermediate D (35 g) illustrated below.

Intermediate D

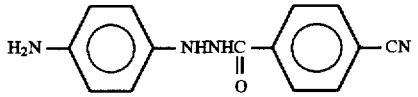

Pyridine (27 ml) was added to a mixture of Intermediate D (77 g), dimethylacetamide (300 ml) and acetonitrile (300 ml) in an atmosphere of nitrogen. Into the resulting solution was dropped phenyl chloroformate (50 g) under cooling (down to −10° C. or lower) and stirring. The resulting mixture was warmed up to room temperature, and the stirring was continued for 30 minutes. After the completion of the reaction, the reaction mixture was poured into 0.1N aqueous solution of hydrochloric acid to precipitate crystals. The crystals were washed successively with isopropyl alcohol and hexane, and dried under reduced pressure. Thus, Intermediate E (108 g) illustrated below was obtained.

Intermediate E

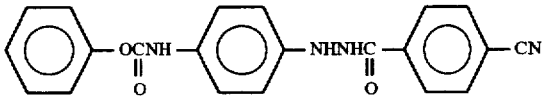

A mixture of N-methoxyethyl-N-methylamine (2.8 g), Intermediate E (11.2 g), imidazole (6.1 g) and acetonitrile (50 ml) was stirred for 5 hours at 50° C. in an atmosphere of nitrogen. After the completion of the reaction, the reaction mixture was poured into 0.1N aqueous solution of hydrochloric acid, extracted with ethyl acetate, washed with saturated brine, and dried over anhydrous magnesium sulfate. Then, the ethyl acetate was removed by distillation. The thus obtained matter was subjected to column chromatography on silica gel to isolate and to purify the product. Thus, the desired Compound 27 (5.5 g) was obtained. The chemical structure of the obtained product was ascertained by the measurements of NMR and IR spectra. m.p. 85°–88° C.

The silver halide photographic material according to the present invention may additionally comprises hydrazine compounds other than those represented by the general formulae (1) and (2) as nucleating agents. Specific examples which are preferred for use in combination with the hydrazine compounds of the present invention include the compounds represented by the following formula (N). These compounds are particularly preferred to attain processing stability and a high sensitivity.

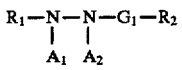

(N)

wherein $R_1$ represents an aliphatic group, an aromatic group, or a heterocyclic group and may or may not be substituted; $R_2$ represents a hydrogen atom, an alkyl group, an aryl group, an alkoxy group, an aryloxy group, an amino group, or a hydrazino group, and the groups other than the hydrogen atom may or may not be substituted; $G_1$ represents a carbonyl group, a sulfonyl group, a sulfoxy group, —P(O)($R_3$)— (where $R_3$ is selected from the same substituents as those defined for $R_2$),—C(O)C(O)—, a thiocarbonyl group, or an iminomethylene group; both $A_1$ and $A_2$ represent a hydrogen atom, or either of them represents a hydrogen atom and another represents a substituted or unsubstituted alkylsulfonyl group, a substituted or unsubstituted arylsulfonyl group, or a substituted or unsubstituted acyl group.

Formula (N) is explained in further detail.

In Formula (N), the aliphatic group represented by $R_1$ has preferably a carbon number of 1 to 30 and particularly is a linear, branched or cyclic alkyl group having a carbon number of 1 to 20. This alkyl group may have a substituent.

In Formula (N), the aromatic group represented by $R_1$ is a monocyclic or dicyclic aryl group or an unsaturated heterocyclic group, wherein the unsaturated heterocyclic group may be condensed with an aryl group.

Preferred as $R_1$ is an aryl group, particularly preferably an aryl group containing a benzene ring.

In the case where $R_1$ is an aliphatic group or aromatic group in Formula (N), therecan be enumerated as typical substituents, an alkyl group, an aralkyl group, an alkenyl group, an alkynyl group, an alkoxy group, an aryl group, a substituted amino group, a ureido group, a urethane group (e.g., alkoxycarbonylamino group), an aryloxy group, a sulfamoyl group, a carbamoyl group, an alkyl- or arylthio group, an alkyl- or arylsulfonyl group, an alkyl- or arylsulfinyl group, a hydroxy group, a halogen atom, a cyano group, a sulfo group (i.e., —$SO_3M$ wherein M represents a hydrogen atom or an alkali atom), an aryloxycarbonyl group, an acyl group, a alkoxycarbonyl group, an acyloxy group, a carbonamido group, a sulfonamido group, a carboxyl group (i.e., —COOM wherein M represents a hydrogen atom or an alkali atom), a phosphoric amido group, a diacylamido group, an imido group, and $R_4$—NHC(O)—N($R_5$)C(O)— ($R_4$ and $R_5$ are selected from the same groups as those defined for $R_2$ and may be the same as or different from each other). The preferred substituents are an alkyl group (having preferably a carbon number of 1 to 20), an aralkyl group (having preferably a carbon number of 7 to 30), an alkoxy group (having preferably a carbon number of 1 to 20), a substituted amino group (preferably an amino group substituted with an alkyl group having a carbon number of 1 to 20), an acylamino group (having preferably a carbon number of 2 to 30), a sulfonamide group (having preferably a carbon number of 1 to 30), a ureido group (having preferably a carbon number of 1 to 30), and a phosphoric amido group (having preferably a carbon number of 1 to 30). These groups may further be substituted.

Further, it may contain the partial structure of —O—$(CH_2CH_2O)_n$—, —O—$(CH_2CH(CH_3)O)_n$—, or —O—$(CH_2CH(OH)—CH_2O)_n$— (provided that n is an integer of 3 or more) as a part of the substituent, or may have a group containing a quaternary ammonium cation as a part of the substituent.

In Formula (N), the heterocyclic group represented by $R_1$ is a 3- to 10-membered saturated or unsaturated hetero ring containing at least one of an N, O and S atom. These rings may be a single ring or may further form a condensed ring with other aromatic or hetero rings. The hetero ring is preferably a 5- or 6-membered aromatic heterocyclic group. Preferred are those containing, for example, a pyridine group, an imidazolyl group, a quinolinyl group, a benzimidazolyl group, a pyrimidyl group, a pyrazolyl group, an isoquinolinyl group, a thiazoline group, and a benzothiazolyl group.

$R_1$ is preferably an aromatic group, a nitrogen-containing heterocyclic ring, or the group represented by the following Formula (b):

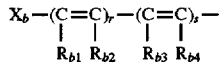

(b)

wherein $X_b$ represents an aromatic group or a nitrogen-containing heterocyclic group; $R_{b1}$ to $R_{b4}$ each represents a hydrogen atom, a halogen atom, or an alkyl group, and $X_b$ and $R_{b1}$ to $R_{b4}$ may have a substituent if possible; and r and s each represents 0 or 1.

$R_{b1}$ is preferably an aromatic group and an aryl group is particularly preferred.

$R_{b1}$ to $R_{b4}$ may be substituted with a substituent. There can be enumerated as examples of the substituents, an alkyl group, an aralkyl group, an alkenyl group, an alkynyl group, an alkoxy group, an aryl group, a substituted amino group, an aryloxy group, a sulfamoyl group, a carbamoyl group, an alkylthio group, an arylthio group, an alkyl- and aryl-sulfonyl group, an alkyl- and aryl- sulfinyl group, a hydroxy group, a halogen atom, a cyano group, a sulfo group (i.e., —$SO_3M$ wherein M represents a hydrogen atom or an alkali atom), a carboxyl group (i.e., —COOM wherein M represents a hydrogen atom or an alkali atom), an alkyl- or aryloxycarbonyl group, an acyl group, a alkoxycarbonyl group, an acyloxy group, a carbonamido group, a sulfonamido group, a nitro group, an alkylthio group, and an arylthio group. In addition thereto, the group represented by the following Formula (c) can be enumerated:

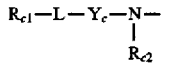

(c)

wherein $Y_c$ represents —CO—, —$SO_2$—, —P(O)($R_{c3}$)— (in which $R_{c3}$ represents an alkoxy group, such as methoxy, ethoxy, and hexanoxy or an aryloxy group, such as phenoxy, 4-chlorophenoxy, 4-methyl-phenoxy, and 2-methyl-phenoxy), or —OP(O)($R_{c3}$)—; L represents a single bond, —O—, —S—, or —$NR_{c4}$— (in which $R_{c4}$ represents a hydrogen atom, an alkyl group, or an aryl group) ; and $R_{c1}$ and $R_{c2}$ each represents a hydrogen atom, an aliphatic group, an aromatic group, or a heterocyclic group and may be the same or different, or may be combined with each other to form a ring.

Further, $R_1$ can contain one or more groups represented by Formula (c).

In Formula (c), the aliphatic group represented by $R_{c1}$ is a linear, branched or cyclic alkyl group, an alkenyl group, or an alkynyl group having 1 to 30 carbon atoms.

The aromatic group represented by $R_{c1}$ is a monocyclic or dicyclic aryl group and there can be enumerated, for example, a phenyl group and a naphthyl group.

The hetero ring represented by $R_{c1}$ is a 3- to 10-membered saturated or unsaturated hetero ring containing at least one of an N, O or S atom. These may be a single ring or may further form a condensed ring with the other aromatic or hetero rings. The hetero ring is preferably a 5- or 6-membered aromatic heterocyclic group. Preferred are those containing, for example, a pyridine group, an imidazolyl group, a quinolinyl group, a benzimidazolyl group, a pyrimidyl group, a pyrazolyl group, an isoquinolinyl group, a thiazolyl group, and a benzothiszolyl group.

$R_{c1}$ may be substituted with a substituent. For example, the following can be enumerated as the substituents. These groups may further be substituted.

They are, for example, an alkyl group, an aralkyl group, an alkenyl group, an alkynyl group, an alkoxy group, an aryl group, a substituted amino group, an acylamino group, an alkyl- and aryl- sulfonylamino group, a ureido group, a urethane group (e.g., alkoxycarbonylamino group), an aryloxy group, a sulfamoyl group, a carbamoyl group, an alkylthio group, an arylthio group, an alkyl- and aryl-sulfonyl group, an alkyl- and aryl- sulfinyl group, a hydroxy group, a halogen atom, a cyano group, a sulfo group (e.g., —$SO_3M$ wherein M represents a hydrogen atom or an alkali metal atom), a carboxyl group (e.g., —COOM wherein M represents a hydrogen atom or an alkali metal atom), an alkyl- and aryloxycarbonyl group, an acyl group, an alkoxy-carbonyl group, an acyloxy group, a carbonamido group, a sulfonamido group, a nitro group, an alkylthio group, and an arylthio group.

These groups may be combined with each other to form a ring if possible.

The aliphatic group represented by $R_{c2}$ in Formula (c) is a linear, branched or cyclic alkyl group, an alkenyl group, or an alkynyl group having 1 to 30 carbon atoms.

The aromatic group represented by $R_{c2}$ is a monocyclic or dicyclic aryl group, and for example a phenyl group.

$R_{c2}$ may be substituted with a substituent. There can be enumerated as the substituents, for example, those enumerated as the substituents for $R_{c1}$.

Further, $R_{c1}$ and $R_{c2}$ may be combined with each other to form a ring if possible.

A hydrogen atom is more preferred as $R_{c2}$.

Particularly preferred as $Y_c$ in Formula (c) are —CO— and —$SO_2$—, and L is preferably a single bond or —$NR_{c4}$—.

The aliphatic group represented by $R_{c4}$ in Formula (c) is a linear, branched or cyclic alkyl group, an alkenyl group, or an alkynyl group having 1 to 30 carbon atoms.

The aromatic group represented by $R_{c4}$ is a monocyclic or dicyclic aryl group, for example a phenyl group.

$R_{c4}$ may be substituted with a substituent. There can be enumerated as the substituent, for example, those enumerated as substituents for $R_{c1}$.

A hydrogen atom is more preferred as $R_{c4}$.

In the case where $G_1$ is a —C(O)— group, the preferred group represented by $R_2$ is a hydrogen atom, an alkyl group having 1 to 30 carbon atoms (for example, methyl, trifluoromethyl, 3-hydroxypropyl, 3-methanesulfonamidopropyl, n-propyl, methoxyethyl, methoxymethyl, phenoxymethyl, and phenylsulfonylmethyl), an aralkyl group having 1 to 30 carbon atoms (for example, o-hydroxybenzyl), and an aryl group (for example, phenyl, 3,5-dichlorophenyl, o-methanesulfonamidophenyl, 4-methanesulfonylphenyl, 4-cyanophenyl, 4-bromophenyl, 2,5-dichlorophenyl, and 2-hydoxymethylphenyl).

Further, $R_2$ may permit the moiety of $G_1$—$R_2$ to split off from the remainder of the compound of Formula (N) and may cause a cyclization reaction in which a cyclic structure containing the atoms in the moiety of —$G_1$—$R_2$ is formed. Therecan be enumerated as examples thereof, the compounds described in JP-A-63-29751.

A hydrogen atom is the most preferable as Al and $A_2$.

$R_1$ or $R_2$ in Formula (N) may have a ballast group or a polymer incorporated thereinto, which is conventionally used for an immobile photographic additive such as a coupler. The ballast group is a group which has 8 or more carbon atoms and is comparatively inactive on photographic characteristics, and can be selected from, for example, an alkyl group, an alkoxy group, a phenyl group, an alkylphenyl group, a phenoxy group, and an alkylphenoxy group. Also, the eompounds described in JP-A-1-100530 can be enumerated as the polymer.

A group promoting adsorption to the surface of a silver halide grain may be incorporated into $R_1$ or $R_2$ in Formula (N). There can be enumerated as such adsorbing groups, the groups described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, and JP-A-63-234246, such as a thiourea group, a heterocyclic thioamido group, a mercapto heterocyclic group, and a triazole group.
Examples of the compounds represented by Formula (N) are shown below but the present invention is not limited to the following compounds.
N-1)
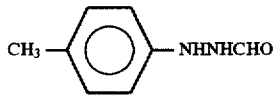
N-2)
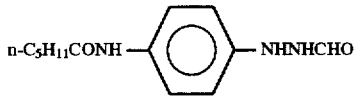
N-3)
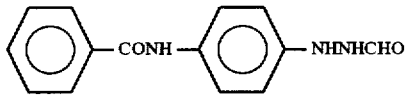
N-4)
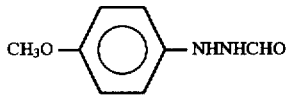
N-5)
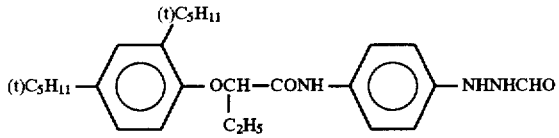
N-6)
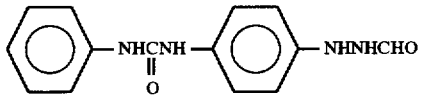
N-7)
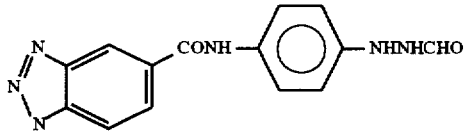
N-8)
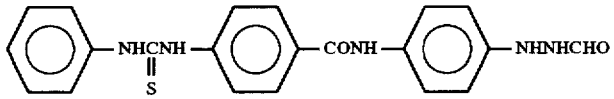
N-9)
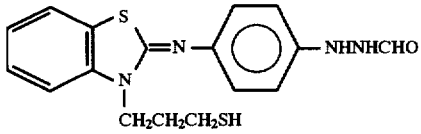
N-10)
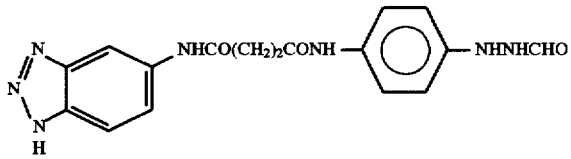
N-11)
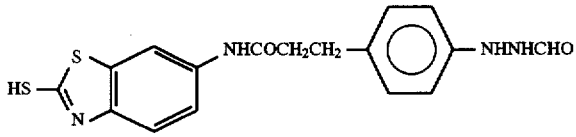

-continued
N-12)
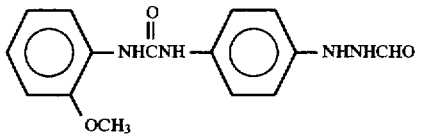
N-13)
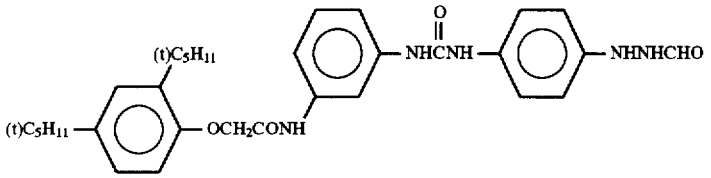
N-14)
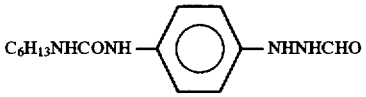
N-15)
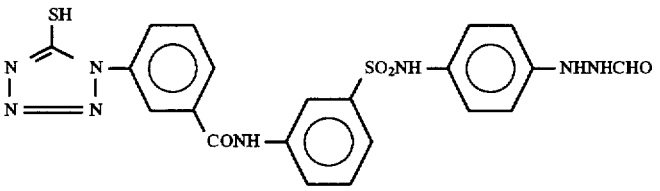
N-16)
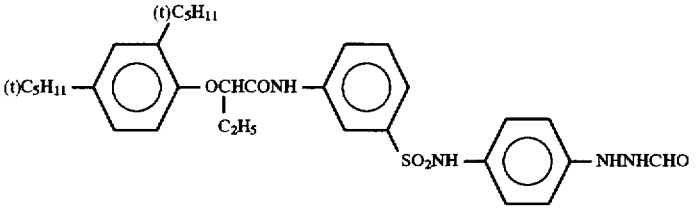
N-17)
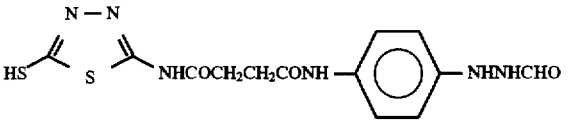
N-18)
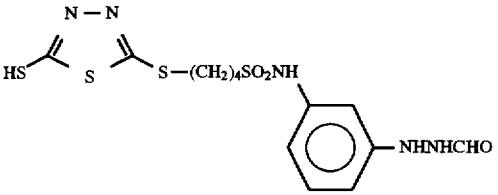
N-19)
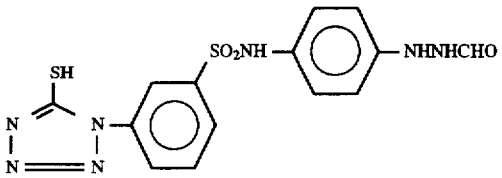
N-20)
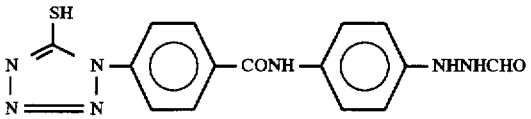

-continued
N-21)
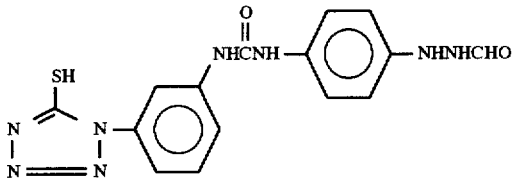
N-22)
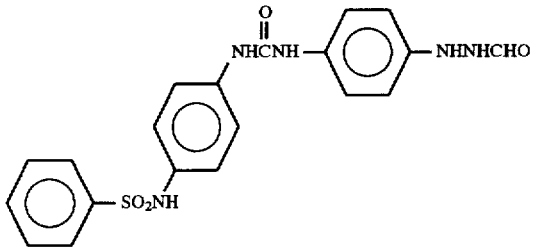
N-23)
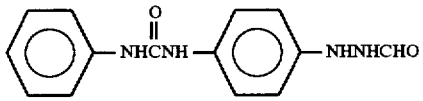
N-24)
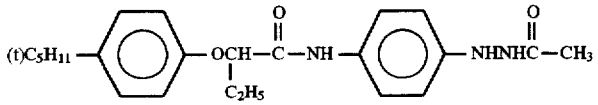
N-25)
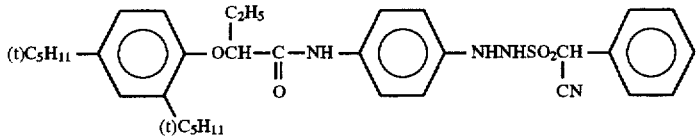
N-26)
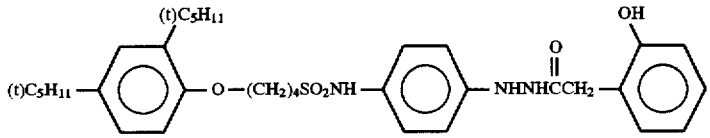
N-27)
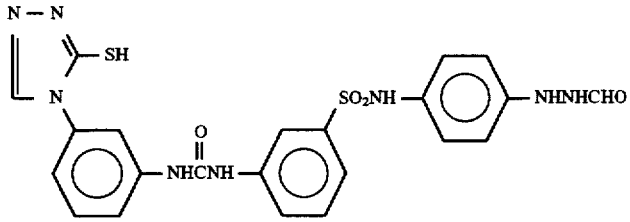
N-28)
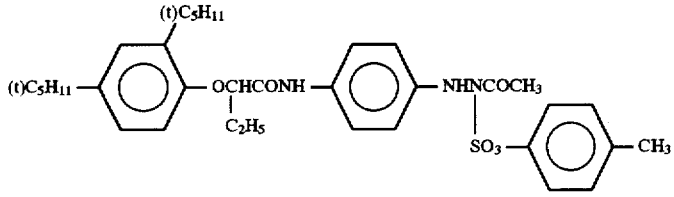
N-29)
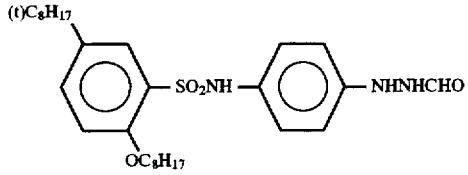

-continued
N-30)
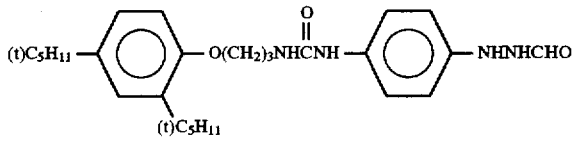
N-31)
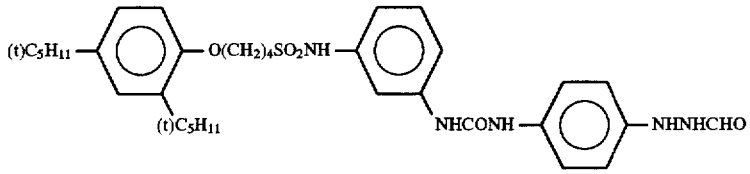
N-32)
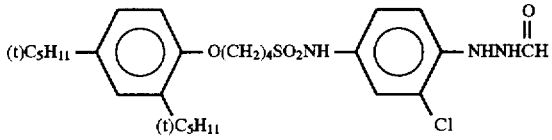
N-33)
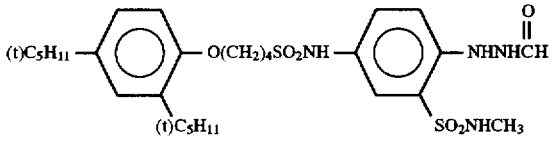
N-34)
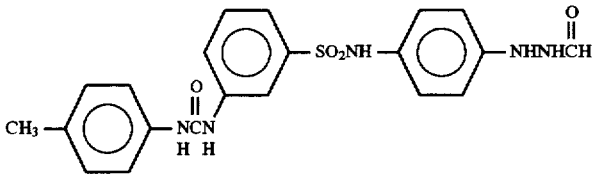
N-35)
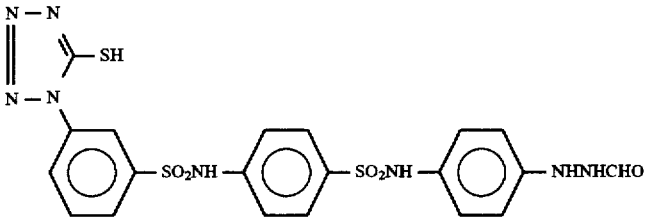
N-36)
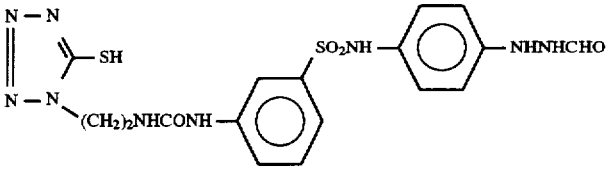
N-37)
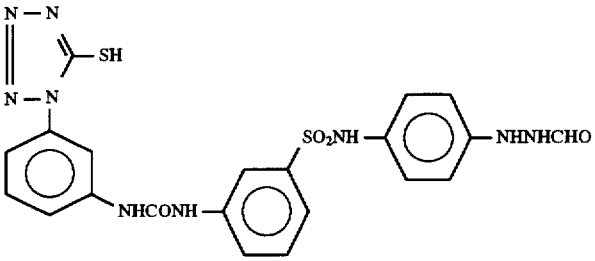
N-38)
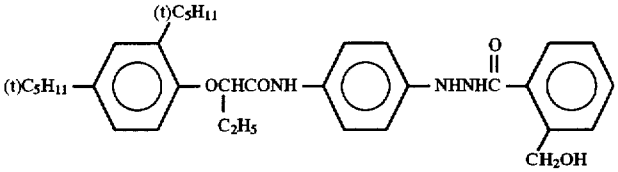

-continued
N-39)
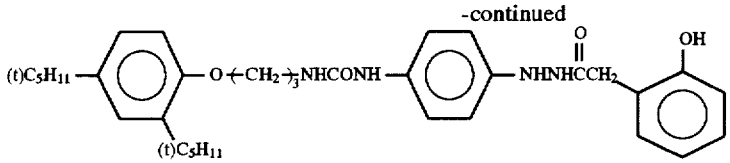
N-40)
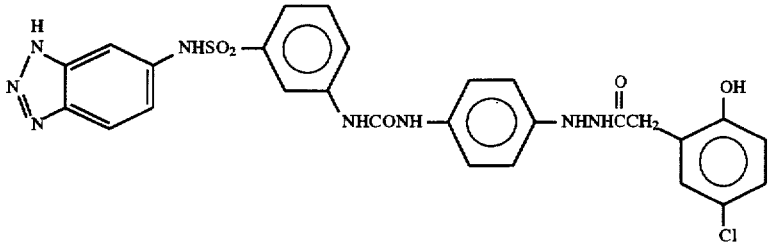
N-41)
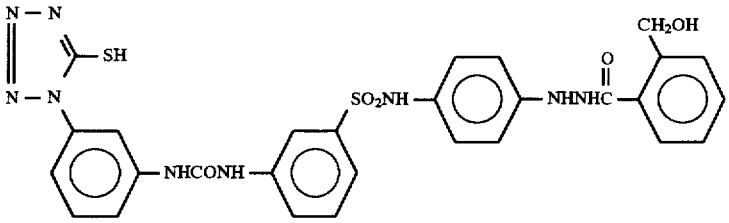
N-42)
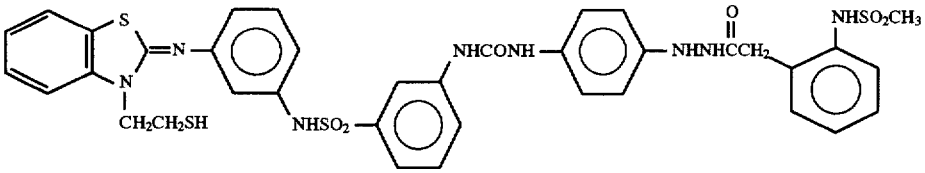
N-43)
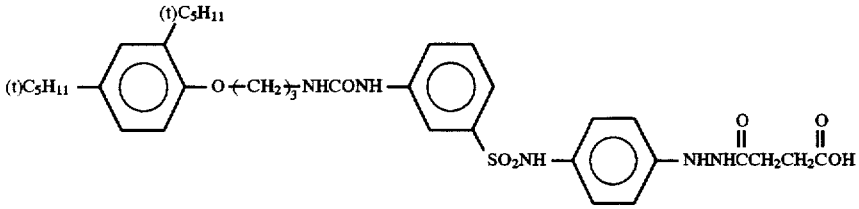
N-44)
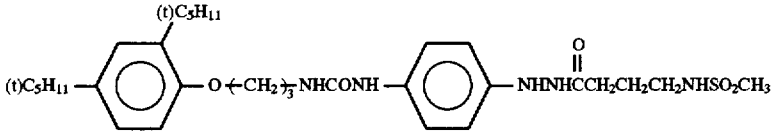
N-45)
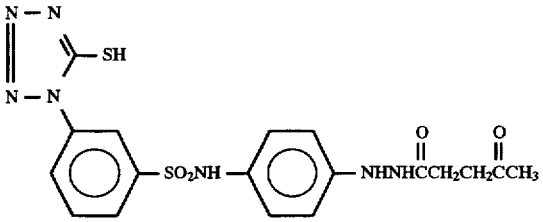
N-46)
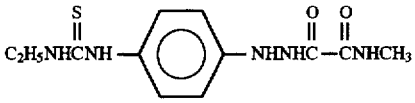
N-47)
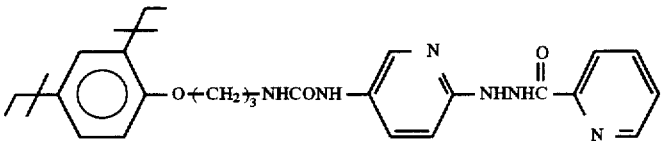

-continued
N-48)
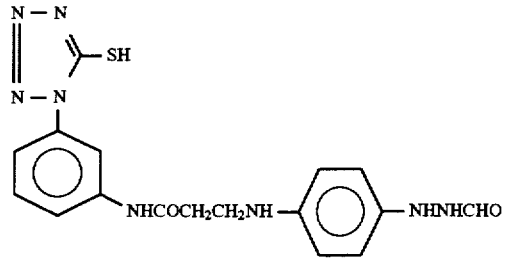
N-49)
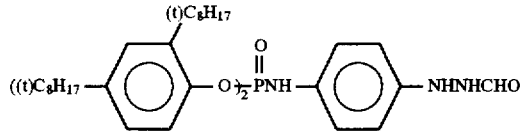
N-50
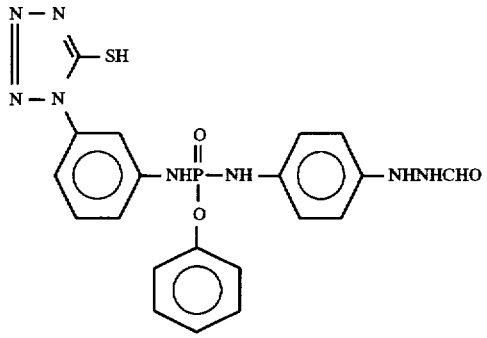
N-51)
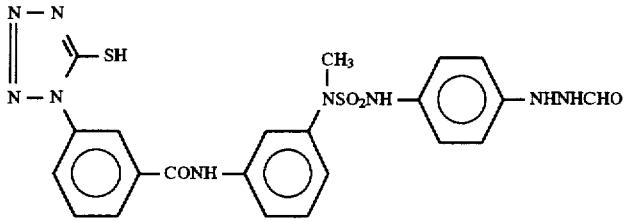
N-52)
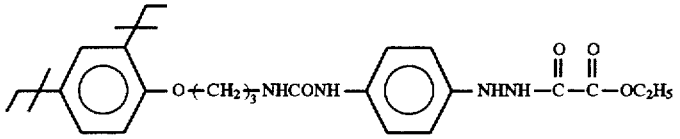
N-53)
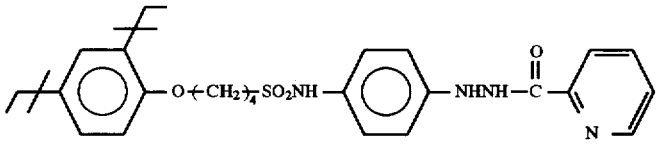
N-54)
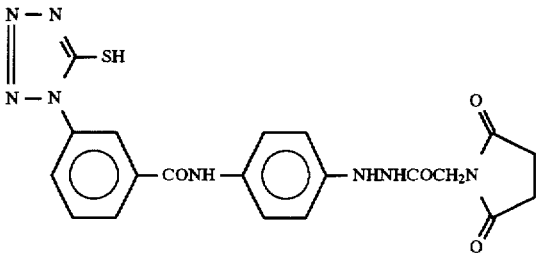

-continued
N-55)
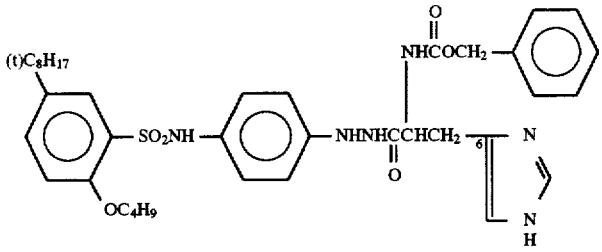
N-56)
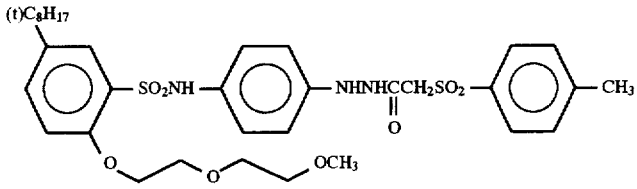
N-57)
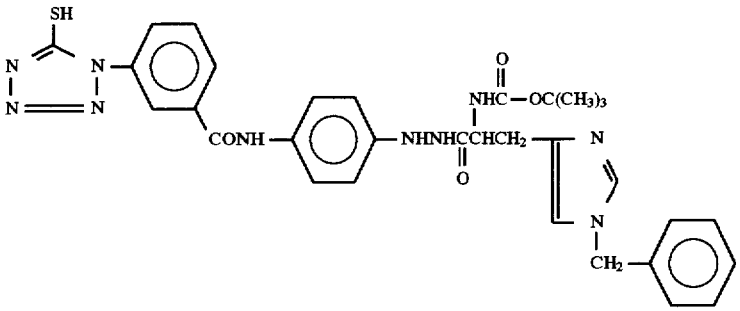
N-58)
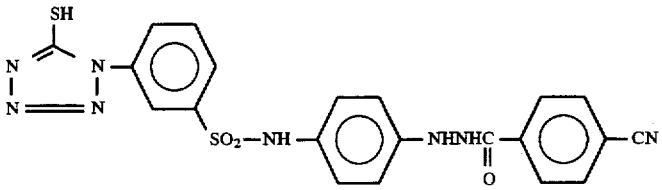
N-59)
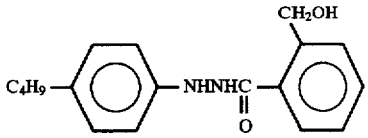
N-60)
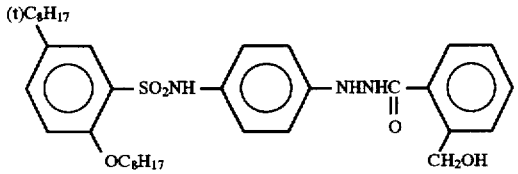
N-61)
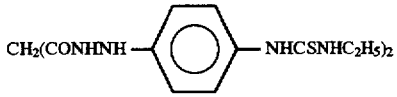
N-62
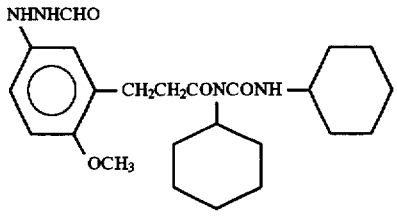

-continued
N-63)
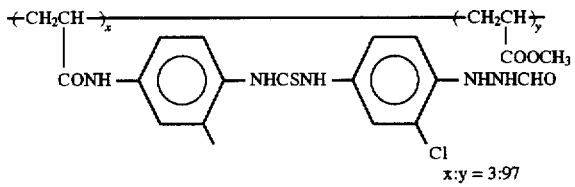
(by weight)
Average molecular weight: approx. 100,000
N-64)
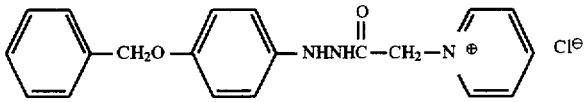
N-65)
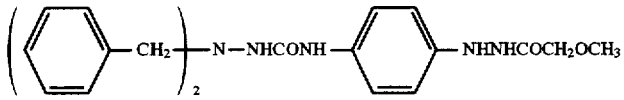
N-66)
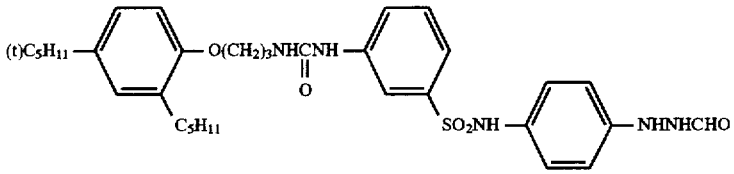
N-67)
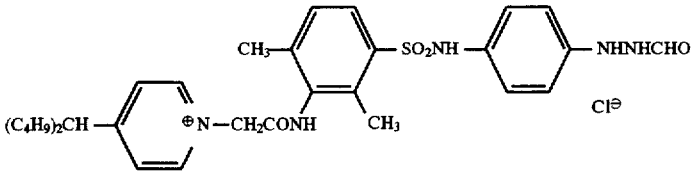
N-68)
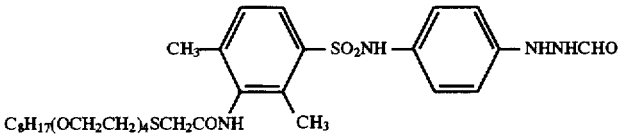
N-69)
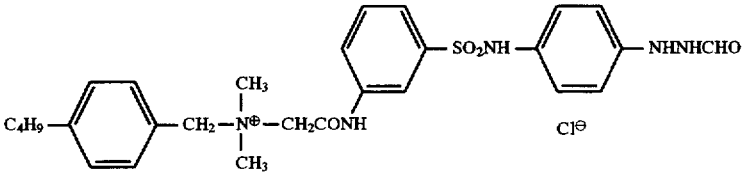
N-70)
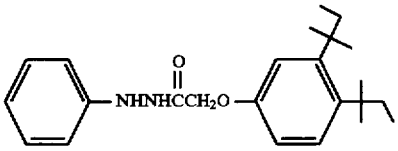
N-71)
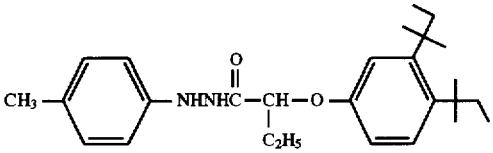

-continued

N-72)

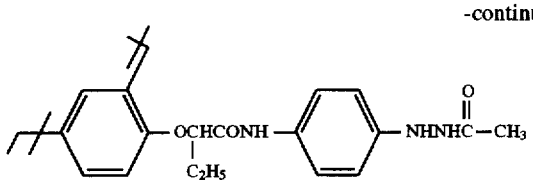

N-73)

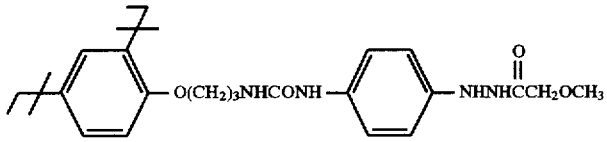

N-74)

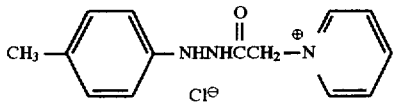

N-75)

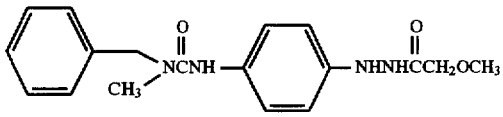

In the present invention, the amount of the hydrazine compound as a nucleating agent to be added is preferably in the range of $1\times10^{-6}$ mol to $5\times10^{-2}$ mol, particularly $1\times10^{-5}$ mol to $2\times10^{-2}$ mol per mol of silver halide (based on the total amount of silver halide in the photographic material).

If the silver halide photographic material according to the present invention further comprises hydrazine compounds other than those represented by the general formulae (1) and (2) as nucleating agents, the molar proportion of these hydrazine compounds to those represented by the general formulae (1) and (2) is preferably in the range of 1:100 to 100:1, particularly 1:20 to 20:1.

In the present invention the nucleating agent may be incorporated into at least one of silver halide emulsion layer(s), the light-insensitive hydrophilic colloid layer(s) (provided between a silver halide emulsion layer and the support) and other hydrophilic colloid layer(s). In particular, the nucleating agent is preferably incorporated into at least one of the silver halide emulsion layer(s) and its adjacent layer(s).

The layer structure of the silver halide photographic material according to the present invention will be described hereinafter.

The silver halide photographic material according to the present invention is characterized by a layer structure in which a light-insensitive layer consisting of at least a hydrophilic colloid layer is provided interposed between a support and a silver halide emulsion layer. This layer is particularly effective to reduce the number and area of black peppers and to improve characteristics of copy dots and enlarged dots.

The thickness of the hydrophilic colloid layer (in the dried state) is not specifically limited but preferably is not less than 0.1 μm and is not more than 2 μm, more preferably within the range of from 0.3 to 1.0 μm, and particularly preferably is within the range of from 0.3 to 1.5 μm. The number of hydrophilic colloid layers is not specifically limited. No matter how many hydrophilic colloid layers, including one, are provided, their effect can be exerted.

The hydrophilic colloid layer provided between the support and the silver halide emulsion layer preferably contains a polymer latex. The amount of the polymer latex is preferably from 0.1 to 1.0 g/m$^2$ (solid), more preferably from 0.1 to 0.5 g/m$^2$. Polymer latexes disclosed in JP-A-2-103536, page 18, left lower column, lines 12 to 20 are preferably used in the present invention.

The hydrophilic colloid layers may comprise the foregoing hydrazine derivatives and/or other compounds, e.g., solid-dispersible dye, redox compound which undergoes oxidation to release a development inhibitor, gelatin hardener, surface active agent and fog inhibitor as mentioned later.

The hydrophilic colloid layers other than the above-described hydrophilic colloid layer are those which do not contain a light-sensitive silver halide, such as an interlayer and a protective layer.

As a hydrophilic colloid used in a hydrophilic colloid layer, compounds disclosed in JP-A-2-18542, page 3, right lower column lines 1 to 20 are preferred and gelatin (lime-processed gelatin, acid-processed gelatin, enzymatically decomposed gelatin, phthalated gelatin and acetylated gelatin) is particularly preferred.

The halogen composition of the silver halide emulsion to be incorporated in the silver halide photographic material according to the present invention is not specifically limited and may be any of silver chloride, silver bromochloride, silver bromochloroiodide, silver bromide and silver bromoiodide. The silver chloride content of the silver halide emulsion is preferably not less than 30 mol %, more preferably not less than 50 mol %. Silver bromochloride or silver bromochloroiodide is preferred. The silver iodide content of the silver halide emulsion is preferably not more than 3 mol %, more preferably not more than 0.5 mol %. The silver halide emulsion grains may have a so-called core/shell structure in which the halogen composition differs between core and shell.

The crystal form of silver halide emulsion grains according to the present invention may be cube, tetradecahedron, octahedron, amorphous, sphere, tablet or composite thereof but is preferably regular crystal form, particularly cube. The silver halide grains may be uniform in phase between core and shell or may differ in phase between core and shell.

The average grain size of silver halide emulsion grains according to the present invention is preferably from 0.1 μm to 0.7 μm, more preferably from 0.2 μm to 0.5 μm. The grain size distribution is preferably monodisperse. The term "monodisperse emulsion" as used herein means an "emulsion of silver halide grains having a grain size variation coefficient of not more than 20%, particularly preferably not more than 15%". The grain size variation coefficient (%) as used herein is obtained by multiplying the division of the standard deviation of grain diameter by the average grain diameter by 100. More preferably, the grain diameter distribution is as narrow as not more than 10% as calculated in terms of grain size variation coefficient.

The preparation of silver halide grains to be used in the present invention can be accomplished by any suitable method as disclosed in P. Glafkides, *Chimie et Physique Photographique*, Paul Montel, 1967, G. F. Duffin, *Photographic Emulsion Chemistry*, The Focal Press, 1966, and V. L. Zelikman et al., *Making and Coating Photographic Emulsion*, The Focal Press, 1964.

In some detail, the emulsion can be prepared by any of the acid process, the neutral process, the ammonia process, etc. The reaction between a soluble silver salt and a soluble halogen salt can be carried out by any of a single jet process, a double jet process, a combination thereof, and the like. A method in which grains are formed in the presence of excess silver ions (so-called reverse mixing method) may be used.

Further, a so-called controlled double jet process, in which a pAg value of a liquid phase in which silver halide grains are formed is maintained constant, may also be used. According to the controlled double jet process, a silver halide emulsion having a regular crystal form and an almost uniform grain size can be obtained.

In order to provide a uniform grain size, a method which comprises changing the rate at which a silver nitrate or halogenated alkali is added depending on the growth speed of grains as disclosed in U.S. Pat. No. 1,535,016, and JP-B-48-36890 and JP-B-52-16364 (The term "JP-B" as used herein means an "examined Japanese patent publication") or a method which comprises changing the concentration of an aqueous solution as disclosed in British Patent 4,242,445, and JP-A-55-158124 may be used to allow grains to grow rapidly within the critical saturation degree.

The grain formation of the silver halide emulsion used in the present invention may be carried out in the presence of a silver halide solvent such as ammonia, tetra-substituted thiourea and organic thioether compound, particularly tetra-substituted thiourea and organic thioether compound. Preferred examples of tetra-substituted thiourea silver halide solvents include compounds as disclosed in JP-A-53-82408, and JP-A-55-77737. Specific examples of such silver halide solvents include tetramethylthiourea, and 1,3-dimethyl-2-imidazolidinethione. Examples of organic thioether silver halide solvents which may be preferably used in the present invention include a compound containing at least one group wherein an oxygen atom and a sulfur atom separated by ethylene (e.g., —O—$CH_2CH_2$—S—) as disclosed in JP-B-47-11386 (U.S. Pat. No. 3,574,628), and a chain thioether compound containing an alkyl group (this alkyl group contains at least two substituents selected from a hydroxyl group, an amino group, a carboxyl group, an amido group and sulfo group) at its both ends as disclosed in JP-A-54-155828 (U.S. Pat. No. 4,276,374).

The amount of the silver halide solvent to be incorporated in the system depends on the kind of compounds used and the desired grain size and halogen composition and is preferably in the range of $10^{-5}$ to $10^{-2}$ mol per mol of silver halide. If the grain size exceeds the desired value due to the use of a silver halide solvent, the desired grain size can be obtained by altering the temperature at which grains are formed, the time at which a silver salt solution and a halogen salt solution are added to the system, and other factors.

The silver halide emulsion used in the present invention may contain the group VIII metal atoms. In particular, in order to attain a high sensitivity and a high contrast, the silver halide emulsion preferably contains iridium atom, rhodium atom or iron atom.

Metals of the group VIII in the periodic table are iron, cobalt, nickel, ruthenium, rhodium, palladium, osmium, iridium, and platinum. Examples of compounds containing these metals which can be preferably used in the present invention include halides of various metallic atoms, water-soluble complex salts comprising nuclear metal complex salts with halogen atoms, $H_2O$ , amines, cyan, oxalate, nitrosil, thionitrosil, etc. as ligands, particularly hexacoordinated complexes, and water-soluble compounds as disclosed in JP-A-63-2042, JP-A-1-285941, JP-A-2-20852, JP-A-2-20853, JP-A-2-20854, and JP-A-2-20855.

Specific examples of rhodium compounds which can be preferably used in the present invention include halogenated rhodium (III) compounds, hexachlororhodium (III) complex salts, tetrachloroacorhodium (III) complex salts, hexabromorhodium (III) complex salts, hexaminerhodium (III) complex salts, tetrabromonitrosilrhodium (III) complex salts, and tetrachlorothionitrosilrhodium (III) complex salts. Specific examples of iridium compounds which can be preferably used in the present invention include hexachloroiridium (III) complex salts, hexachloroiridium (IV) complex salts, hexabromoiridium (III) complex salts, hexamineiridium (III) complex salts, and hexacyanoiridium (III) complex salts. Specific examples of iron compounds which can be preferably used in the present invention include ferrous sulfate (II), ferric chloride (III), hexacyanoferrate (II) complex salts, and hexacyanoferrate (III) complex salts.

These compounds may be used in the form of aqueous solution or solution in a proper solvent. In order to stabilize these compounds in the form of solution, a commonly practiced method may be used, i.e., a method which comprises the addition of an aqueous solution of hydrogen halide (e.g., hydrochloric acid, bromic acid, fluoric acid) or halogenated alkali (e.g., KCl, NaCl, NaBr). Instead of using such a water-soluble metal compound, separate silver halide grains doped with a metal may be added to and dissolved in the system during the preparation of silver halide.

The addition of these compounds to the system can be properly effected at each step during the preparation of a silver halide emulsion and before the coating of the silver halide emulsion. In particular, these compounds are preferably added to the system during the formation of silver halide grains so that they can be incorporated in the silver halide grains.

In order to add the above mentioned metal atoms of the group VIII to the system during the formation of grains, they may be preferably incorporated in a water-soluble silver salt or water-soluble halide solution to be simultaneously added to the system. Alternatively, when a silver salt and a halide solution are simultaneously added to the system, silver halide grains may be prepared using the metal as a third solution and using a manner wherein the three solutions are simultaneously added. Furthermore, an aqueous solution of a salt of the group VIII metal may be charged into a reaction vessel in a required amount during or immediately after the formation of grains or during or at the end of physical ripening of grains. In particular, a salt of the group VIII metal is preferably added to a halide solution in the form of powder or aqueous solution containing NaCl and KCl.

These compounds of the group VIII metal are used singly or in combination generally in an amount of $10^{-9}$ to $10^{-3}$ mol, particularly $10^{-8}$ to $10^{-6}$ mol per mol of silver halide.

Preferred among salts of the group VIII metal are iridium salt, rhodium salt, and iron salt. Two or three these metal salts are advantageously used.

The silver halide emulsion according to the present invention is preferably subjected to chemical sensitization. As such a chemical sensitization there may be used a known method such as a sulfur sensitization method, a selenium sensitization method, a tellurium sensitization method and a noble sensitization method, singly or in combination. Preferred examples of combination of these chemical sensitization methods include a combination of a sulfur sensitization method and a gold sensitization method, a combination of a sulfur sensitization method, a selenium sensitization method and a gold sensitization method, and a combination of a sulfur sensitization method, a telluirium sensitization method and a gold sensitization method.

In the present invention the sulfur sensitization method is normally effected by stirring the emulsion with a sulfur sensitizer at a temperature as high as not lower than 40° C. for a predetermined period of time. As such a sulfur sensitizer there may be used a known compound. For example, a sulfur compound contained in gelatin as well as various sulfur compounds such as a thiosulfate, a thiourea, a thiazole and a rhodaine can be used. Preferred among these sulfur compounds are a thiosulfate, and a thiourea compounds. The amount of such a sulfur sensitizer to be added varies with various conditions such as pH, temperature and size of silver halide grains during chemical ripening but is normally in the range of $10^{-7}$ to $10^{-2}$ mol, preferably $10^{-5}$ to $10^{-3}$ mol per mol of silver halide.

As the selenium sensitizer employable in the present invention there may be used a known selenium compound. That is, the selenium sensitization is normally effected by stirring the emulsion with an unstable and/or non-unstable selenium compound at a temperature as high as not lower than 40° C. for a predetermined period of time. As such an unstable selenium compound there may be used a compound as disclosed in JP-B-44-15748, JP-B-43-13489, and Japanese Patent Application No. 2-13097, JP-A-4-109240 and JP-A-4-324855. In particular, compounds represented by the general formulae (VIII) and (IX) disclosed in JP-A-4-324855 are preferably used.

The tellurium sensitizer employable in the present invention is a compound capable of forming silver telluride which is presumed to be a sensitizing nucleus on the surface of or inside the silver halide grains. The rate at which silver telluride is formed in the silver halide emulsion can be examined by the method as disclosed in Japanese Patent Application No. 4-146739.

In some detail, there can be used compounds as disclosed in U.S. Pat. Nos. 1,623,499, 3,320,069, and 3,772,031, British Patents 235,211, 1,121,496, 1,295,462, and 1,396,696, Canadian Patent 800,958, JP-A-4-221400, JP-A-4-271341, JP-A-4-333043 and Japanese Patent Application No. 4-129787, *Journal of Chemical Society Chemical Communication*, 635 (1980), ibid 1102 (1979), ibid 645 (1979), *Journal of Chemical Society Perkin Transaction*, 1, 2191 (1980), and *The Chemistry of Organic Selenium and Tellurium Compounds* edited by S. Patai, Vol. 1 (1986), ibid. 12 (1987). In particular, compounds represented by the general formulae (II), (III) and (IV) disclosed in Japanese Patent Application No. 4-146739 may be preferably used.

The selenium and tellurium sensitizers employable in the present invention varies with silver halide grains used, chemical ripening conditions, etc. but is normally in the range of $10^{-8}$ to $10^{-2}$ mol, preferably $10^{-7}$ to $10^{-3}$ mol per mol of silver halide. In the present invention, the chemical sensitizing conditions are not specifically limited but normally comprise a pH of 5 to 8, a pAg of 6 to 11, preferably 7 to 10, and a temperature of 40° to 95° C., preferably 45° to 85° C.

Examples of the noble metal sensitizer employable in the present invention include gold, platinum, palladium, and iridium. A gold sensitization method is preferred. Specific examples of gold sensitizers employable in the present invention include chloroauric acid, potassium chlorate, potassium aurithiocyanate, and gold sulfate. Such a gold sensitizer is preferably used in an amount of $10^{-7}$ to $10^{-2}$ mol per mol of silver halide.

The formation or pysical ripening of silver halide emulsion grains according to the present invention may be effected in the presence of a cadmium salt, zinc salt, lead salt, thallium salt or the like.

In the present invention, reduction sensitization may be effected. As a reduction sensitizer there may be used a stannous salt, amine, formamidinesulfinic acid, silane compound or the like.

A thiosulfonic compound may be added to the silver halide emulsion by the method as disclosed in EP 293,917.

The photographic light-sensitive material according to the present invention may comprise one or more silver halide emulsions (e.g., those differing in average grain size, halogen composition, crystal habit, chemical sensitizing conditions, etc.) in combination.

In the present invention, a finely solid-dispersed dye may be preferably used as well. By the use of such a dye, characteristics of copy dots and enlarged dots can be further improved without reduction of sensitivity.

The finely solid-dispersed dye employable in the present invention needs to meet the following requirements: (1) It should be prevented from being diffused from the layer in which it has been incorporated to other layers so that it gives no adverse effects on the photographic properties (e.g., sensitivity, fog, gradation, regression of the latent image). (2) It should be discolored or eluted with a processing solution or washing water during the photographic processing so that it leaves no harmful colors on the photographic light-sensitive material after processing, and (3) It should exhibit an excellent ageing stability in a solution or photographic light-sensitive material so that it doesn't undergo discoloration.

A solid-dispersible dye is a dye which has a too low solubility to be present in a molecular form in the light-insensitive colloid layer in which it has been incorporated and is thus present in the layer in the form of microcrystalline solid having a size substantially incapable of being diffused in the layer.

The dye employable as a solid-dispersible dye in the present invention is represented by the following general formula (I):

$$D\text{—}(X)_y \qquad (I)$$

wherein D represents a y-valent group derived from a compound having a chromophore; X represents a dissociative proton or group having a dissociative proton bonded to D directly or via a divalent linking group; and y represents an integer of from 1 to 7.

The compound having a chromophore can be selected from many known dye compounds.

Examples of these compounds include oxonol dye, melocyanine dye, cyanine dye, arylidene dye, azomethine dye, triphenylmethane dye, azo dye, anthraquinone dye, and indoaniline dye.

The group having a dissociative proton represented by X stays nondissociative while the compound represented by the general formula (I) is incorporated in the silver halide photographic material of the present invention, making the compound of the general formula (I) substantially water-insoluble but dissociates during the development of the photographic light-sensitive material, making the compound of the general formula (I) substantially water-soluble. Preferred examples of such a group include a carboxylic group, a sulfonamido group, an arylsulfamoyl group, a sulfonylcarbamoyl group, a carbanoylsulfamoyl group, an enol group in oxonol dye, and a hydroxyphenyl group.

Preferred among compounds represented by the general formula (I) are those represented by the following general formulae (II), (III), (IV) and (V):

$$A^1=L^1-(L^2=L^3)_m-Q \quad \text{(II)}$$

$$A^1=L^1-(L^2=L^3)_n-A^2 \quad \text{(III)}$$

$$A^1=(L^1-L^2)_p=B^1 \quad \text{(IV)}$$

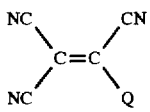
(V)

wherein $A^1$ and $A^2$ each represents an acidic nucleus; Brepresents a basic nucleus; Q represents an aryl group or heterocyclic group; $L^1$, $L^2$ and $L^3$ each represents a methine group; m represents 0, 1 or 2; and n and p each represent 0, 1, 2 or 3, with the proviso that the compounds represented by the general formulae (II) to (V) each contains at least one group selected from the group consisting of a carboxylic group, sulfonamido group, arylsulfamoyl group, sulfonylcarbamoyl group, carbonylsulfamoyl group, enol group in oxonol dye and a hydroxyl phenyl group but contain no other water-soluble groups (e.g., sulfonic group, phosphoric group).

The acidic nucleus represented by $A^1$ or $A^2$ is preferably a cyclic ketomethylene compound or a compound containing a methine group interposed between electron withdrawing groups.

Examples of the cyclic ketomethylene compound include 2-pyrazoline-5-one, rhodanine, hydantoin, thiohydantoin, 2,4-oxazolidinedione, isooxazolone, barbituric acid, thiobarbituric acid, indanedione, dioxopyrazolopyridine, hydroxypyridone, pyrazolidinedione, and 2,5-dihydrofuran. These compounds may have substituents.

The compound containing a methine interposed between electron withdrawing groups can be represented by $Z^1CH_2Z^2$ wherein $Z^1$ and $Z^2$ each represents —CN, $—SO_2R^1$, $—COR^1$, $—COOR^2$, $—CONHR^2$, $—SO_2NHR^2$, $—C[=C(CN)_2]R^1$ or $—C[=C(CN)_2]NHR^1$ (in which $R^1$ which may contain substituents represents an alkyl group, aryl group or heterocyclic group, and $R^2$ which may contain substituents represents a hydrogen atom or has the same meaning as $R^1$).

Examples of the basic nucleus represented by $B^1$ include pyridine, quinoline, indolenine, oxazole, imidazole, thiazole, benzoxazole, benzoimidazole, benzothiazole, oxazoline, naphthoxazole, and pyrrole. These basic nuclei may contain substituents.

Examples of the aryl group represented by Q include phenyl group, and naphthyl group. These aryl groups may contain substituents. Examples of the heterocyclic group represented by Q include pyrrole, indole, furan, thiophene, imidazole, pyrazole, indolidine, quinoline, carbazole, phenothiazine, phenoxazine, indoline, thiazole, pyridine, pyridazine, thiadiazine, pyran, thiopyran, oxadiazole, benzoquinoline, thiadiazole, pyrrolothiazole, pyrrolopyridazine, tetrazole, oxazole, coumarin, and coumarone. These heterocyclic groups each contain substituents.

The methine group represented by $L^1$, $L^2$ or $L^3$ may contain substituents which may be connected to each other to form a 5- or 6-membered ring (e.g., cyclopentene, cyclohexene).

The substituents which may be on the foregoing groups are not specifically limited so far as they do not render the compounds of the general formulae (I) to (V) substantially soluble in water having a pH of 5 to 7. Examples of such substituents include $C_{1-10}$ a sulfonamido group (e.g., methanesulfonamido, benzenesulfonamido, butanesulfonamido, n-octanesulfonamido), a $C_{0-10}$ sulfamoyl group (e.g., unsubstituted sulfamoyl, methylsulfamoyl, phenylsulfamoyl, butylsulfamoyl), a $C_{2-10}$ sulfonylcarbamoyl group (e.g., methanesulfonylcarbamoyl, propanesulfonylcarbamoyl, benzenesulfonylcarbamoyl), a $C_{1-10}$ acylsulfamoyl group (e.g., acetylsulfamoyl, propionylsulfamoyl, pivaloylsulfamoyl, benzoylsulfamoyl), a $C_{1-8}$ chain or cyclic alkyl group (e.g., methyl, ethyl, isopropyl, butyl, hexyl, cyclopropyl, cyclopentyl, cyclohexyl, 2-hydroxyethyl, 4-carboxybutyl, 2-methoxyethyl, benzyl, phenethyl, 4-carboxybenzyl, 2-diethylaminoethyl), a $C_{2-8}$ alkenyl group (e.g., vinyl, allyl), a $C_{1-8}$ alkoxy group (e.g., methoxy, ethoxy, butoxy), halogen atom (e.g., F, Cl, Br), a $C_{0-10}$ amino group (e.g., unsubstituted amino, dimethylamino, diethylamino, carboxyethylamino), a $C_{2-10}$ ester group (e.g., an alkoxycarbonyl group such as methoxycarbonyl), a $C_{1-10}$ amido group (e.g., acetylamino, benzamido), a $C_{1-10}$ carbamoyl group (e.g., unsubstituted carbamoyl, methylcarbamoyl, ethylcarbamoyl), a $C_{6-10}$ aryl group (e.g., phenyl, naphthyl, 4-carboxyphenyl, 3-carboxyphenyl, 3,5-dicarboxyphenyl, 4-methanesulfonamidophenyl, 4-butanesulfonamidophenyl), a $C_{6-10}$ aryloxy group (e.g., phenoxy, 4-carboxyphenoxy,3-methylphenoxy, naphthoxy), a $C_{1-8}$ alkylthio group (e.g., methylthio, ethylthio, octylthio), a $C_{6-10}$ arylthio group (e.g., phenylthio, naphthylthio), a $C_{1-10}$ acyl group (e.g., acetyl, benzoyl, propanoyl), a $C_{1-10}$ sulfonyl group (e.g., an alkyl- or aryl- sulfonyl group such as methanesulfonyl, benzenesulfonyl), a $C_{1-10}$ ureido group (e.g., ureido, methylureido), a $C_{2-10}$ urethane group (e.g., an alkoxycarbonylamino group such as methoxycarbonylamino, ethoxycarbonylamino), a cyano group, a hydroxyl group, a nitro group, heterocyclic group (e.g., 5-carboxybenzoxazole ring, pyridine ring, sulforan (tetramethylene sulfon) ring, pyrrole ring, pyrrolidine ring, morpholine ring, piperadine ring, pyrimidine ring, and furan ring).

Specific examples of the compounds represented by the general formulae (I) to (V) employable in the present invention will be given below.

(I-1)
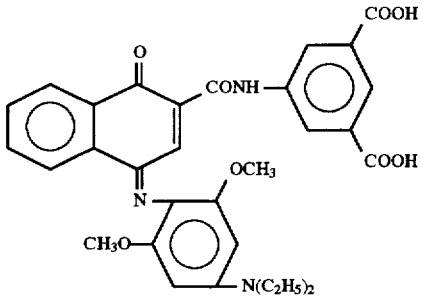
(I-2)
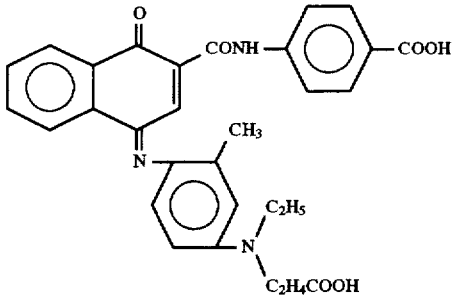
(I-3)
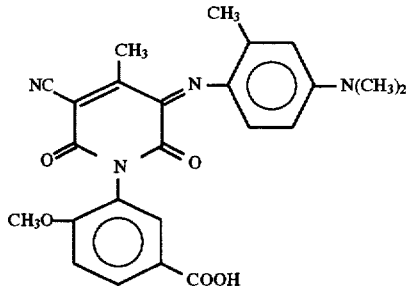
(I-4)
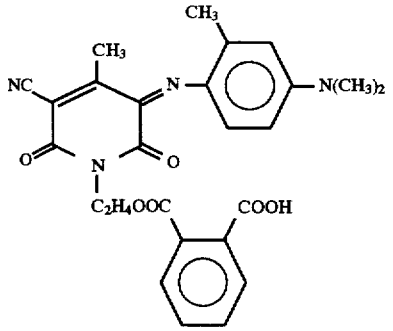
(II-1)
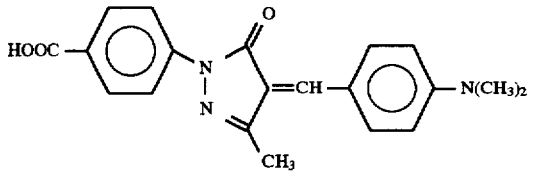
(II-2)
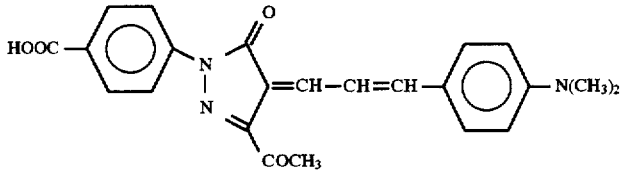

-continued
(II-3)
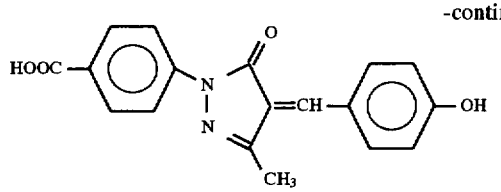
(II-4)
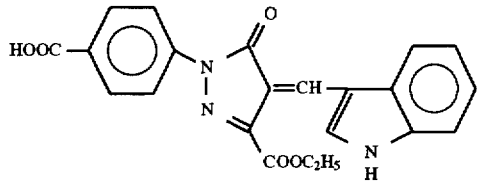
(II-5)
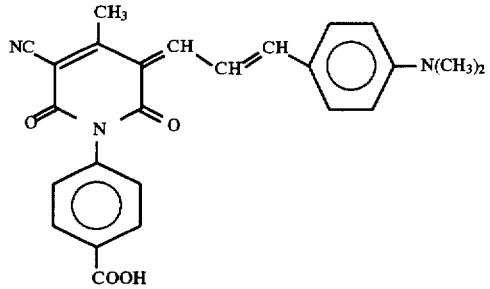
(II-6)
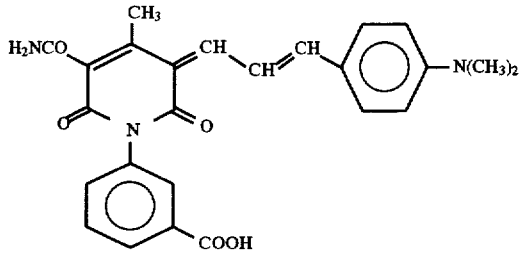
(II-7)
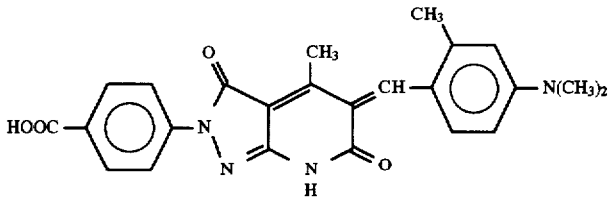
(II-8)
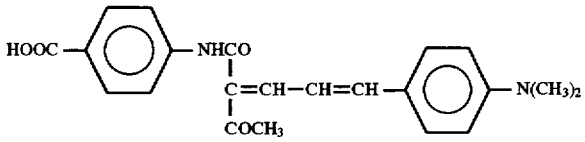
(II-9)
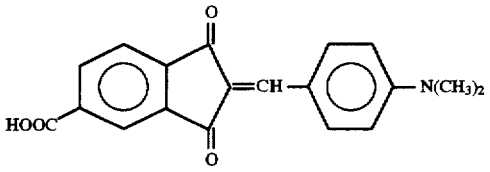
(II-10)
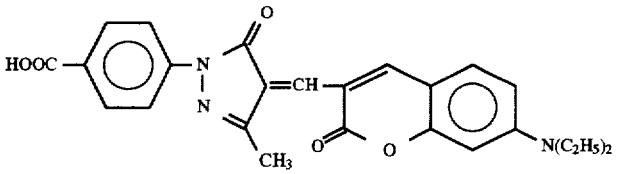

-continued
(II-11)
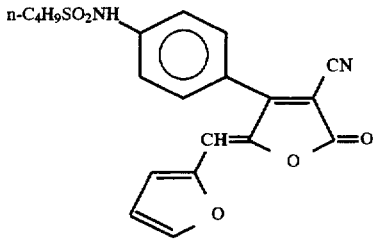
(II-12)
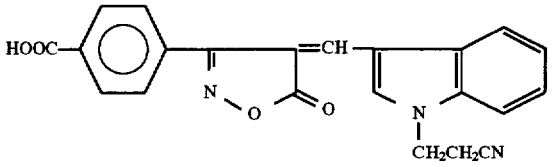
(II-13)
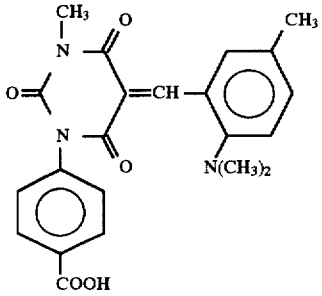
(II-14)
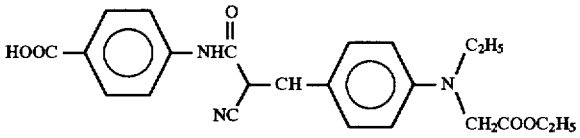
(II-15)
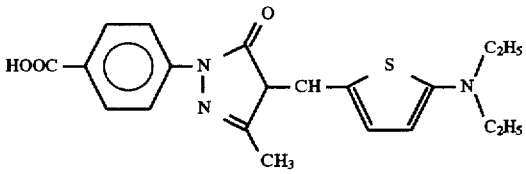
(II-16)
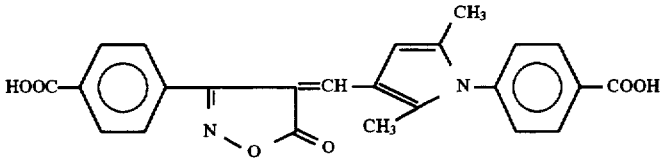
(II-17)
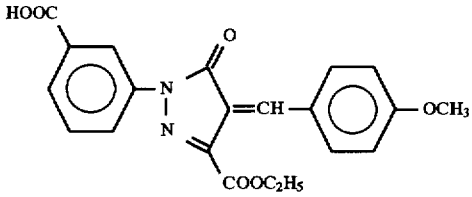
(II-18)
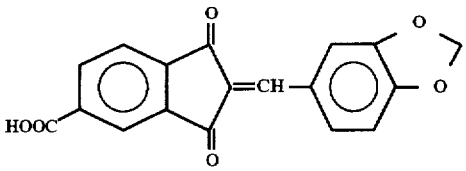

-continued
(II-19)
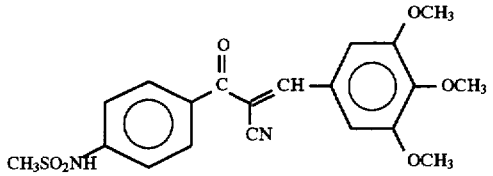
(II-20)
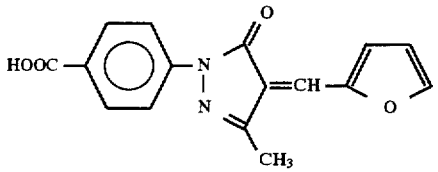
(II-21)
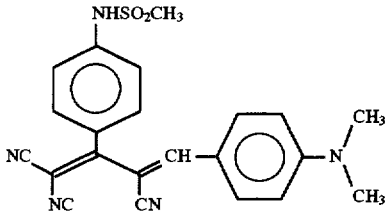
(II-22)
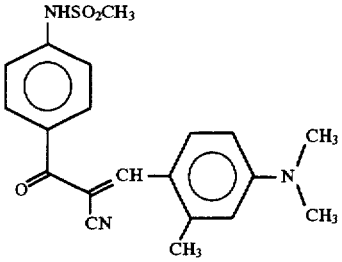
(II-23)
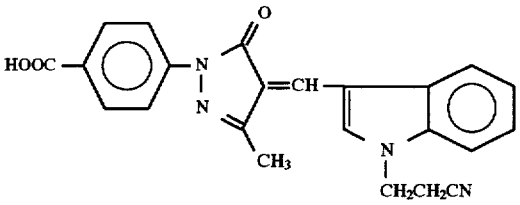
(II-24)
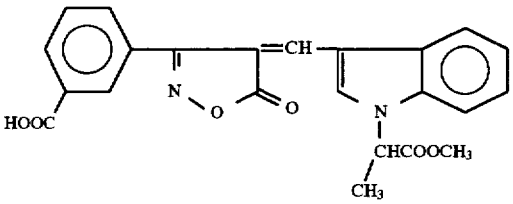
(III-1)
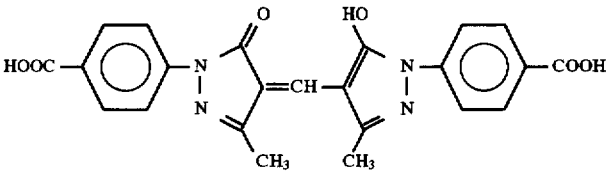
(III-2)
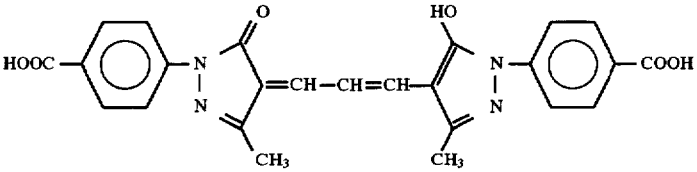

-continued
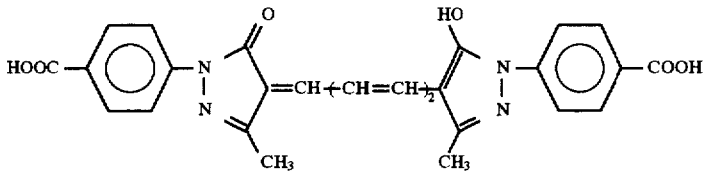
(III-3)
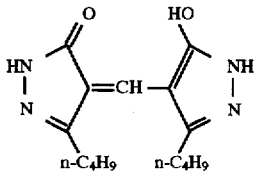
(III-4)
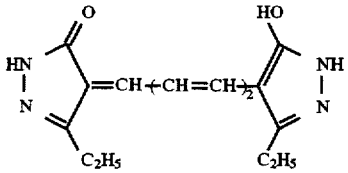
(III-5)
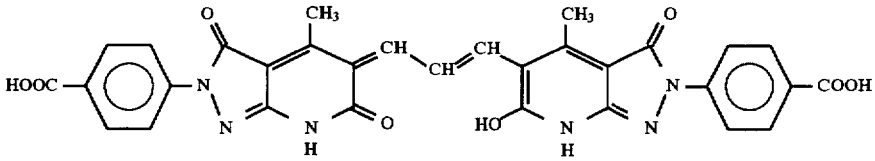
(III-6)
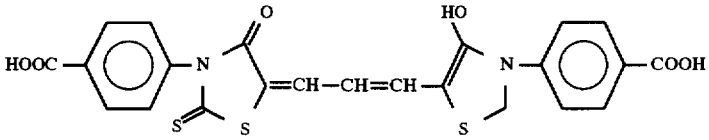
(III-7)
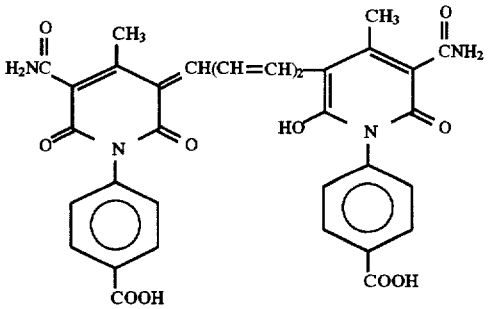
(III-8)
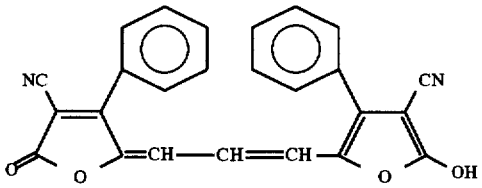
(III-9)
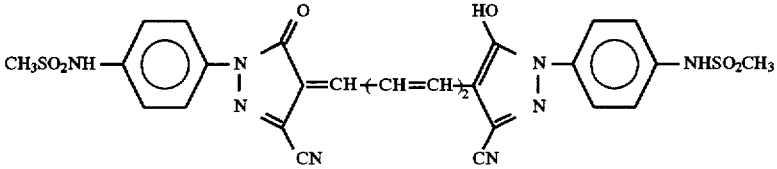
(III-10)

-continued
(III-11)
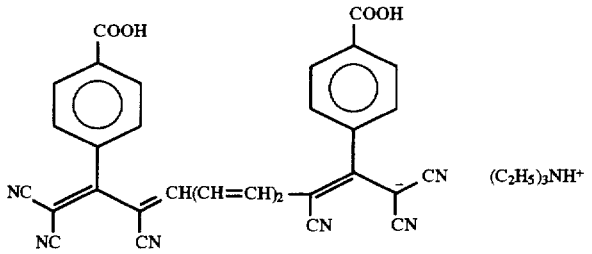
(III-12)
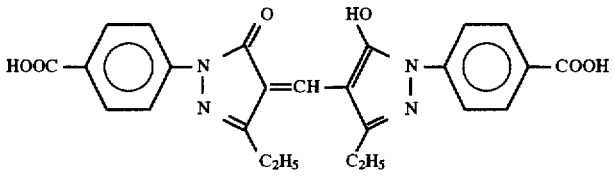
(III-13)
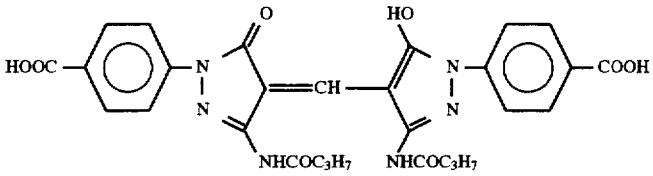
(IV-1)
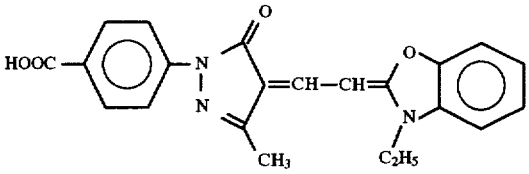
(IV-2)
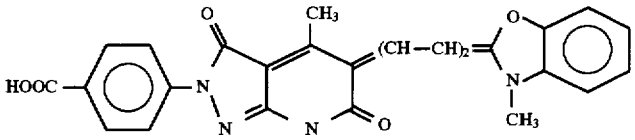
(IV-3)
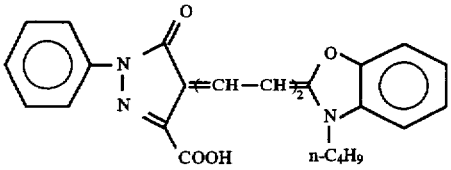
(IV-4)
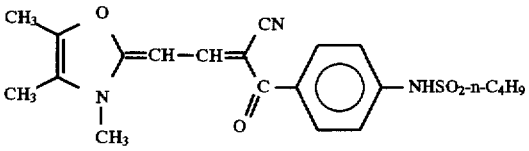
(IV-5)
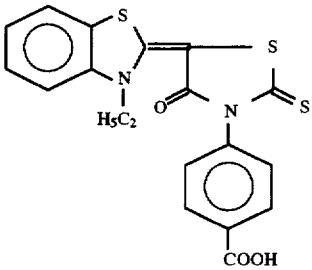

-continued

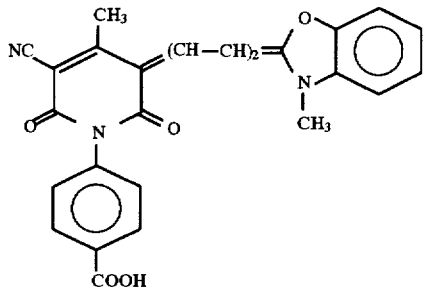

(IV-6)

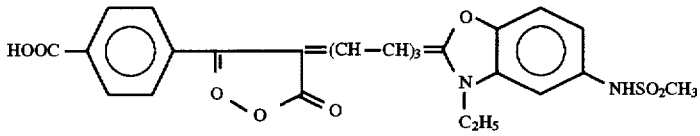

(IV-7)

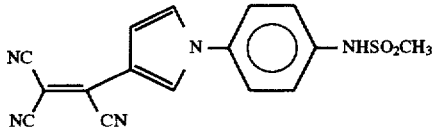

(V-1)

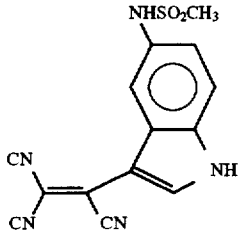

(V-2)

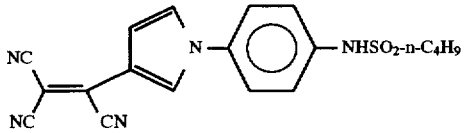

(V-3)

The synthesis of the dye employable in the present invention can be accomplished by or in accordance with the methods as disclosed in W088/04794, EP0274723A1, EP276566, EP299435, JP-A-52-92716, JP-A-55-155350, JP-A-55-155351, JP-A-61-205934, JP-A-48-68623, JP-A-3-282244, JP-A-3-7931, and JP-A-3-167546, and U.S. Pat. Nos. 2,527,583, 3,486,897, 3,746,539, 3,933,798, 4,130,429, and 4,040,841.

The micro(crystalline) solid dispersion of a dye can be mechanically prepared optionally with a proper solvent (e.g., water, alcohol) in the presence of a dispersant by a known means of finely deviding (e.g., ball mill, vibrating ball mill, planetary ball mill, sandmill, colloid mill, jet mill, roller mill). Micro(crystalline) dye grains can be obtained by dissolving a dye in a proper solvent in the presence of a dispersing surface active agent, and then adding the solution to a poor solvent to deposit microcrystals or by controlling the pH value of the solution so that it is dissolved, and then changing the pH value thereof so that it is microcrystallized.

The layer comprising a finely divided powder of a dye incorporated therein can be provided by dispersing micro (crystalline) dye grains thus obtained in a proper binder to prepare a substantially homogeneous solid dispersion of grains, and then coating the solid dispersion on a desired support. Alternatively, such a layer can be obtained by coating a dissociated dye on a support in the form of salt, and then coating an acidic gelatin thereon so that dispersion and solidification are simultaneously effected.

The foregoing binder is not specifically limited so far as it is a hydrophilic colloid that can be used in the light-sensitive emulsion layer or light-insensitive layer. In general, gelatin or synthetic polymers may be used.

The average grain diameter of finely divided dye grains in the solid dispersion is preferably in the range of 0.005 μm to 10 μm, more preferably 0.01 μm to 1 μm, most preferably 0.01 μm to 0.5 μm.

The amount of the dye represented by the general formula (I) to be added is preferably in the range of $5\times10^{-2}$ mol to $5\times10^{-7}$ mol/m$^2$, particularly $1\times10^{-3}$ mol to $5\times10^{-5}$ mol/m$^2$.

The solid-dispersed dye is incorporated in a hydrophilic colloid layer other than the photographic silver halide emulsion layer. The hydrophilic colloid layer in which the solid-dispersed dye is incorporated is not specifically limited but may be a light-insensitive layer comprising a hydrophilic colloid of the present invention provided between the support and the silver halide emulsion layer or a hydrophilic colloid layer present farer than the silver halide emulsion layer from the support. If the hydrazine derivative of the present invention is incorporated in the hydrophilic colloid layer, the solid-dispersed dye may be incorporated in the same layer as the hydrazine derivative.

In the present invention, a redox compound which can undergo oxidation to release a development inhibitor can be used as well. By the use of the redox compound characteristics of copy dots and enlarged dots can be further improved.

The redox group to be contained in the redox compound is preferably derived from a hydroquinone, catechol, naphthohydroquinone, aminophenol, pyrazolidone, hydrazine, hydroxylamine or reductone, more preferably hydrazine. Further, a redox compound is preferably used which allows at least a part of a development inhibitor to be eluted with a developer and react with a component of the developer to make itself less inhibitive.

The hydrazines employable in the present invention as redox compounds which undergo oxidation to release a development inhibitor can be represented by the following general formulae (R-1), (R-2) and (R-3). Particularly preferred among these compounds are those represented by the general formula (R-1).

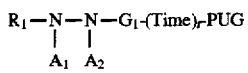

(R-1)

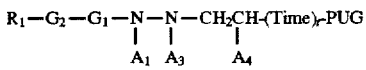

(R-2)

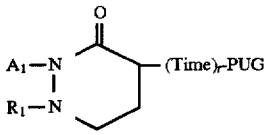

(R-3)

In the foregoing general formulae, $R_1$ represents an aliphatic group, a cycloalkyl group or an aromatic group. $G_1$ represents —CO— group, —CO—CO— group, —CS— group, —C($NG_2R_2$)— group, —SO— group, —$SO_2$— group or —PO($G_2R_2$)— group. $G_2$ represents a single bond, —O—, —S— or —$NR_2$—. $R_2$ represents a hydrogen atom or $R_1$.

$A_1$ and $A_2$ each represents a hydrogen atom, an alkylsulfonyl group, an arylsulfonyl group or an acyl group which may be substituted. In the general formula (R-1), at least one of $A_1$ and $A_2$ is a hydrogen atom. $A_3$ has the same meaning as $A_1$ or represents —$CH_2$—CH($A_4$)-(Time)$_t$-PUG.

$A_4$ represents a nitro group, a cyano group, a carboxyl group, a sulfo group or —$G_1$—$G_2$—$R_1$.

Time represents a divalent linking group. The suffix t represents 0 or 1. PUG represents a development inhibitor.

The general formulae (R-1), (R-2) and (R-3) will be further described hereinafter.

In the general formulae (R-1), (R-2) and (R-3), the aliphatic group or cycloalkyl group represented by $R_1$ is preferably a $C_{1-30}$, particularly $C_{1-20}$, straight-chain, branched or cyclic alkyl group which may be substituted.

In the general formulae (R-1), (R-2) and (R-3), the aromatic group represented by $R_1$ is a monocyclic or bicyclic aryl group or unsaturated heterocyclic group. The unsaturated heterocyclic group may be condensed with an aryl group to form a heteroaryl group.

Examples of such an unsaturated heterocyclic group include benzene ring, naphthalene ring, pyridine ring, quinoline ring, and isoquinoline ring. Particularly preferred among these unsaturated heterocyclic groups are those containing benzene ring.

A particularly preferred group represented by $R_1$ is an aryl group.

The aliphatic group, cycloalkyl group, aryl group and unsaturated heterocyclic group represented by $R_1$ may be substituted. Typical examples of substituents of $R_1$ include an alkyl group, an aralkyl group, an alkenyl group, an alkinyl group, an alkoxy group, an aryl group, a substituted amino group, a ureido group, a urethane group (e.g., an alkoxycarbonylamino group), an aryloxy group, a sulfamoyl group, a carbamoyl group, an alkylthio group, an arylthio group, a sulfonyl group (e.g., alkyl- and aryl- sulfonyl group), a sulfinyl group (e.g., alkyl- and aryl- sulfinyl group), a hydroxyl group, a halogen atom, a cyano group, a sulfo group (e.g., —$SO_3M$ wherein M represents a hydrogen atom or an alkali metal atom), an aryloxycarbonyl group, an acyl group, an alkoxycarbonyl group, an acyloxy group, an acylamino group, a sulfonamido group, a carboxyl group (e.g., —COOM wherein M represents a hydrogen atom or an alkali metal atom), and phosphonic amido group. Preferred examples of such substituents include a straight-chain, branched or cyclic alkyl group (preferably having 1 to 20 carbon atoms), an aralkyl group (preferably having 7 to 30 carbon toms), an alkoxy group (preferably 1 to 30 carbon atoms), a substituted amino group (preferably the amino group substituted by a $C_{1-30}$ alkyl group), a acylamino group (preferably having 2 to 40 carbon atoms), a sulfonamide group (preferably having 1 to 40 carbon atoms), a ureido group (preferably having 1 to 40 carbon atoms), and phosphonic amido group (preferably having 1 to 40 carbon atoms).

In the general formulae (R-1), (R-2) and (R-3), $G_1$ is preferably —CO— group or —$SO_2$— group, particularly —CO— group.

$A_1$ and $A_2$ each preferably represents a hydrogen atom. $A_3$ preferably represents a hydrogen atom or —$CH_2$CH($A_4$)-(Time)$_t$-PUG.

In the general formulae (R-1), (R-2) and (R-3), Time represents a divalent linking group which has time controlling function.

The divalent linking group represented by Time represents a group which causes Time-PUG group released from the oxidation product of the redox nucleus to release PUG via one or more reaction steps.

Examples of the divalent linking group represented by Time include those which undergo intramolecular ring closure reaction of p-nitrophenoxy derivative to release PUG as disclosed in U.S. Pat. No. 4,248,962 (corresponding to JP-A-54-145135), those which undergo intramolecular ring closure reaction after ring cleavage to release PUG as disclosed in U.S. Pat. Nos. 4,310,612 (corresponding to JP-A-55-53330) and 4,358,525, those which release PUG with the production of an acid anhydride by the intramolecular ring closure reaction of carboxyl group in monoester succinate or its analogue as disclosed in U.S. Pat. Nos. 4,330,617, 4,446,216, and 4,483,919, and JP-A-59-121328, those which undergo electron transfer via a double bond conjugated with an aryloxy group or a heterocyclic oxy group to produce quinomonomethane or its analogue and hence release PUG as disclosed in U.S. Pat. Nos. 4,409,323, 4,421,845, and 4,416,977 (corresponding to JP-A-57-135944), Research Disclosure No. 21,228 (December 1981), and JP-A-58-209736, and JP-A-58-209738, those which undergo electron transfer in the enamine structure moiety of a nitrogen-containing heterocyclic group to cause PUG to be released from γ-position of enamine as disclosed in U.S. Pat. No. 4,420,554 (corresponding to JP-A-57-136640), and JP-A-57-135945, JP-A-57-188035, JP-A-58-98728, and JP-A-58-209737, those which undergo electron transfer to a carbonyl group conjugated with a nitrogen atom in a nitrogen-containing heterocyclic group to produce an oxy group which then undergoes an intramolecular ring closure reaction to release PUG as disclosed in JP-A-57-56837, those which release PUG with the production of an aldehyde as disclosed in U.S. Pat. No. 4,146,396 (corresponding to JP-A-52-90932), and JP-A-59-93442, JP-A-59-75475, JP-A-60-249148, and JP-A-60-249149, those which release PUG with the decarboxylation of carboxyl group as disclosed in JP-A-51-146828, JP-A-57-179842, and JP-A-59-104641, those having —O—COOCR$_a$R$_b$—PUG (in which R$_a$ and R$_b$ each represent a monovalent group) which release PUG with the production of an aldehyde followed by decarboxylation, those which release PUG with the production of an isocyanate as disclosed in JP-A-60-7429, and those which undergo coupling reaction with an oxidation product of a color developer to release PUG as disclosed in U.S. Pat. No. 4,438,193.

Specific examples of these divalent linking groups represented by Time are further disclosed in JP-A-61-236549, JP-A-1-269936, and JP-A-3-67246.

PUG represents a group which exerts an effect of inhibiting development as it is or in the form of (Time)$_t$-PUG. PUG is preferably a development inhibitor moiety which undergoes elution with a developer to react with a component of the developer and hence make itself less inhibitive.

The development inhibitor moiety represented by PUG or (Time)$_t$-PUG is a known development inhibitor having hetero atoms via which it is connected to the other moiety of the redox compound. Such a development inhibitor is further disclosed in C. E. K. Mees and T. H. James, *The Theory of the Photographic Processes*, 3rd edition, 1967, Macmillan, pp. 344–346.

The development inhibitor moiety represented by PUG may be substituted. Examples of substituents of the development inhibitor moiety include those described with reference to R$_1$. These substituents may be further substituted.

Preferred examples of substituents for the further substitution include nitro group, sulfo group, carboxyl group, sulfamoyl group, phosphono group, phosphinyl group, and sulfonamido group.

In the general formulae (R-1), (R-2) and (R-3), R$_1$ or -(Time)$_t$-PUG may comprise a ballast group commonly used in immobile photographic additives such as coupler or a group which accelerates the adsorption of the compound represented by the general formula (R-1), (R-2) or (R-3) to silver halide.

The ballast group is an organic group which gives an enough molecular weight to make the compound represented by the general formula (R-1), (R-2) or (R-3) substantially nondiffusible to other layers or processing solution. The ballast group consists of a combination of two or more of an alkyl group, an aryl group, a heterocyclic group, an ether group (e.g., ROR'—, wherein R represents an alkyl group or an aryl group and R' represents an alkylene group or an arylene group), a thioether group (e.g., RSR'—, wherein R represents an alkyl group or an aryl group and R' represents an alkylene group or an arylene group), an amido group, a ureido group and a sulfonamido group. The ballast group is preferably one having a substituted benzene ring, particularly one having a benzene ring substituted by a branched alkyl group.

Specific examples of the group which accelerates the adsorption to silver halide include a cyclic or chain thioamido groups such as groups derived from 4-thiazoline-2-thione, 4-imidazoline-2-thione, 2-thiohydantoin, rhodanine, thiobaribituric acid, tetrazoline-5-thione, 1,2,4-triazoline-3-thione, 1,3,4-oxazoline-2-thione, benzimidazoline-2-thione, benzoxazoline-2-thione, benzthiazoline-2-thione, thiotriazine and 1,3-imidazoline-2-thione, aliphatic mercapto groups, aromatic mercapto groups, heterocyclic mercapto groups (it has the same meaning as cyclic thioamido group tautomeric therewith if the atom adjacent to the carbon atom to which —SH group is connected is a nitrogen atom; specific examples of such a group include those described above), groups having a disulfide bond, 5- or 6-membered nitrogen-containing heterocyclic groups consisting of a combination of nitrogen, oxygen, sulfur and carbon such as groups derived from benzotriazole, triazole, tetrazole, indazole, benzimidazole, imidazole, benzothiazole, thiazole, thiazoline, benzoxazole, oxazole, oxazoline, thiadiazole, oxathiazole, triazine and azaindene, and heterocyclic quaternary salts such as benzimidazolinium. These groups may be further substituted. Examples of substituents of these groups include those described with reference to R$_1$.

Specific examples of compounds employable in the present invention will be given below, but the present invention should not to be construed as being limited thereto. (In the present invention an alkyl group in a formula, which is not defined by n-, iso- or ter-, resents a n-alkyl group.)

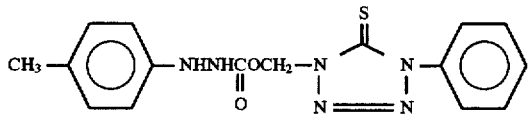

B-1

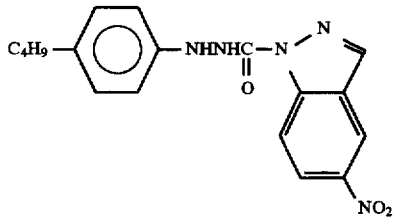

B-2

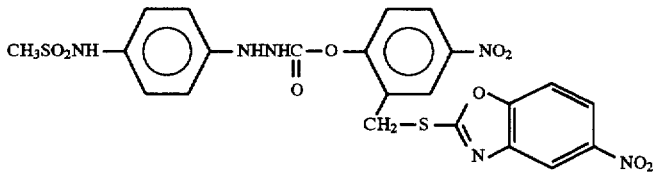

B-3

-continued
B-4
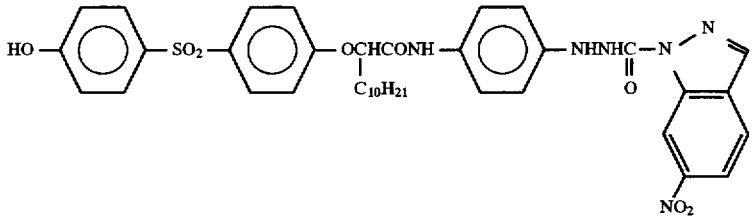
B-5
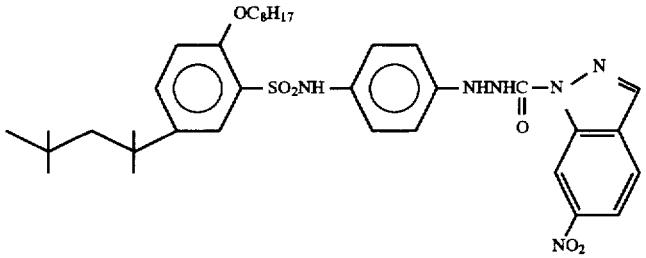
B-6
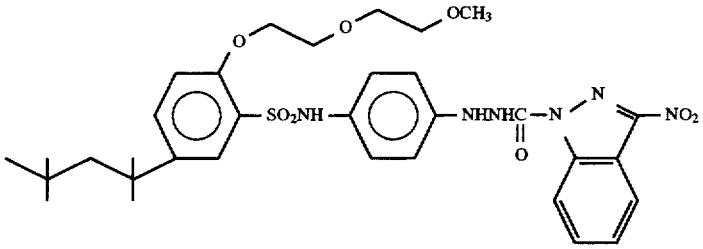
B-7
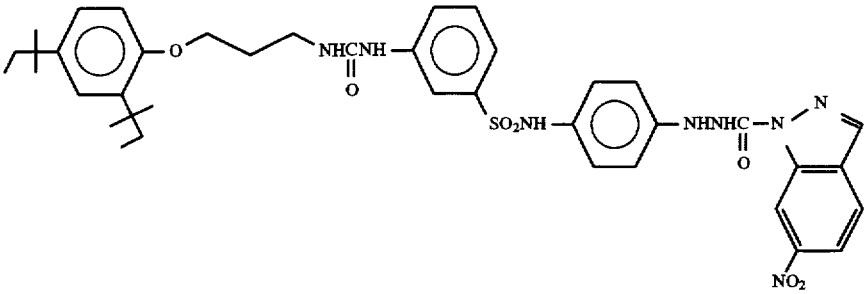
B-8
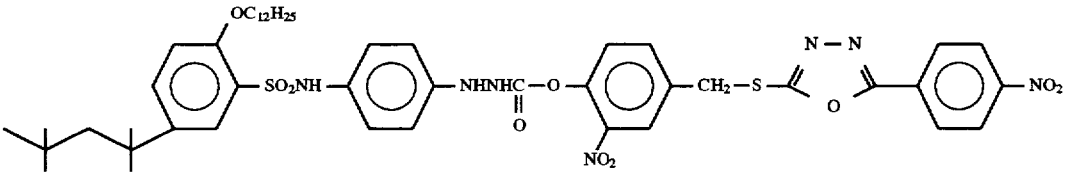
B-9
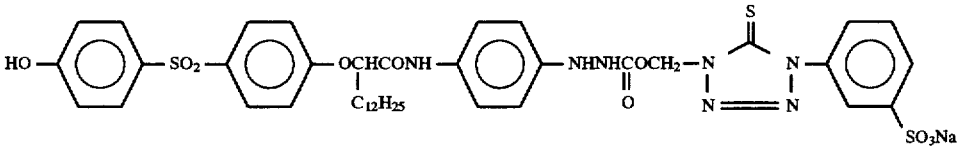
B-10
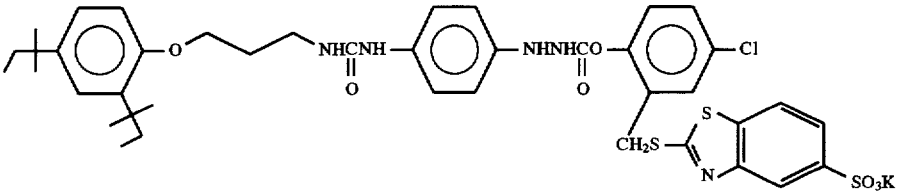

-continued
B-11
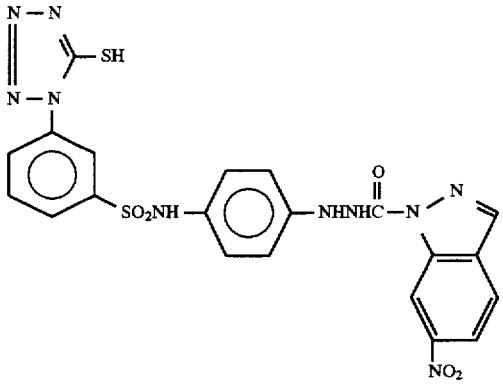
B-12
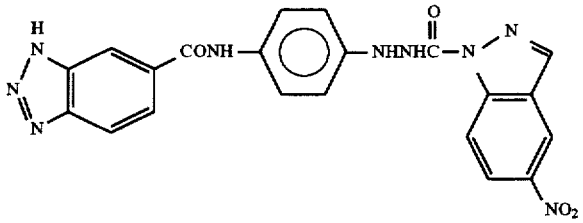
B-13
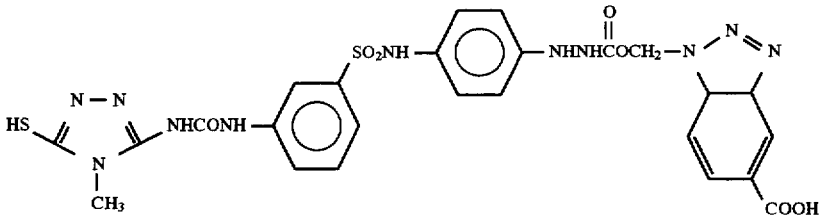
B-14
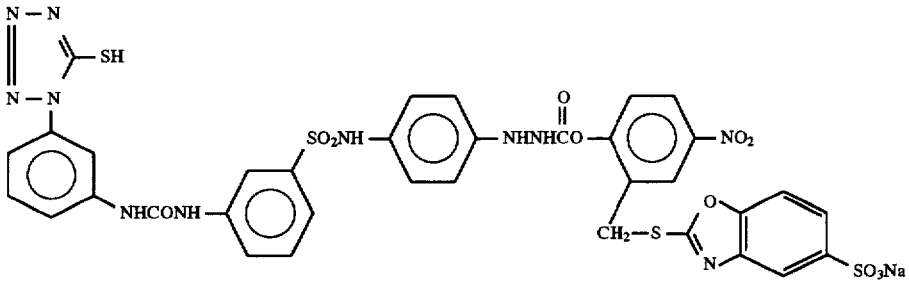
B-15
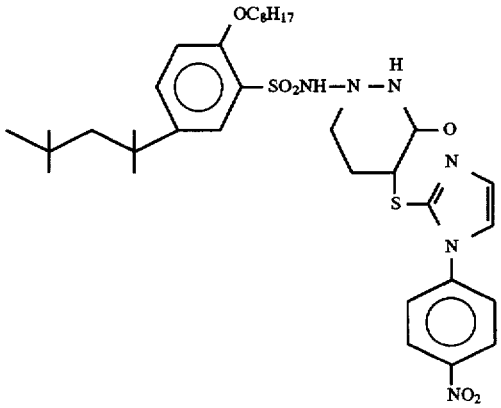

-continued

B-16

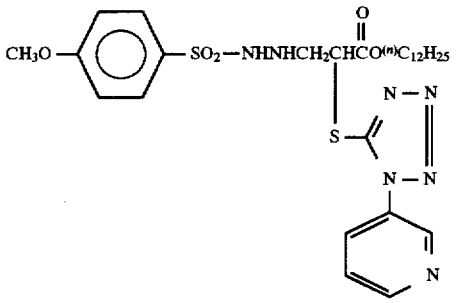

B-17

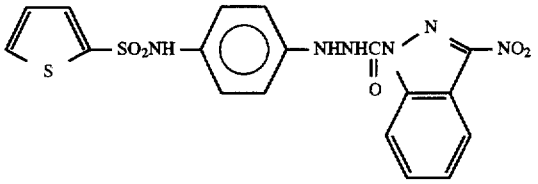

B-18

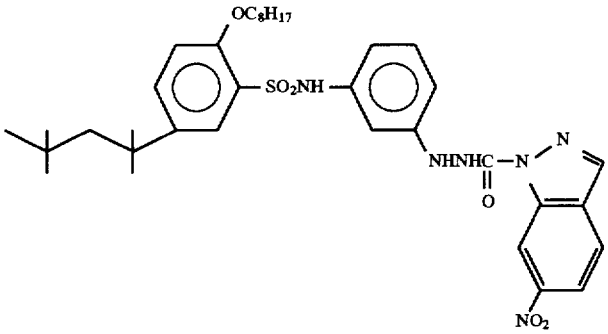

B-19

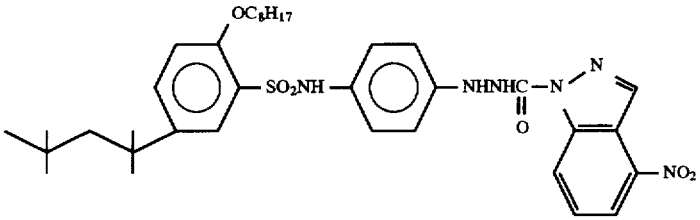

B-20

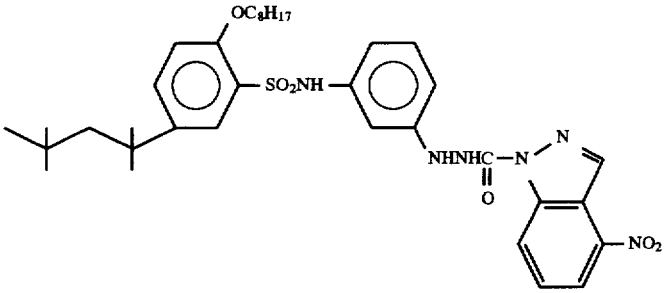

Other examples of redox compounds employable in the present invention include compounds (particularly Exemplary Compounds 1 to 50) represented by the general formula (I) as disclosed in JP-A-2-301743 (U.S. Pat. No. 5,085,971), Exemplary Compounds 1 to 75 represented by the general formulae (R-1), (R-2) and (R-3) as disclosed in JP-A-3-174143, and compounds as disclosed in JP-A-5-257239 and Japanese Patent Application No. 3-15648 U.S. Pat. No. 5,196,293).

Examples of the method for the synthesis of redox compounds employable in the present invention are disclosed in JP-A-61-213847, JP-A-62-260153, JP-A-49-129536, JP-A-56-153336, and JP-A-56-153342, U.S. Pat. Nos. 4,684,604, 3,379,529, 3,620,746, 4,377,634, and 4,332,878, and JP-A-1-269936.

The redox compound according to the present invention is preferably used in an amount of $1\times10^{-6}$ to $5\times10^{-2}$ mol, more preferably $1\times10^{-5}$ to $1\times10^{-2}$ mol.

The redox compound according to the present invention may be used in the form of solution in a proper water-miscible organic solvent such as alcohol (e.g., methanol, ethanol, propanol, fluorinated alcohol), ketone (e.g., acetone, methyl ethyl ketone), dimethylformamide, dimethyl sulfoxide and methylcellosolve.

Alternatively, the redox compound according to the present invention may be used in the form of emulsion dispersion mechanically prepared by dissolving the redox compound in an oil such as dibutyl phthalate, tricresyl phosphate, glyceryl triacetate and diethyl phthalate or auxiliary solvent such as ethyl acetate and cyclohexanone by a well-known emulsion dispersion method. Further, the redox compound may be used in the form of dispersion obtained by dispersing a powdered redox compound in water by means of ball mill, colloid mill or ultrasonic wave by a method known as solid dispersion method.

The layer containing the redox compound according to the present invention may contain silver halide emulsion grains and/or hydrazine derivatives or may be one of other hydrophilic colloid layers. If the redox compound is contained in a hydrophilic colloid layer, the layer may be one containing a solid-dispersed dye.

An example of the structure in which the light-sensitive emulsion layer contains hydrazine derivatives and other hydrophilic colloid layers contain redox compounds used in the present invention is disclosed in EP 395069.

In this case, the layer containing a redox compound may be disposed above or under the light-sensitive emulsion layer containing a hydrazine nucleating agent. The layer containing a redox compound according to the present invention may further contain light-sensitive or light-insensitive silver halide emulsion grains. An interlayer containing gelatin or a synthetic polymer (e.g., polyvinyl acetate, polyvinyl alcohol) may be provided interposed between the layer containing a redox compound according to the present invention and the light-sensitive emulsion layer containing a hydrazine nucleating agent.

As a binder or protective colloid to be incorporated in the hydrophilic emulsion there may be advantageously used gelatin. Other hydrophilic colloids may be used. Examples of such hydrophilic colloids which can be used in the present invention include protein such as gelatin derivatives, graft polymer of gelatin with other high molecular compounds, albumine, and casein, saccharide derivative such as hydroxyethyl cellulose, carboxymethyl cellulose, cellulose sulfate ester, sodium alginate, and starch derivative, monopolymer or copolymer such as polyvinyl alcohol, polyacrylic acid, polymethacrylic acid, polyacrylamide, polyvinyl imidazole, and polyvinyl butyral, and other various synthetic hydrophilic high molecular compounds.

The silver halide emulsion to be incorporated in the photographic light-sensitive material according to the present invention may be subjected to spectral sensitization. Preferred examples of spectral sensitizing dyes are disclosed in JP-A-2-12236 (line 13, lower left column—line 4, lower right column, page 8), JP-A-2-103536 (line 3, lower right column, page 16—line 20, lower left column, page 17), JP-A-1-112235, JP-A-2-124560, JP-A-3-7928, and JP-A-5-11389. Particularly preferred among these spectral sensitizing dyes is one represented by the following general formula (S):

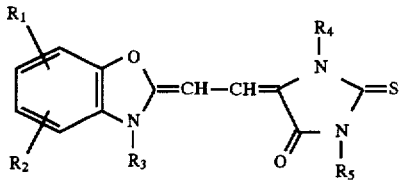

(S)

wherein $R_1$ and $R_2$ each represents a hydrogen atom, a halogen atom or a substituted or unsubstituted $C_{1-8}$ alkyl group, a substituted or unsubstituted hydroxyl group, a substituted or unsubstituted alkoxy group, a substituted or unsubstituted phenyl group, a substituted or unsubstituted naphthyl group, a sulfo group (e.g., —$SO_3M$, wherein M represents a hydrogen atom or an alkali metal atom) or carboxyl group (e.g., —COOM, wherein M represents a hydrogen atom or an alkali metal atom), with the proviso that $R_1$ and $R_2$ may be connected to each other to form a 6-membered ring; $R_3$ represents an alkyl group or an allyl group which may be substituted; $R_4$ represents a hydrogen atom or a $C_{1-12}$ alkyl group which may be substituted; and $R_5$ represents a pyridyl group or a phenyl group which may be substituted by a halogen atom, a lower alkyl group (preferably $C_{1-4}$), a hydroxyl group, a hydroxyalkyl group (preferably $C_{1-4}$), an alkoxy group (preferably $C_{1-4}$), a sulfo group (e.g., —$SO_3M$, wherein M represents a hydrogen atom or an alkali metal atom) or a carboxyl group (e.g., —COOM, wherein M represents a hydrogen atom or an alkali metal atom).

The compound represented by the general formula (S) will be further described hereinafter. In the general formula (S), $R_1$ and $R_2$ each represents a hydrogen atom, a halogen atom (e.g., chlorine, bromine), a $C_{1-8}$ alkyl group which may be substituted with, for example, a halogen atom, a lower alkyl group ($C_{1-4}$), a hydroxyl group, a $C_{1-4}$ hydroxyalkyl group, a phenyl group, a $C_{1-4}$ alkoxy group, and a carboxy group (e.g., —COOM, wherein M represents a hydrogen atom or an alkali metal atom) (e.g., methyl, ethyl, hydroxyethyl), a $C_{1-8}$ alkoxy group which may substituted with, for example, a halogen atom, a lower alkyl group ($C_{1-4}$), a hydroxyl group, a $C_{1-4}$ hydroxyalkyl group, a phenyl group, a $C_{1-4}$ alkoxy group, and a carboxy group (e.g., —COOM, wherein M represents a hydrogen atom or an alkali metal atom) (e.g, methoxy, ethoxy), a phenyl group, a naphthyl group, a sulfo group or a carboxyl group. $R_1$ and $R_2$ may be connected to each other to form a 6-membered ring on which substituents such as a halogen atom, a lower alkyl group (preferably $C_{1-4}$), a hydroxyl group, a hydroxyalkyl group, a phenyl group, an alkoxy group or a carboxyl group (e.g., —COOM, wherein M represents a hydrogen atom or an alkali metal atom) may be present.

$R_3$ represents an alkyl group (e.g., methyl, ethyl, sulfoethyl, sulfopropyl, sulfoamidoethyl, sulfobutyl), an alkenyl group, or an allyl group which may substituted with, for example, a halogen atom, a lower alkyl group ($C_{1-4}$), a hydroxyl group, a $C_{1-4}$ hydroxyalkyl group, a phenyl group, a $C_{1-4}$ alkoxy group, and a carboxy group (e.g., —COOM, wherein M represents a hydrogen atom or an alkali metal atom).

$R_4$ represents a $C_{1-12}$ alkyl group or a $C_{1-12}$ aliphatic group containing —O—, —OCO—, —NH— and/or —N(R)— (wherein R represents a $C_{1-3}$ alkyl group) interposed between carbon chains, which may be substituted. Preferred examples of the substituents of the alkyl group include a hydroxyl group, and a carbamido group.

$R_5$ represents a pyridyl group or a phenyl group which may be substituted by a halogen atom (e.g., chlorine, bromine), a lower alkyl group (e.g., methyl, ethyl), a hydroxyl group, a hydroxyalkyl group (e.g., hydroxyethyl), an alkoxy group (e.g., methoxy, ethoxy), a sulfo group (—$SO_3M$ as defined above) or a carboxyl group (—COOM as defined above).

Specific examples of the compound represented by the general formula (S) employable in the present invention will be given below, but the present invention should not be construed as being limited thereto.

S-1
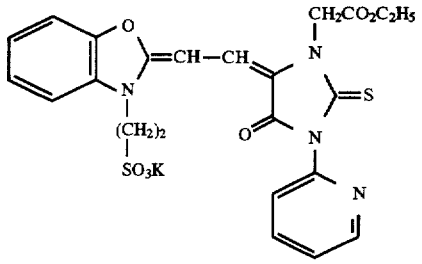
S-2
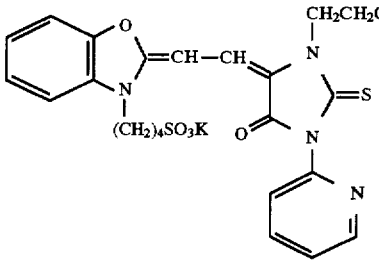
S-3
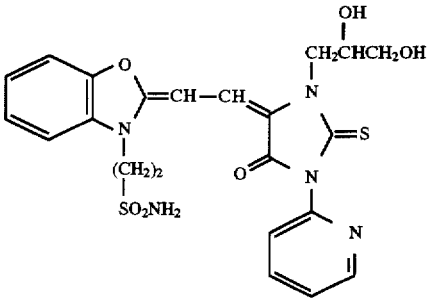
S-4
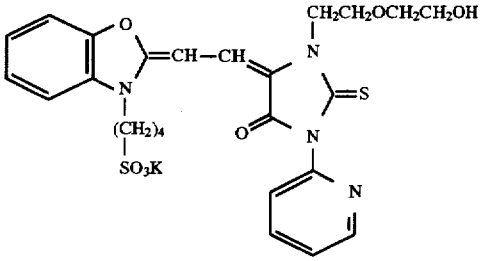
S-5
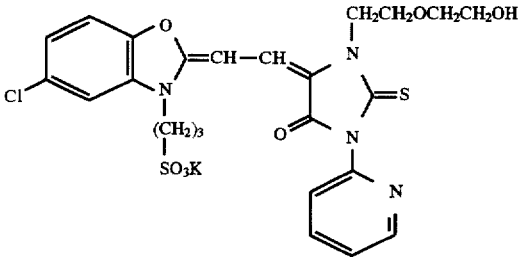
S-6
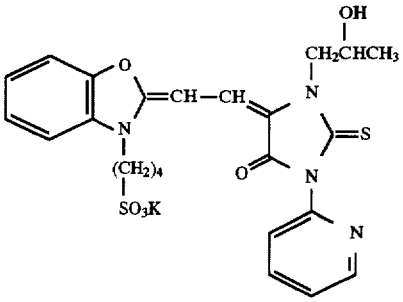
-continued
S-7
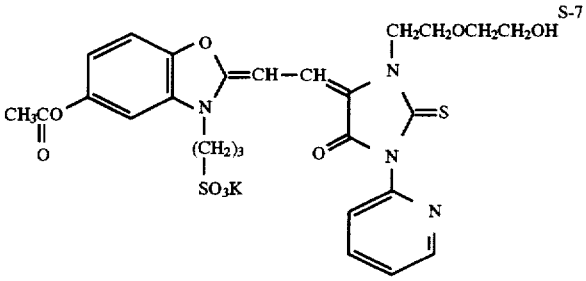
S-8
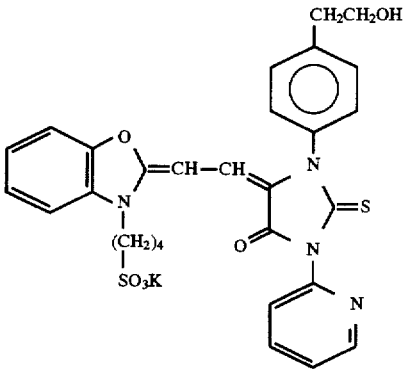
S-9
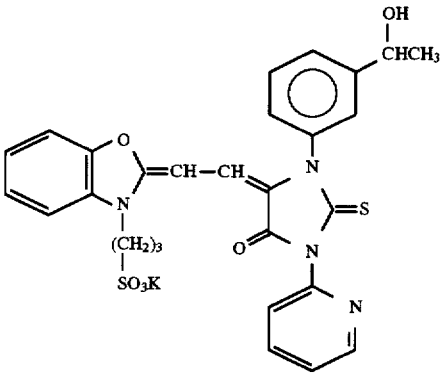
S-10
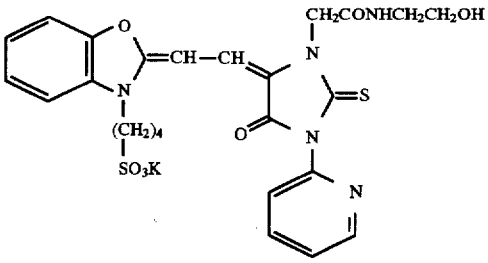
S-11
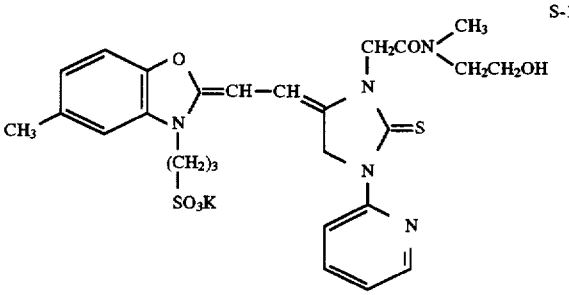

-continued
S-12
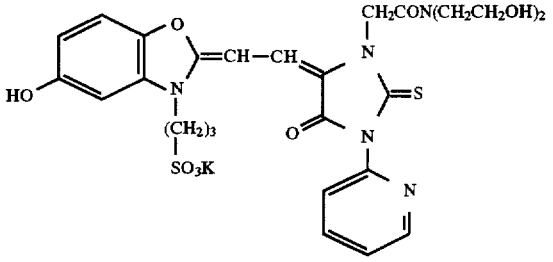
S-13
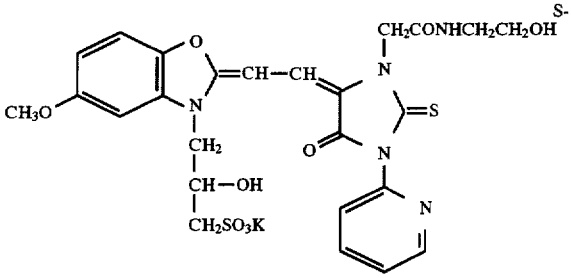
S-14
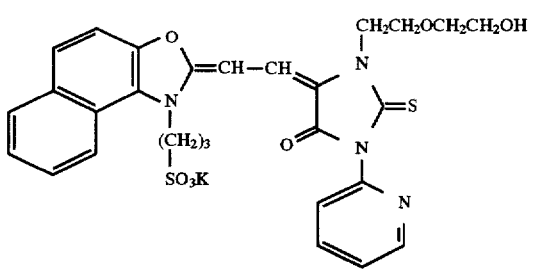
S-15
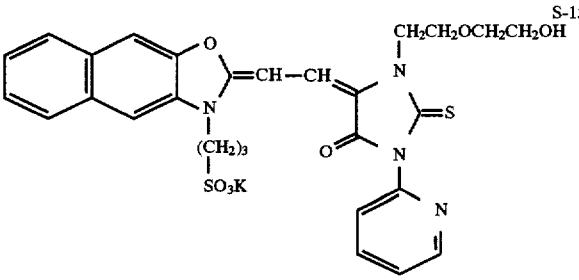
S-16
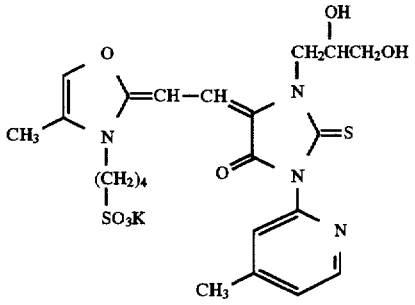
-continued
S-17
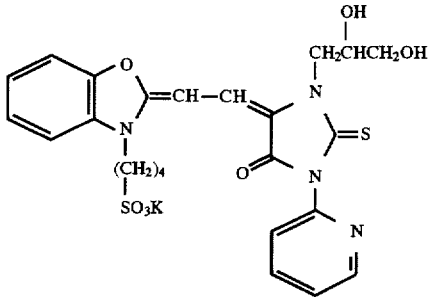
S-18
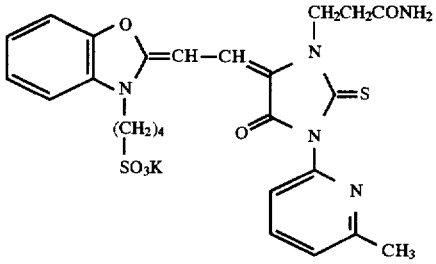
S-19
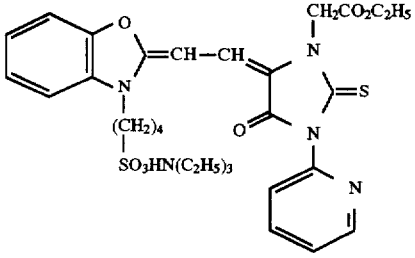
S-20
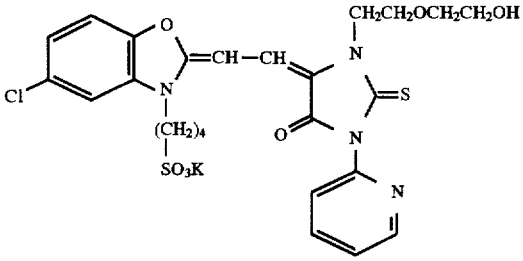
S-21
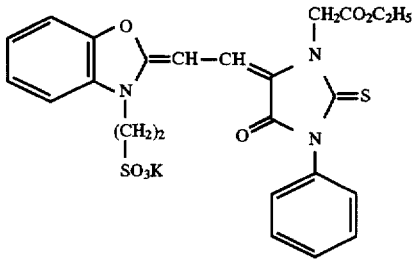
S-22
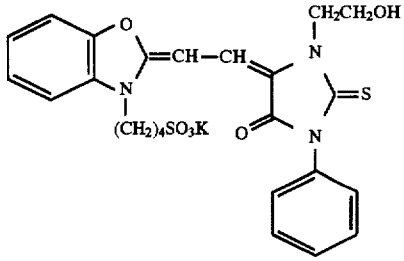

-continued
S-23
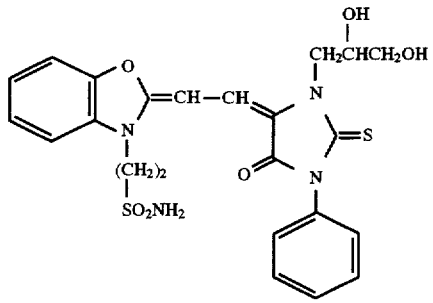
S-24
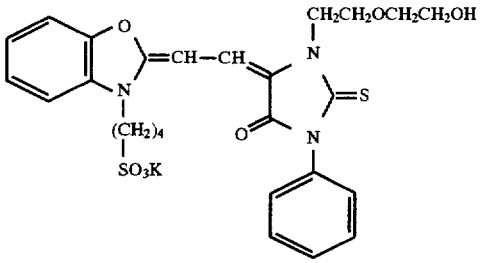
S-25
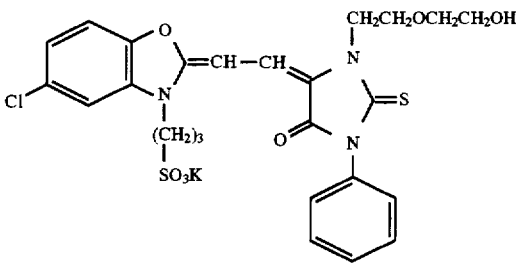
S-26
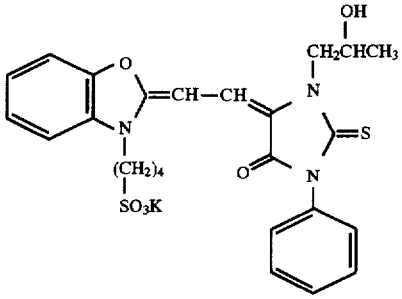
S-27
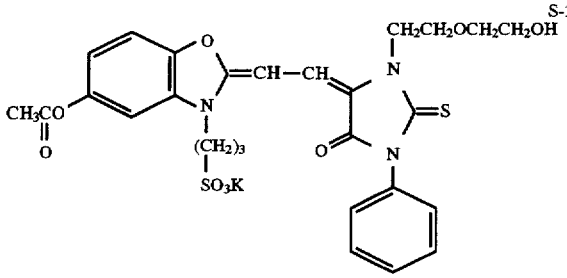
-continued
S-28
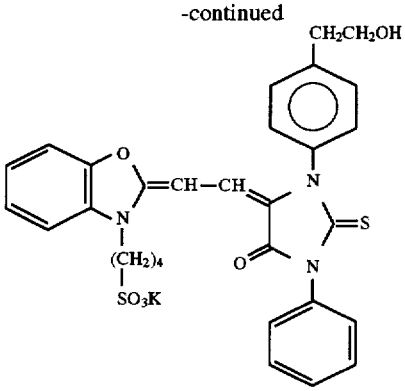
S-29
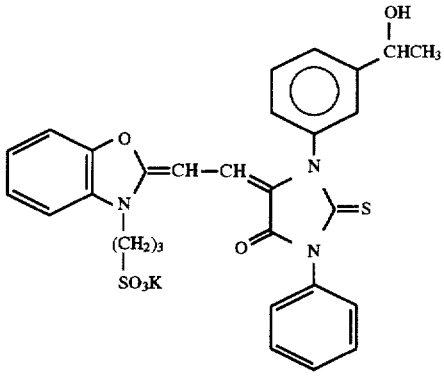
S-30
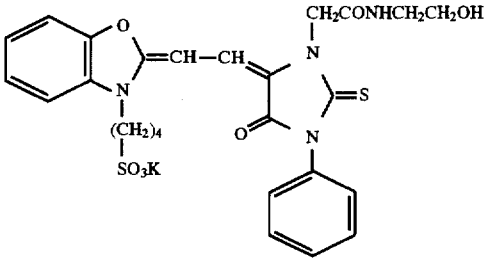
S-31
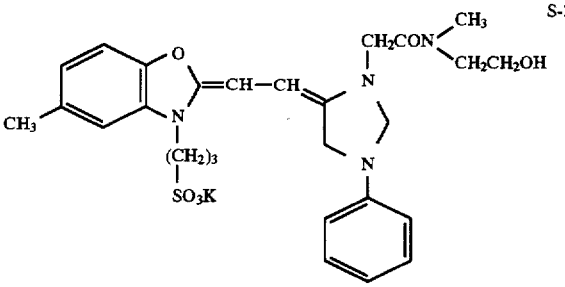
S-32
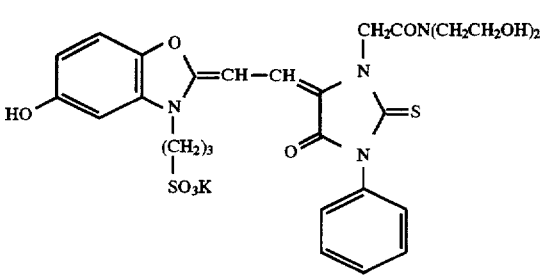

-continued

S-33

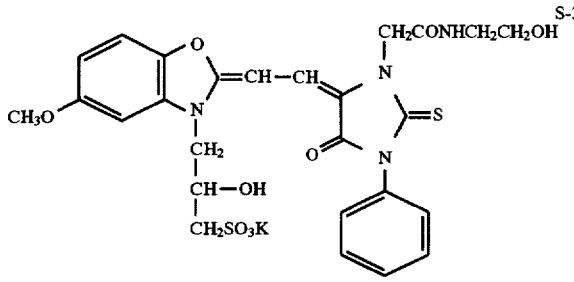

S-34

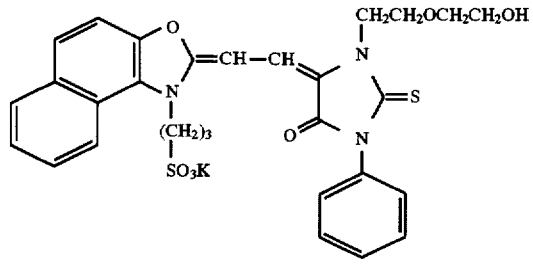

S-35

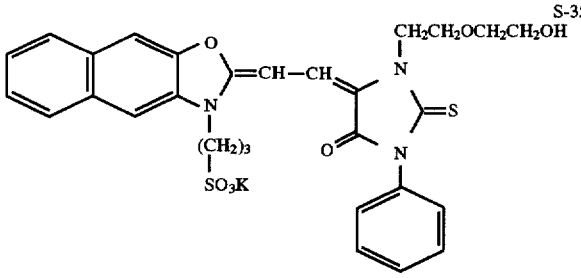

S-36

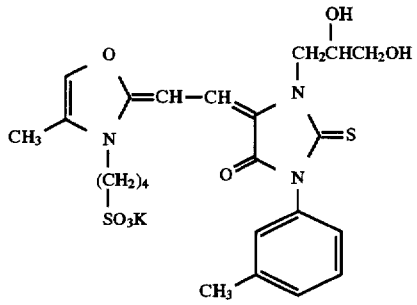

S-37

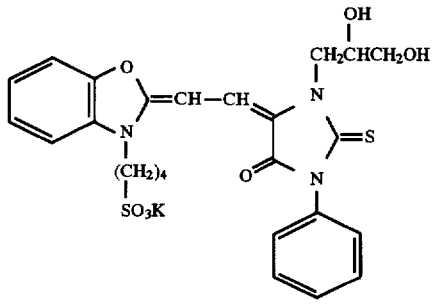

-continued

S-38

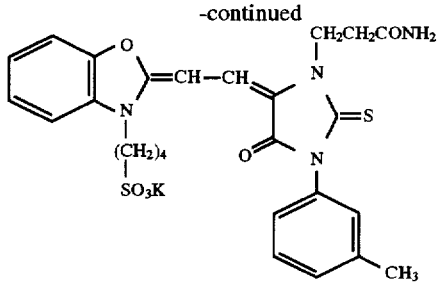

S-39

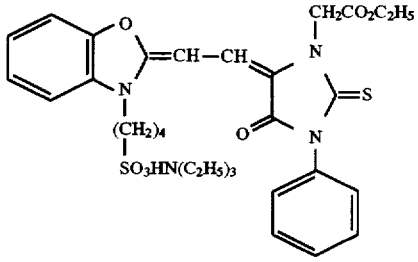

S-40

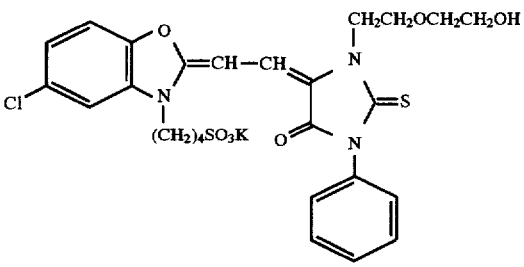

The amount of the spectral sensitizing dye of the general formula (S) to be used is preferably in the range of $1\times10^{-7}$ to $5\times10^{-2}$ mol, particularly $1\times10^{-6}$ to $1\times10^{-2}$ mol per mol of silver halide.

The sensitizing dyes represented by formula (S) can be easily produced according on the methods disclosed in, for example, JP-A-50-33828, JP-A-55-45015, JP-A-56-25728, U.S. Pat. Nos. 2,742,833, 2,756,148 and 3,567,458.

In order to provide the silver halide photographic material of the present invention with an ultrahigh contrast and a high sensitivity, it is not necessary to use the conventional infectious developers or highly alkaline developers having a pH value approximate to 13 as described in U.S. Pat. No. 2,419,975. A stable developer is enough.

In particular, the silver halide photographic material of the present invention can provide a sufficiently ultrahigh negative image with a developer containing 0.15 mol/l or more of sulfite ions as preservative and having a pH of 9.6 to 11.0.

The developing agent to be incorporated in the developer used in the present invention is not specifically limited but preferably contains dihydroxybenzenes, optionally in combination with 1-phenyl-3-pyrazolidones or p-aminophenols.

Examples of the dihydroxybenzene developing agent to used in the present invention include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, and 2,5-dimethylhydroquinone. Particularly preferred among these dihydroxybenzene developing agents is hydroquinone.

Examples of 1-phenyl-3-pyrazolidone and derivatives thereof used as developing agents include 1-phenyl-3-pyrazolidone, 1-phenyl-4,4-dimethyl-4-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, and 1-p-tolyl-4,4-dimethyl-3-pyrazolidone.

Examples of the p-aminophenol developing agent used in the present invention include N-methyl-p-aminophenol, p-aminophenol, N-(β-hydroxyethyl)-p-aminophenol, N-(4-hydroxyphenyl)glycine, 2-methyl-p-aminophenol, and p-benzylaminophenol. Particularly preferred among these p-aminophenol developing agents is N-methyl-p-aminophenol.

In general, the developing agent is preferably used in an amount of 0.05 mol/l to 0.8 mol/l. When dihydroxybenzenes are used in combination with 1-phenyl-3-pyrazolidones or p-amino-phenoles, the formers are preferably used in an amount of 0.05 mol/l to 0.5 mol/l while the latters are preferably used in an amount of 0.06 mol/l or less.

Examples of sulfites as preservatives to be used in the present invention include sodium sulfite, potassium sulfite, lithium sulfite, ammonium sulfite, sodium bisulfite, potassium metabisulifte, and sodium formaldehydebisulfite. The amount of the sulfite to be used is preferably in the range of 0.15 mol/l or more, particularly 0.3 mol/l or more. The upper limit of the amount of the sulfite to be used is preferably 2.5 mol/l.

Examples of the alkaline agent used for the pH adjustment include a pH adjustor or buffer such as sodium hydroxide, potassium hydroxide, sodium carbonate, potassium carbonate, sodium tertiary phosphate and potassium tertiary phosphate. The pH of the developer is set between 9.6 and 12.0.

Examples of additives which can be used other than the foregoing components include development inhibitors such as boric acid, borax, sodium bromide, potassium bromide and potassium iodide, organic solvents such as ethylene glycol, diethylene glycol, triethylene glycol, dimethylformamide, methylcellosolve, hexyleneglycol, ethanol and methanol, and fog inhibitors or black pepper inhibitors such as 1-phenyl-5-mercaptotetrazole, an indazole compound (e.g., 5-nitroindazole) and benztriazole compound (e.g., 5-methylbenztriazole). The developer may further contain a color toner, a surface active agent, an antifoaming agent, a water softener, a film hardener, and an amino compound as described in JP-A-56-106244 as necessary.

The developer used in the present invention may contain a compound as described in JP-A-56-24347 as a silver stain inhibitor. As the dissolution aid to be incorporated in the developer there may be used a compound as described in JP-A-61-267759. As the pH buffer to be incorporated in the developer there may be used a compound as described in JP-A-60-93433 or JP-A-62-186259.

As the fixing agent there may be used a composition commonly used. As a fixing agent a thiosulfate or a thiocyanate as well as organic sulfur compound known to serve as fixing agent may be used. The fixing agent used in the present invention may contain a water-soluble aluminum compound (e.g., aluminum sulfate, alum) as a film hardener. The amount of such a water-soluble aluminum salt is normally in the range of 0.4 to 2.0 g-Al/l. Further, ferric iron compounds may be used as oxidizers in the form of complex with ethylenediaminetetraacetic acid.

The development temperature may be normally between 18° C. and 50° C., preferably between 25° C. and 43° C.

Various additives to be incorporated in the photographic light-sensitive material of the present invention are not specifically limited. For example, those described below may be preferably used.

| | Item | References |
|---|---|---|
| 1) | Nucleation accelerator | Compounds of the general formulae (I), (II), (III), (IV), (V) and (VI) described in Japanese Patent Application No. 4-237366; Compounds of the general formulae (II-m) to (II-p) and (II-1) to (II-22) described in line 13, upper right column, page 9 - line 10, upper left column, page 16 of JP-A-2-103536; compounds as described in JP-A-1-179939 |
| 2) | Surface active agent, antistatic agent | Line 7, upper right column, page 9 - line 7, lower right column, page 9 of JP-A-2-12236; line 13, lower left column, page 2 - line 18, lower right column, page 4 of JP-A-2-18542 |
| 3) | Fog inhibitor, stabilizer | Line 19, lower right column, page 17 - line 4, upper right column, page 18 and line 1 - line 5, lower right column, page 18 of JP-A-2-103536; thiosulfinic compounds as described in JP-A-1-237538 |
| 4) | Polymer latex | Line 12 - line 20, lower left column, page 18 of JP-A-2-103536 |
| 5) | Acid group containing compound | Line 5, lower right column, page 8 - line 1, upper left column, page 19 of JP-A-2-2-103536; line 13, lower right column, page 8 - line 8, upper left column, page 11 of JP-A-2-55349 |
| 6) | Mat agent, lubricant, plasticizer | Line 15, upper left column, page 19 - line 15, upper right column, page 19 of JP-A-2-103536 |
| 7) | Film hardener | Line 5–line 17, uppe right column, page 18 of JP-A-2-103536 |
| 8) | Binder | Line 1–line 20, lower right column, page 3 of JP-A-2-18542 |
| 9) | Black pepper inhibitor | Compounds as described in U.S. Pat. No. 4,956,257 and JP-A-1-118832 |
| 10) | Monomethine compound | Compounds of the general formula (II) (particularly Exemplary Compounds II-1 to II-26) as described in JP-A-2-2-287532 |
| 11) | Dihydroxybenzenes | Compounds as described in JP-A-3-39948, upper left column, page 11 - lower left column, page 12, and EP452772A |
| 12) | Processing solution and method | Line 16, upper right column, page 19 - line 8, upper left column, page 21 of JP-A-2-103536 |

The present invention will be further described in the following examples, but the present invention should not be construed as being limited thereto.

EXAMPLE 1

Preparation of hydrazine derivative-containing layer coating solution

An emulsion was prepared in the following manner: Emulsion: 250 ml of an aqueous solution of 63 g of silver nitrate and 250 ml of an aqueous halide solution of 20 g of potassium bromide and 14 g of sodium chloride containing $K_2Rh(H_2O)Cl_5$ and $K_3IrCl_6$ in an amount of $1\times10^{-7}$ mol and $1\times10^{-7}$ mol, respectively, per mol of silver in the entire emulsion, respectively, were added to a 2% aqueous solution of gelatin containing sodium chloride (0.5%), 1,3-dimethyl-2-imidazolithione (0.002%) and citric acid (0.05%) at a temperature of 38° C. with stirring by double jet process spending 12 minutes to obtain silver bromochloride grains having an average grain size of 0.20 μm and a silver chloride content of 55 mol % by which nuclei were formed. Subsequently, 450 ml of an aqueous solution of 107 g of silver nitrate and 450 ml of an aqueous halide solution of 28 g of potassium bromide and 28 g of sodium chloride were added to the emulsion spending 20 minutes by double jet process.

Thereafter, a potassium iodide solution having a concentration of $1\times10^{-3}$ mol per mol of silver was added to the emulsion to make conversion. The emulsion was then rinsed by an ordinary flocculation method. Gelatin was then added to the emulsion in an amount of 40 g per mol of silver and the pH and pAg thereof were adjusted to 6.0 and 7.5, respectively. To the emulsion were then added sodium benzenethiosulfonate, sodium benzenesulfinate, sodium thiosulfate and chloroauric acid in an amount of 7 mg, 2 mg, 5 mg and 8 mg per mol of silver, respectively. The emulsion was then heated to a temperature of 60° C. for 70 minutes so that it was subjected to chemical sensitization. To the emulsion were then added 150 mg of 4-hydroxy-6-methyl-1,3,3a,7-tetrazaindene as a stabilizer and 100 mg of proxel as a preservative. As a result, an emulsion of cubic silver bromochloroiodide grains having an average grain size of 0.27 Am and a silver chloride content of 60 mol % (coefficient of variation: 10%) was obtained.

To the emulsion thus obtained were then added as sensitizing dyes each of potassium salt of 5-[3-(4-sulfobutyl)-5-chloro-2-benzoxazolidilidene]ethylidene-1-hydroxyethoxyethyl-3-(2-pyridyl)-2-thiohydantoin in an amount of $4\times10^{-4}$ mol per mol of silver, a short wave cyanine dye represented by the following general formula (A) in an amount of $6\times10^{-4}$ mol per mol of silver, 1-phenyl-5-mercaptotetrazole in an amount of $3\times 10^{-4}$, a mercapto compound represented by the following general formula (B) in an amount of $6\times10^{-4}$ mol per mol of silver, a mercapto compound represented by the following general formula (C) in an amount of $6\times10^{-4}$ mol per mol of silver, a triazine compound represented by the following general formula (D) in an amount of $3\times10^{-4}$ mol per mol of silver, 5-chloro-8-hydroxyquinoline in an amount of $6\times10^{-4}$ mol per mol of silver, and a hydrazine compound according to the present invention and comparative compounds having the following structural formulae (E) and (F) in an amount as set forth in Table 1. To the emulsion were then added sodium salt of N-oleyl-N-methyltaurine, a water-soluble latex represented by the following structural formula (G), a polyethyl acrylate dispersion and 1,3-divinylsulfonyl-2-propanol as a hardener in such an amount that the coated amount thereof reached 30 mg/m², 200 mg/m², 300 mg/m², and 100 mg/m², respectively. The pH of the coating solution was adjusted to 6.0.

(A)

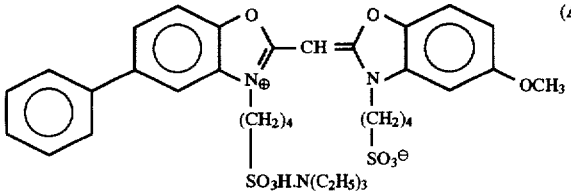

-continued (B)

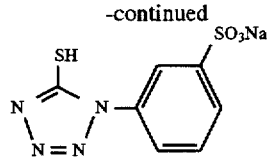

(C)

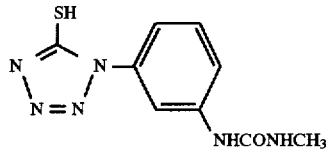

(D)

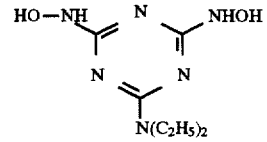

(E)

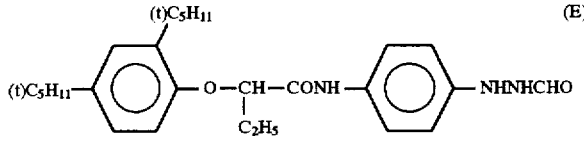

(F)

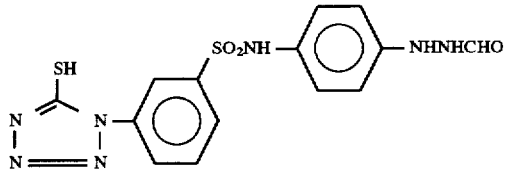

(G)

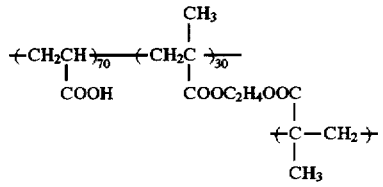

(70 and 30 show the molar ratio of each monomers: the same hereinafter if not defined differently)

Onto a polyethylene terephthalate film having a vinylidene chloride-containing moistureproof undercoating layer on both sides thereof was coated a gelatin layer as a lowermost layer in an amount of 0 g to 1.5 g as set forth in Table 1. Onto the gelatin layer was then coated the foregoing emulsion layer coating solution in an amount of 3.6 g/m² (gelatin: 1.8 g/m²). The gelatin layer coating solution to be coated as a lowermost layer had comprised a polyethyl acrylate dispersion (latex) in the same coated amount as gelatin. As can be seen in Table 1 the thickness of each of the lowermost layer was 0 to 2.4 μm.

Onto the emulsion layer was then coated a protective layer in such an amount that the coated amount of gelatin, an amorphous silica matting agent having an average grain size of about 3.5 μm, a colloidal silica (Snowtex C available from Nissan Chemical Industries, Ltd.), a silicone oil represented by the structural formula (H) (added in the form of gelatin dispersion), hydroquinone, sodium p-dodecylbenzenesulfonate, and a fluorinic surface active agent were 1.5 g/m², 40 mg/m², 0.1 g/m², 50 mg/m², 50 mg/m², 40 mg/M², and 5 mg/m², respectively. The coating solution had comprised proxel and phenoxyethanol as preservatives incorporated therein.

(H)

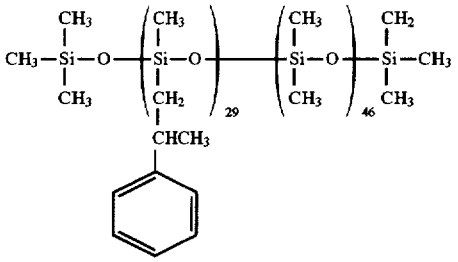

(I)

$C_8F_{17}SO_2N(C_3H_7)CH_2COOK$

A backing layer was coated in the following formulations:

| | |
|---|---|
| Gelatin | 3.0 mg/m$^2$ |
| Surface active agent (sodium salt of p-dodecylbenzenesulfonate) | 40 mg/m$^2$ |
| Sodium dihexyl-α-sulfosuccinate | 40 mg/m$^2$ |
| Gelatin hardener (1,2-bis (vinylsulfonylacetamide)ethane | 200 mg/m$^2$ |
| $SnO_2$/Sb (weight ratio: 90/10; average grain diameter: 0.20 μm) | 200 mg/m$^2$ |
| Dye (mixture of the following dyes (J), (K), (L) and (M)) | |
| Dye (J) | 20 mg/m$^2$ |
| Dye (K) | 50 mg/m$^2$ |
| Dye (L) | 20 mg/m$^2$ |
| Dye (M) | 30 mg/m$^2$ |
| Proxel | 10 mg/m$^2$ |

(J)

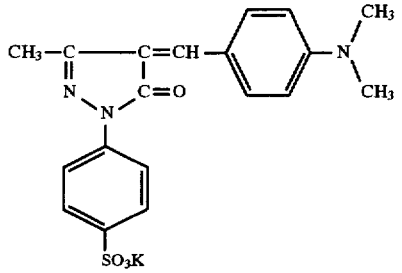

(K)

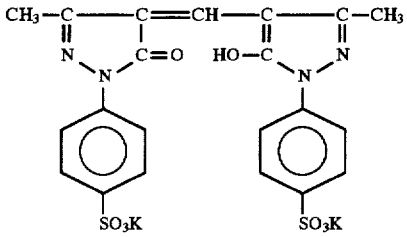

(L)

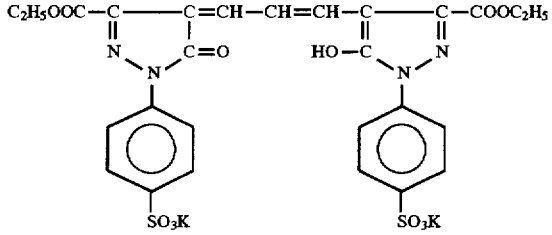

-continued (M)

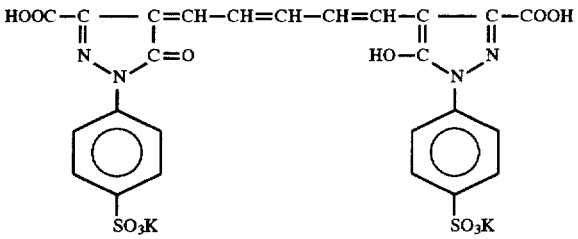

Backing layer

Back protective layer

| | |
|---|---|
| Gelatin | 1.1 g/m$^2$ |
| Finely divided grains of polymethyl methacrylate (average grain diameter: 2.5 μm) | 20 mg/m$^2$ |
| Sodium dodecylbenzenesulfonate | 15 m/m$^2$ |
| Sodium dihexyl-α-sulfosuccinate | 15 mg/m$^2$ |
| Sodium acetate | 60 mg/m$^2$ |
| Proxel | 1 mg/m$^2$ |

Thus, Specimens 1-1 to 1-17 were prepared as set forth in Table 1. These specimens exhibited a pH of 5.9 to 6.1 on the surface thereof. (The pH was determined by dropping 0.05 ml of water onto 1 cm$^2$ of the surface of the side of the light-sensitive material coated with the emulsion (after coating photographic layers such as a silver halide emulsion layer and light-insensitive hydrophilic colloidal layers and drying), allowing to stand under 90% RH for 10 minutes, and measuring the pH using, for example, a plain electrode GS-165F manufactured by TOA DENPA KOGYO Co., Ltd.) The developer had the following formulations:

Developer

| | |
|---|---|
| Potassium hydroxide | 90.0 g |
| Sodium hydroxide | 8.0 g |
| Disodium ethylenediaminetetraacetate | 1.0 g |
| Boric acid | 24.0 g |
| Sodium metabisulfite | 65.0 g |
| Potassium bromide | 10.0 g |
| Hydroquinone | 55.0 g |
| 5-Methylbenzotriazole | 0.4 g |
| N-methyl-p-aminophenol | 0.5 g |
| Sodium 2-mercaptobenzimidazole-5-sulfonate | 0.3 g |
| Sodium 3-(5-mercaptotetrazole) benzenesulfonate | 0.2 g |
| N-n-butyl-diethanolamine | 14.0 g |
| N,N-dimethylamino-6-hexanol | 0.2 g |
| Sodium toluenesulfonate | 8.0 g |
| 5-Sulfosalicylic acid | 23.0 g |
| Water to make | 1 l |
| (after adjustment of the pH) | |
| Potassium hydroxide to make | pH 11.9 |

These specimens were each exposed on the emulsion side to light from a tungsten lamp through a step wedge. These specimens were then processed with the foregoing developer and GR-F1 (available from Fuji Photo Film Co., Ltd.) as a fixing solution by means of Type FG-710F automatic developing machine (available from Fuji Photo Film Co., Ltd.) to determine photographic properties 1.

The sensitivity is represented by the following formula;

$$\text{Sensitivity}=\log(E/E')+1$$

wherein E is the exposure for Specimen 1-1 and E' is the exposure for the other Specimen to obtain density of fog plus 0.1 by developing the photographic material at 34° C. for 30 seconds, and log is conventional logalithm. The higher this value is, the higher is the sensitivity. The value γ is represented by the following equation. Dmax is represented by the density at the exposure E" of which logalithm corresponds to log E (E has the same meaning as above) plus 0.5 on the characteristic curve.

$$\gamma = \frac{3.0 - 0.3}{\log(\text{exposure giving a density of } 3.0) - \log(\text{exposure giving a density of } 0.3)}$$

Photographic properties 2 were determined for sensitivity, γ and Dmax in the same manner as the photographic properties 1 except that a developer having the seme formulations as the foregoing developer but having a sodium metabisulfite content of one third that of the foregoing developer and a pH of 0.1 higher than the foregoing developer was used as a simulation of aged developer.

The black pepper was subjected to 5-step evaluation by observing the unexposed portion developed at 34° C. for 40 seconds under microscope. In the 5-step evaluation, Step "5" is excellent, and Step "1" is poor. Steps "5" and "4" are practicable. Step "3" is the lowest practicable level. Steps "2" and "1" are impracticable levels.

The image quality was evaluated in the following manner:

1. Evaluation of enlarged image quality (1) Preparation of original Using a monochromatic scanner SCANART30 and a light-sensitive material SF-100 dedicated for this purpose (produced by Fuji Photo Film Co., Ltd.), a transparent image of a person of dots and a step wedge having a stepwise gradation of dot percentage were prepared. The number of lines in the screen was 150 per inch.

(2) Picture taking

These originals were positioned in a plate-making camera fine zoom C-880 (a camera-integrated type automatic developing machine; processing by LD-281Q) produced by Dainippon Screen Mfg. Co., Ltd. in such an arrangement that the magnification of enlargement was 1.2. The specimens to be evaluated were each then exposed to light from a xenon lamp in such a manner that the portion of 95% (dot area) on the original turned to 5% (dot area) on the light-sensitive material and developed.

(3) Evaluation

A five step evaluation (5 to 1) was made on the gradation reproducibility (difficulty in dot collapse) of the shadow portion of the specimen on the small dot side (highlighted portion) at which the dot percentage was adjusted by controlling the exposure as described in the foregoing paragraph (2). In the 5-step evaluation, Step "5" is excellent, and Step "1" is poor. Steps "5" and "4" are practicable. Step "3" is the lowest practicable level. Steps "2" and "1" are impracticable levels.

2. Evaluation of copy dot (1) Preparation of original

Using a monochromatic scanner SCANART30 and a light-sensitive material SF-100WP dedicated for this purpose (both are produced by Fuji Photo Film Co., Ltd.), a step wedge having a stepwise gradation of dot percentage was prepared. The number of lines in the screen upon exposure was 150 per inch.

(2) Picture taking

The original and the specimen were properly positioned in a plate-making camera C-690 (Autocompanica) produced by Dainippon Screen Mfg. Co., Ltd. and photographed by illuminating light to the reflecting original. The exposure time was adjusted such that the 80% (dot area) step wedge portion on the original turned to 10% (dot area) step wede on the specimen.

(3) Evaluation

A five step evaluation (5-1) was made on the gradation reproducibility (difficulty in dot collapse) of the shadow portion (dot percentage: 10%) of the specimen on the small dot side at which the dot percentage was adjusted by controlling the exposure time as described in the foregoing paragraph. In the 5-step evaluation, Step "5" is excellent, and Step "1" is poor. Steps "5" and "4" are practicable. Step "3" is the lowest practicable level. Steps "2" and "1" are impracticable levels.

The results are set forth in Table 1.

TABLE 1

| | Hydrazine Derivative | | Gelatin Layer | | Photographic Properties 1 | | | Photographic Properties 2 | | | | | | |
|---|---|---|---|---|---|---|---|---|---|---|---|---|---|---|
| Specimen No. | No. of Compound | Amount* | Amount** | Thickness*** | Sensitivity | γ | Dmax | Sensitivity | γ | Dmax | Black Pepper | Copy Dot | Enlargement | Remarks |
| 1-1 | 7 | $5 \times 10^{-4}$ | — | 0 | 1.00 | 15 | 5.2 | 0.98 | 14 | 4.9 | 1 | 1 | 1 | Comparative |
| 1-2 | 7 | $5 \times 10^{-4}$ | 0.1 | 0.2 | 1.00 | 15 | 5.2 | 0.98 | 14 | 5.0 | 3 | 3 | 3 | Invention |
| 1-3 | 7 | $5 \times 10^{-4}$ | 0.3 | 0.5 | 1.00 | 15 | 5.2 | 0.98 | 14 | 5.1 | 4 | 3 | 3 | " |
| 1-4 | 7 | $5 \times 10^{-4}$ | 0.5 | 0.8 | 0.99 | 15 | 5.1 | 0.98 | 13 | 5.1 | 4 | 3 | 3 | " |
| 1-5 | 7 | $5 \times 10^{-4}$ | 1.0 | 1.6 | 0.98 | 14 | 5.0 | 0.97 | 13 | 5.0 | 5 | 3 | 4 | " |
| 1-6 | 13 | $5 \times 10^{-4}$ | — | 0 | 1.02 | 15 | 5.2 | 1.00 | 14 | 4.9 | 1 | 1 | 1 | Comparative |
| 1-7 | 13 | $5 \times 10^{-4}$ | 0.1 | 0.2 | 1.02 | 15 | 5.2 | 1.00 | 14 | 5.0 | 3 | 3 | 3 | Invention |
| 1-8 | 13 | $5 \times 10^{-4}$ | 0.3 | 0.5 | 1.02 | 15 | 5.2 | 1.00 | 14 | 5.1 | 4 | 3 | 3 | " |
| 1-9 | 13 | $5 \times 10^{-4}$ | 0.5 | 0.8 | 1.01 | 15 | 5.1 | 1.00 | 13 | 5.1 | 4 | 3 | 3 | " |
| 1-10 | 13 | $5 \times 10^{-3}$ | 0.5 | 0.8 | 1.06 | 17 | 5.2 | 1.05 | 15 | 5.1 | 3 | 3 | 3 | " |
| 1-11 | 13 | $5 \times 10^{-4}$ | 1.0 | 1.6 | 1.00 | 14 | 5.0 | 0.99 | 13 | 5.0 | 5 | 3 | 4 | " |
| 1-12 | 13 | $1 \times 10^{-3}$ | 1.0 | 1.6 | 1.05 | 16 | 5.1 | 1.03 | 14 | 5.0 | 4 | 3 | 3 | " |
| 1-13 | 13 | $5 \times 10^{-4}$ | 1.5 | 2.4 | 0.98 | 13 | 4.9 | 0.96 | 11 | 4.8 | 5 | 3 | 4 | " |
| 1-14 | E | $5 \times 10^{-4}$ | 0.3 | 0.5 | 1.02 | 14 | 5.1 | 0.88 | 9 | 4.4 | 3 | 3 | 3 | Comparative |
| 1-15 | E | $1 \times 10^{-3}$ | 0.3 | 0.5 | 1.07 | 16 | 5.2 | 0.92 | 10 | 4.4 | 2 | 2 | 2 | " |
| 1-16 | F | $5 \times 10^{-6}$ | 0.3 | 0.5 | 1.05 | 15 | 5.0 | 0.95 | 9 | 4.2 | 3 | 3 | 2 | " |
| 1-17 | F | $1 \times 10^{-5}$ | 0.3 | 0.5 | 1.10 | 17 | 5.2 | 1.00 | 10 | 4.2 | 2 | 2 | 2 | " |

*mol/Ag · mol
**g/m²
***μm

It can be seen in Table 1 that Specimens 1-2 to 1-5 and 1-7 to 1-13 according to the present invention exhibit a reduced change in sensitivity, γ and Dmax from the Photographic Properties 1 to the Photographic Properties 2, less black peppers, and improved enlargement and copy dot properties as compared with the comparative specimens. Comparative Specimens 1-14 to 1-17, free of hydrazine derivatives according to the present invention, exhibit a great change in sensitivity, γ and Dmax from the photographic properties 1 to the Photographic Properties 2. Further, Comparative Specimens 1-1 and 1-6, free of the layer structure according to the present invention, exhibit much black peppers and poor enlargement and copy dot properties. The speicmens free of hydrazine derivatives according to the present invention exhibit γ of 6 or 7 of the Photographic Properties 1 and thus do not exhibit ultrahigh contrast.

EXAMPLE 2

A hydrazine derivative-containing layer coating solution was prepared in the same manner as in Example 1 except that a hydrazine derivative according to the present invention was added in an amount of $5\times10^{-4}$ mol per mol of silver and a comparative hydrazine compound represented by the structural formula (E) was added as set forth in Table 2.

Onto a polyethylene terephthalate film having a vinylidene chloride-containing moistureproof undercoating layer on both sides thereof was coated a gelatin layer as a lowermost layer in an amount of 0 g to 1.0 g as set forth in Table 2. Onto the gelatin layer was then coated the foregoing emulsion layer coating solution in an amount of 3.6 g/m$^2$ (gelatin: 1.8 g/m$^2$). The gelatin layer coating solution to be coated as a lowermost layer had comprised a polyethyl acrylate dispersion in the same coated amount as gelatin. The thickness of the lowermost layer was within the range of 0 to 1.6 μm as shown in Table 2.

A protective layer and a backing layer were coated in the same manner as in Example 1 to prepare Specimens 2-1 to 2-17. The photographic properties of the specimens were evaluated in the same manner as in Example 1. The sensitivity was determined relative to that of Specimen 2-1 as 1.

The results are set forth in Table 2.

TABLE 2

| Specimen No. | No. of Hydrazine Derivative | Gelatin Layer Amount* | Gelatin Layer Thickness** | Solid-Dispersed Dye No. of Dye | Solid-Dispersed Dye Amount*** | Photographic Properties 1 Sensitivity | Photographic Properties 1 γ | Photographic Properties 1 Dmax | Photographic Properties 2 Sensitivity | Photographic Properties 2 γ | Photographic Properties 2 Dmax | Black Pepper | Copy Dot | Enlargement | Remarks |
|---|---|---|---|---|---|---|---|---|---|---|---|---|---|---|---|
| 2-1 | 7 | — | 0 | — | — | 1.00 | 15 | 5.2 | 0.98 | 14 | 4.9 | 1 | 1 | 1 | Comparative |
| 2-2 | 7 | 0.3 | 0.5 | — | — | 1.00 | 15 | 5.2 | 0.98 | 14 | 5.1 | 4 | 3 | 3 | Invention |
| 2-3 | 7 | 0.3 | 0.5 | III-1 | 100 | 1.00 | 15 | 5.2 | 0.98 | 14 | 5.1 | 4 | 4 | 3 | " |
| 2-4 | 7 | 0.3 | 0.5 | III-2 | 100 | 0.98 | 15 | 5.2 | 0.96 | 14 | 5.1 | 4 | 4 | 3 | " |
| 2-5 | 7 | 0.3 | 0.5 | III-3 | 100 | 0.98 | 15 | 5.2 | 0.96 | 14 | 5.1 | 4 | 4 | 3 | " |
| 2-6 | 7 | 0.3 | 0.5 | III-3 | 150 | 0.97 | 15 | 5.2 | 0.95 | 14 | 5.1 | 4 | 4 | 4 | " |
| 2-7 | 7 | 0.3 | 0.5 | III-4 | 100 | 0.99 | 15 | 5.2 | 0.97 | 14 | 5.1 | 4 | 4 | 3 | " |
| 2-8 | 7 | 1.0 | 1.6 | — | — | 0.98 | 14 | 5.0 | 0.97 | 13 | 5.0 | 5 | 3 | 4 | " |
| 2-9 | 7 | 1.0 | 1.6 | III-1 | 100 | 0.98 | 14 | 5.0 | 0.97 | 13 | 5.0 | 5 | 4 | 4 | " |
| 2-10 | 7 | 1.0 | 1.6 | III-2 | 100 | 0.96 | 14 | 5.0 | 0.95 | 13 | 5.0 | 5 | 4 | 4 | " |
| 2-11 | 7 | 1.0 | 1.6 | III-3 | 100 | 0.96 | 14 | 5.0 | 0.95 | 13 | 5.0 | 5 | 4 | 4 | " |
| 2-12 | 7 | 1.0 | 1.6 | III-4 | 100 | 0.97 | 14 | 5.0 | 0.95 | 13 | 5.0 | 5 | 4 | 4 | " |
| 2-13 | E | 0.3 | 0.5 | — | — | 1.02 | 14 | 5.1 | 0.88 | 9 | 4.4 | 3 | 3 | 3 | Comparative |
| 2-14 | E | 0.3 | 0.5 | III-1 | 100 | 1.02 | 14 | 5.1 | 0.87 | 9 | 4.4 | 3 | 4 | 3 | " |
| 2-15 | E | 0.3 | 0.5 | III-2 | 100 | 1.00 | 14 | 5.1 | 0.85 | 9 | 4.3 | 3 | 4 | 3 | " |
| 2-16 | E | 0.3 | 0.5 | III-3 | 100 | 1.00 | 14 | 5.1 | 0.85 | 9 | 4.4 | 3 | 4 | 3 | " |
| 2-17 | E | 0.3 | 0.5 | III-4 | 100 | 1.00 | 14 | 5.1 | 0.86 | 9 | 4.3 | 3 | 4 | 3 | " |

*g/m$^2$
**μm
***mg/m$^2$

It can be seen in Table 2 that Specimens 2-2 to 2-12 according to the present invention exhibit a reduced change in sensitivity, γ and Dmax from the Photographic Properties 1 to the Photographic Properties 2, less black peppers, and improved enlargement and copy dot properties as compared with the comparative specimens. Comparative Specimens 2-14 to 2-17 which are free of hydrazine derivatives according to the present invention, exhibit a great change in sensitivity, γ and Dmax from the Photographic Properties 1 to the Photographic Properties 2. Further, Comparative Specimen 1-1, free of the layer structure according to the present invention, exhibits much black peppers and poor enlargement and copy dot properties. Specimens 2-3 to 2-7 and 2-9 to 2-12, comprising a solid-dispersed dye according to the present invention, exhibit an improved image quality as compared with Specimens 2-2 and 2-8, free of solid-dispersed dye.

EXAMPLE 3

Preparation of coating emulsion for hydrazine-containing layer

To the same emulsion as used in Example 1 were added as sensitizing dyes potassium salt of 5-[3-(4-sulfobutyl)-5-chloro-2-benzoxazolidilidene]ethylidene-1-hydroxyethoxyethyl-3-(2-phenyl)-2-thiohydantoin in an amount of $3\times10^{-4}$ mol per mol of silver, potassium salt of 5-[3-(4-sulfobutyl)-2-benzoxazolidiliene]ethylidene-1-hydroxyethoxyethyl-3-(2-phenyl)-2-thiohydantoin in an amount of $3\times10^{-4}$, a short wave cyanine dye represented by the structural formula (A) as set forth in Example 1 in an amount of $6\times10^{-4}$ mol per mol of silver, 1-phenyl-5-mercaptotetrazole in an amount of $3\times10^{-4}$ mol per mol of silver, a mercapto compound represented by the structural formula (B) in an amount of $6\times10^{-4}$ mol per mol of silver, a mercapto compound represented by the structural formula (C) in an amount of $6\times10^{-4}$ mol per mol of silver, a triazine compound represented by the structural formula (D) in an amount of $3\times10^{-4}$ mol per mol of silver, 5-chloro-8-hydroxyquinoline in an amount of $6\times10^{-4}$ mol per mol of silver, and a compound represented by the following structural formula (N) in an amount of $3\times10^{-4}$ mol per mol of silver. To the emulsion were then added either or both of the hydrazine compound 13 according to the present invention and the comparative hydrazine compound (E) in an amount of $1\times10^{-3}$ mol per mol of silver. The combined use of the two hydrazine compounds is represented by 13+E in Table 3. To the emulsion were further added sodium salt of N-oleyl-N-methyltaurine, a colloidal silica (Snowtex C available from Nissan Chemical Industries, Ltd.) and a polyethyl acrylate dispersion in such a manner that the coated amounts thereof were 30 mg/m$^2$, 500 mg/m$^2$ and 500 mg/m$^2$, respectively, to prepare coating solutions for hydrazine-containing layer.

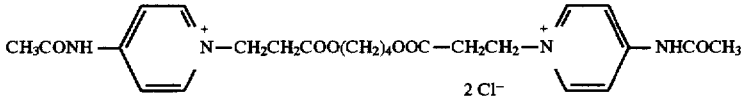

(N)

Preparation of emulsion for redox compound-containing layer

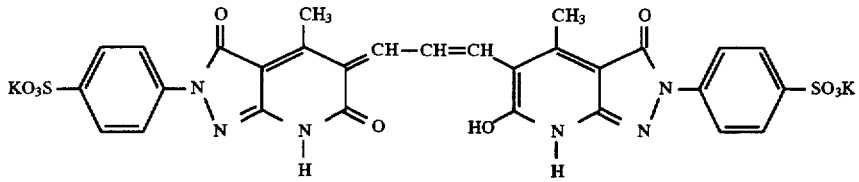

(N)

700 ml of an aqueous solution of 170 g of silver nitrate and 700 ml of an aqueous halide solution of 36 g of potassium bromide and 47 g of sodium chloride containing $(NH_4)_3RhCl_6$ in an amount of $3\times10^{-7}$ mol per mol of silver were added to a 2% aqueous solution of gelatin containing sodium chloride (0.5%) and 1,3-dimethyl-2-imidazolithione (0.002%) at a temperature of 45° C. with stirring in 30 minutes by double jet process to obtain silver bromochloride grains having an average grain size of 0.30 μm and a silver chloride content of 70 mol %. Thereafter, a potassium iodide solution having a concentration of $1\times10^{-3}$ mol per mol of silver was added to the emulsion to make conversion. The emulsion was then rinsed by an ordinary flocculation method. Gelatin was then added to the emulsion in an amount of 40 g per mol of silver, and the pH and pAg thereof were adjusted to 6.0 and 7.5, respectively. To the emulsion were then added sodium benzenethiosulfonate, sodium benzenesulfinate, chloroauric acid and sodium thiosulfate in an amount of 7 mg, 2 mg, 8 mg and 5 mg per mol of silver, respectively. The emulsion was then heated to a temperature of 60° C. for 60 minutes so that it was subjected to chemical sensitization. To the emulsion were then added 350 mg of 4-hydroxy-6-methyl-1,3,3a,7-tetrazaindene as a stabilizer and 100 mg of proxel as a preservative. As a result, an emulsion of cubic silver bromochloride grains having an average grain size of 0.30 μm and a silver chloride content of 70 mol % (coefficient of variation: 9%) was obtained.

To the emulsion thus obtained were then added as sensitizing dyes potassium salt of 5-[3-(4-sulfobutyl)-5-chloro-2-benzoxazolidilidene]ethylidene-1-hydroxyethoxyethyl-3-(2-phenyl)-2-thiohydantoin in an amount of $5\times10^{-4}$ mol per mol of silver (contained in this redox compound-containing emulsion layer: the same hereinafter in preparation of this emulsion), the mercapto compound represented by the structural formula (B) in an amount of $6\times10^{-4}$ mol per mol of silver, the triazine compound represented by the structural formula (D) in an amount of $3\times10^{-4}$ per mol of silver, and 5-chloro-8-hydroxyquinoline in an amount of $6\times10^{-4}$ mol per mol of silver. To the emulsion were then added a dye represented by the following structural formula (O) in an amount of 10 mg/m$^2$, a polyethyl acrylate (dispersion) in an amount of 300 mg/m$^2$, 1,2-bis(vinylsulfonylacetamido) ethane as a hardener in an amount of 30 mg/m$^2$, and a redox compound according to the present invention as set forth in Table 3 below in an amount of 60 mg/m$^2$.

Preparation of interlayer coating solution

To a gelatin solution containing proxel as a preservative were added sodium ethanethiosulfonate in an amount of 5 mg/m$^2$, a dye represented by the following structural formula (P) in an amount of 100 mg/m$^2$, hydroquinone in an amount of 100 mg/m$^2$, and a polyethyl acrylate (dispersion) in an amount of 300 mg/m$^2$ to prepare a coating solution for interlayer.

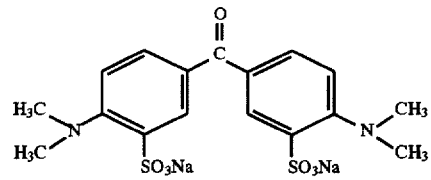

(P)

Onto a polyethylene terephthalate film having a vinylidene chloride-containing moistureproof undercoating layer on both sides thereof was coated a gelatin layer as a lowermost layer in an amount of 0 g to 1.0 g as set forth in Table 3. Onto the gelatin layer was then coated a redox compound-containing layer (Ag: 0.3 g/m$^2$; gelatin: 0.3 g/m$^2$) with a hydrazine-containing layer (Ag: 3.5 g/m$^2$; gelatin: 1.7 g/m$^2$) and an interlayer (gelatin: 1.2 g/m$^2$) interposed therebetween. Onto the emulsion layer was then coated a protective layer in such an amount that the coated amount of gelatin, an amorphous $SiO_2$ matting agent having an average grain size of about 3.5 μm, a colloidal silica (Snowtex C available from Nissan Chemical Industries, Ltd.), a liquid paraffin, a fluorinic surface active agent represented by the structural formula (I) as used as a coating aid in Example 1 and sodium p-dodecylbenzenesulfonate were 0.3 g/m$^2$, 60 mg/m$^2$, 0.1 g/m$^2$, 50 mg/M$^2$, 5 mg/M$^2$, and 20 mg/m$^2$, respectively. The coating solution for the lowermost layer had comprised a polyethyl acrylate dispersion in the same amount as gelatin, bis(vinylsulfonyl) methane in an amount of 40 mg/m$^2$ and a solid-dispersed dye according to the present invention as set forth in Table 3. In the specimens free of the lowermost gelatin layer, bis(vinylsulfonyl)methane was incorporated in the hydrazine derivative-containing layer in an amount of 40 mg/m$^2$. Only Specimen 3-20 comprised a solid-dispersible dye III-1 incorporated in the protective layer in an amount of 50 mg/m$^2$. A backing layer was then coated on the other side of these specimens to prepare Specimens 3-1 to 3-24 as set forth in Table 3. These specimens exhibited a pH of 5.9 to 6.1 on the surface thereof.

TABLE 3

| Specimen No. | No. of Hydrazine Derivative | Amount of Gelatin in Gelatin Layer | Redox Compound | Solid-Dispersed Dye | Remarks |
|---|---|---|---|---|---|
| 3-1 | 13 | — | — | — | |
| 3-2 | 13 | — | B-19 | — | |
| 3-3 | 13 | 0.3 | — | — | |
| 3-4 | 13 | 0.3 | B-19 | — | |
| 3-5 | 13 | 0.3 | — | III-3 | |
| 3-6 | 13 | 0.3 | B-19 | III-3 | |
| 3-7 | 13 | 0.3 | B-19 | III-2 | |
| 3-8 | 13 | 0.3 | B-19 | III-4 | |

TABLE 3-continued

| Specimen No. | No. of Hydrazine Derivative | Amount of Gelatin in Gelatin Layer | Redox Compound | Solid-Dispersed Dye | Remarks |
|---|---|---|---|---|---|
| 3-9 | 13 | 0.3 | B-19 | III-1 | |
| 3-10 | 13 | 1.0 | — | — | |
| 3-11 | 13 | 1.0 | B-19 | — | |
| 3-12 | 13 | 1.0 | — | III-3 | |
| 3-13 | 13 | 1.0 | B-19 | III-3 | |
| 3-14 | 13 + E | — | — | — | |
| 3-15 | 13 + E | — | B-19 | — | |
| 3-16 | 13 + E | 0.3 | — | — | |
| 3-17 | 13 + E | 0.3 | B-19 | — | |
| 3-18 | 13 + E | 0.3 | — | III-3 | |
| 3-19 | 13 + E | 0.3 | B-19 | III-3 | |
| 3-20 | 13 + E | 0.3 | B-19 | III-3 | III-1 was incorporated in protective layer |
| 3-21 | E | 0.3 | B-19 | III-3 | |
| 3-22 | E | 0.3 | B-19 | III-2 | |
| 3-23 | E | 0.3 | B-19 | III-4 | |
| 3-24 | E | 0.3 | B-19 | III-1 | |

* g/m$^2$

The photographic properties of these specimens were evaluated in the same manner as in Example 1. The sensitivity was determined relative to that of Specimen 3-1 as 1. The results are set forth in Table 4.

TABLE 4

| Specimen No. | Photographic Properties 1 | | | Photographic Properties 2 | | | Black Pepper | Copy dot | Enlargement |
|---|---|---|---|---|---|---|---|---|---|
| | sensitivity | γ | Dmax | sensitivity | γ | Dmax | | | |
| 3-1 | 1.00 | 16 | 5.3 | 0.98 | 15 | 4.9 | 1 | 1 | 1 |
| 3-2 | 0.95 | 12 | 5.1 | 0.93 | 11 | 4.8 | 2 | 3 | 3 |
| 3-3 | 1.00 | 16 | 5.3 | 0.98 | 15 | 5.2 | 4 | 3 | 3 |
| 3-4 | 0.95 | 12 | 5.1 | 0.93 | 11 | 5.0 | 5 | 4 | 5 |
| 3-5 | 0.98 | 16 | 5.3 | 0.96 | 15 | 5.2 | 4 | 4 | 3 |
| 3-6 | 0.94 | 12 | 5.1 | 0.92 | 11 | 5.0 | 5 | 5 | 5 |
| 3-7 | 0.94 | 12 | 5.1 | 0.92 | 11 | 5.0 | 5 | 5 | 5 |
| 3-8 | 0.95 | 12 | 5.1 | 0.93 | 11 | 5.0 | 5 | 5 | 5 |
| 3-9 | 0.95 | 12 | 5.1 | 0.93 | 11 | 5.0 | 5 | 5 | 5 |
| 3-10 | 0.98 | 15 | 5.2 | 0.97 | 14 | 5.2 | 5 | 3 | 4 |
| 3-11 | 0.93 | 11 | 5.0 | 0.91 | 10 | 5.0 | 5 | 4 | 5 |
| 3-12 | 0.96 | 15 | 5.2 | 0.94 | 14 | 5.2 | 5 | 4 | 4 |
| 3-13 | 0.91 | 11 | 5.0 | 0.90 | 10 | 5.0 | 5 | 5 | 5 |
| 3-14 | 1.05 | 16 | 5.3 | 1.03 | 15 | 4.9 | 1 | 1 | 1 |
| 3-15 | 1.00 | 12 | 5.1 | 0.98 | 11 | 4.8 | 2 | 3 | 3 |
| 3-16 | 1.05 | 16 | 5.3 | 1.03 | 15 | 5.2 | 4 | 3 | 3 |
| 3-17 | 1.00 | 12 | 5.1 | 0.98 | 11 | 5.0 | 5 | 4 | 5 |
| 3-18 | 1.03 | 16 | 5.3 | 1.01 | 15 | 5.2 | 4 | 4 | 3 |
| 3-19 | 0.98 | 12 | 5.1 | 0.96 | 11 | 5.0 | 5 | 5 | 5 |
| 3-20 | 0.97 | 12 | 5.1 | 0.95 | 11 | 5.0 | 5 | 5 | 5 |
| 3-21 | 0.96 | 15 | 5.2 | 0.82 | 9 | 4.4 | 4 | 4 | 4 |
| 3-22 | 0.96 | 15 | 5.2 | 0.82 | 9 | 4.3 | 4 | 4 | 4 |
| 3-23 | 0.97 | 15 | 5.2 | 0.82 | 9 | 4.4 | 4 | 4 | 4 |
| 3-24 | 0.98 | 15 | 5.2 | 0.84 | 9 | 4.4 | 4 | 4 | 4 |

(Note: Specimens 3-1, 3-14, 3-15, and 3-21 to 3-24 are comparative while the others are according to the present invention)

It can be seen in Table 4 that Specimens 3-3 to 3-13 and 3-16 to 3-20 according to the present invention exhibit a reduced change in sensitivity, γ and Dmax from the Photo graphic Properties 1 to the Photographic Properties 2, less black peppers, and improved enlargement and copy dot properties as compared with the comparative specimens. Similarly to the results of Examples 1 and 2, Comparative Specimens 3-21 to 3-24, free of hydrazine derivatives according to the present invention, exhibit a great change in sensitivity, γ and Dmax from the Photographic Properties 1 to the Photographic Properties 2. Further, Comparative Specimens 3-1, 3-2, 3-14 and 3-15, free of the layer structure according to the present invention, leave something to be desired in the prevention of black peppers. Specimens 3-4, 3-6 to 3-9, 3-11, 3-13, 3-17, 3-19, and 3-20, comprising a redox compound according to the present invention, show further improvements in copy dot and enlargement properties. Further, the specimens comprising a solid-dispersed dye as well show a further improvement in image quality.

EXAMPLE 4

Specimens 4-1 to 4-24 were prepared in the same manner as Specimens 3-1 to 3-24 of Example 3 except that the solid-dispersible dye was incorporated in the protective layer instead of the lowermost layer. In Specimen 4-20, the solid-dispersible dye III-1 according to the present invention was incorporated in the lowermost layer instead of the protective layer.

The photographic properties of these specimens were evaluated in the same manner as in Examples 1 to 3 except that these specimens were exposed to light on the back side instead of the emulsion side. As a result, similarly to the results of Example 3, Specimens 4-3 to 4-13, and 4-16 to 4-20 according to the present invention exhibit a reduced change in sensitivity, γ and Dmax from the Photographic Properties 1 to the Photographic Properties 2, less black peppers, and excellent enlargement and copy dot properties as compared with the comparative specimens. Further, the use of redox compounds and solid-dispersible dyes according to the present invention provides a further improvement in image quality.

EXAMPLE 5

| Developer | |
|---|---|
| Hydroquinone | 25.0 g |
| 1-Phenyl-4-methyl-4-hydroxymethyl-3-pyrazolidone | 0.5 g |
| Sodium hydroxide | 10.0 g |
| Potassium sulfite | 60.0 g |
| Diethylenetriaminepentaacetic acid | 2.0 g |
| 2,3,5,6,7,8-Hexahydro-2-thioxo-4-(1H)-quinazolidone | 0.05 g |
| Potassium bromide | 3.0 g |
| 5-Methylbenzotriazole | 0.1 g |
| 2-Mercaptobenzimidazole-5-sulfonic acid | 0.15 g |
| Sodium 3-(5-mercaptotetrazole)benzene-sulfonate | 0.2 g |
| Sodium carbonate | 11.0 g |
| Water to make (after adjustment of pH) | 1 l |
| pH | 10.4 |

Preparation of emulsion

A 0.13M aqueous solution of silver nitrate and an aqueous halide solution of 0.04 mol of potassium bromide and 0.09 mol of sodium chloride containing $(NH_4)_3RhCl_6$ in an amount of $1\times10^{-7}$ mol per mol of silver were added to an aqueous solution of gelatin containing sodium chloride and 1,3-dimethyl-2-imidazolidinethione at a temperature of 38° C. with stirring by double jet process in 12 minutes to obtain silver bromochloride grains having an average grain size of 0.15 μm and a silver chloride content of 70 mol % by which nuclei were formed. Subsequently, a 0.87M aqueous solution of silver nitrate and an aqueous halide solution of 0.26 mol of potassium bromide and 0.65 mol of sodium chloride were added to the emulsion spending 20 minutes by double jet process.

Thereafter, a potassium iodide solution having a concentration of $1\times10^{-3}$ mol per mol of silver was added to the emulsion to make conversion. The emulsion was then rinsed by an ordinary flocculation method. Gelatin was then added to the emulsion in an amount of 40 g and the pH and pAg thereof were adjusted to 6.5 and 7.5, respectively. To the emulsion were then added sodium thiosulfate and chloroauric acid in an amount of 5 mg and 8 mg per mol of silver, respectively. The emulsion was then heated to a temperature of 60° C. for 60 minutes so that it was subjected to chemical sensitization. To the emulsion were then added 150 mg of 4-hydroxy-6-methyl-1,3,3a,7-tetrazaindene as a stabilizer. As a result, an emulsion of cubic silver bromochloride grains having an average grain size of 0.27 μm and a silver chloride content of 70 mol % (coefficient of variation: 10%) was obtained.

Preparation of coat specimen

To the emulsion thus obtained was then added a hydrazine derivative as set forth in Table 5.

To the emulsion were then added a compound represented by the following structural formula (S) in an amount of $3.4\times10^{-4}$ mol per mol of silver, 1-phenol-5-mercaptotetrazole in an amount of $2\times10^{-4}$ mol per mol of silver, a short wave cyanine dye represented by the following general formula (a) in an amount of $5\times10^{-4}$ mol per mol of silver, a water-soluble latex represented by the following structural formula (b) in an amount of 200 mg/m$^2$, a polyethyl acrylate dispersion in an amount of 200 mg/m$^2$, and 1,3-divinylsulfonyl-2-propanol as a hardener in an amount of 200 mg/m$^2$.

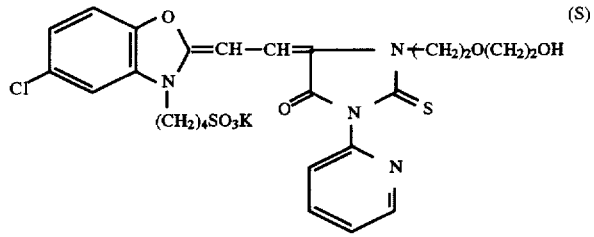

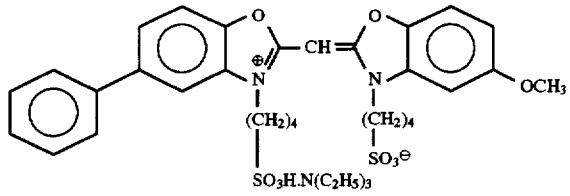

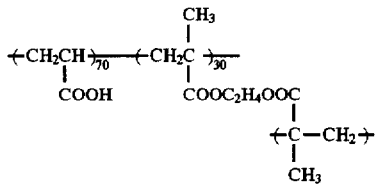

To the emulsion was further added an amine compound represented by the following structural formula in an amount of 20 mg/m$^2$:

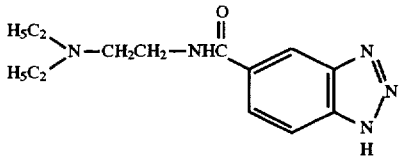

The formulations of the protective layer were gelatin (1.0 g/m$^2$), an amorphous $SiO_2$ matting agent having a grain size of about 3.5 μm (40 mg/m$^2$), methanol silica (0.1 g/m$^2$), a polyacrylamide (100 mg/m$^2$), hydroquinone (200 mg/m$^2$), a silicone oil, and a fluorinic surface active agent represented by the following structural formula and sodium dodecylbenzenesulfonate as coating aids.

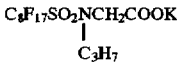

Onto a gelatin-undercoated polyethylene terephthalate was coated a gelatin layer containing 40 mg/m$^2$ of bis (vinylsulfonyl)methane in an amount of 0.3 g/m$^2$. Onto the gelatin layer was then simultaneously coated an emulsion layer and a protective layer.

A backing layer and a back protective layer were coated in the following formulations:

Backing layer

| | |
|---|---|
| Gelatin | 3 g/m$^2$ |
| Latex (polyethyl acrylate) | 2 g/m$^2$ |
| Surface active agent (sodium p-dodecylbenzenesulfonate) | 40 g/m$^2$ |
| Gelatin hardener | |

-continued

| | |
|---|---|
| $CH_2{=}CHSO_2CH_2CONH$ — $(CH_2)_2$ — $CH_2{=}CHSO_2CH_2CONH$ | 110 mg/m$^2$ |

Fluorinic surface active agent

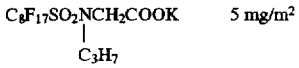

Dye (mixture of Dye (a), Dye (b) and Dye (c))

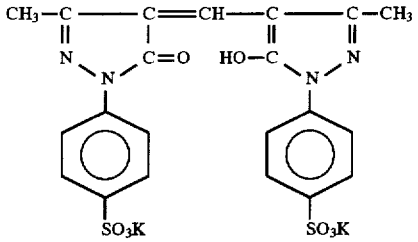

Dye [a] 50 mg/m$^2$

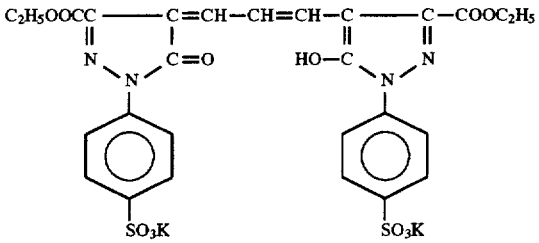

Dye [b] 100 mg/m$^2$

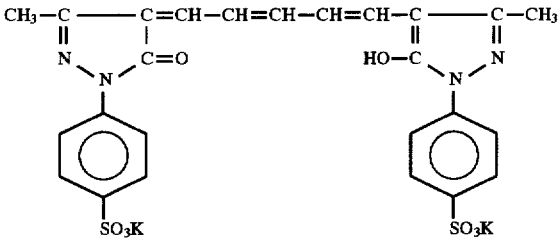

Dye [c] 50 mg/m$^2$

Back protective layer

| | |
|---|---|
| Gelatin | 0.8 mg/m$^2$ |
| Finely divided polymethyl methacrylate grains (average grain diameter: 4.5 μm) | 30 mg/m$^2$ |
| Sodium dihexyl-α-sulfosuccinate | 15 mg/m$^2$ |
| Sodium dodecylbenzenesulfonate | 15 mg/m$^2$ |
| Sodium acetate | 40 mg/m$^2$ |

Evaluation

These specimens were each exposed to light from a tungsten lamp having 3,200° K through an optical wedge or an optical wedge and a contact screen (150L chain dot type, available from Fuji Photo Film Co., Ltd.), processed with the foregoing developer 1 at a temperature of 34° C. for 30 seconds, fixed, rinsed, and then dried.

As the fixing solution there was used GR-F1 (available from Fuji Photo Film Co., Ltd.).

In the Photographic Properties 1, the sensitivity is represented by the conventional logarithm of the exposure giving a density of fog plus 1.5 relative to the value of Specimen A as 1. The higher this value is, the higher is the sensitivity. The value γ is represented by the following equation. Dmax is represented by the density at the exposure of log E plus 0.5 with respect to the sensitivity point of density of 0.1 on the characteristic curve.

$$\gamma = \frac{3.0 - 0.3}{\log(\text{exposure giving a density of } 3.0) - \log(\text{exposure giving a density of } 0.3)}$$

Photographic Properties 2 were determined for sensitivity and Dmax in the same manner as the photographic Properties 1 except that a developer having the seme formulations as the foregoing developer but having a potassium sulfite content of one third that of the foregoing developer and a pH value of 0.2 higher than the foregoing developer was used as a simulation of aged developer.

The results are set forth in Table 5.

TABLE 5

| Specimen | Compound of Formula (1) or (2) or Comparative Compound (mg/m²) | Compound of Formula (N) (mg/m²) | Photographic Properties 1 Sensitivity | γ | Dmax | Photographic Properties 2 Sensitivity | γ | Dmax | Remarks |
|---|---|---|---|---|---|---|---|---|---|
| A | — | N-37 (10) | 1.25 | 10.5 | 4.0 | 1.30 | 9.5 | 3.9 | Comparison |
| B | — | N-67 (20) | 1.30 | 16.0 | 4.8 | 1.40 | 9.3 | 3.2 | " |
| C | — | N-68 (20) | 1.32 | 16.5 | 4.8 | 1.42 | 9.2 | 3.2 | " |
| D | — | N-69 (20) | 1.35 | 17.8 | 4.9 | 1.46 | 9.5 | 3.3 | " |
| F | N-70 (30) | N-69 (20) | 1.37 | 18.0 | 4.9 | 1.42 | 9.0 | 3.5 | " |
| G | N-71 (30) | " | 1.39 | 18.5 | 5.0 | 1.45 | 9.5 | 3.3 | " |
| H | N-72 (30) | " | 1.38 | 18.1 | 4.9 | 1.43 | 9.1 | 3.2 | " |
| I | N-73 (30) | " | 1.40 | 18.3 | 4.8 | 1.45 | 9.9 | 3.3 | " |
| J | N-74 (30) | " | 1.38 | 17.9 | 5.0 | 1.43 | 9.3 | 3.6 | " |
| K | N-75 (30) | " | 1.42 | 18.9 | 5.1 | 1.48 | 9.8 | 3.7 | " |
| L | Compound 5 (30) | N-69 (20) | 1.42 | 19.8 | 5.2 | 1.46 | 16.3 | 4.6 | Invention |
| M | Compound 7 (30) | " | 1.43 | 20.1 | 5.1 | 1.47 | 18.5 | 4.5 | " |
| N | Compound 12 (30) | " | 1.40 | 18.9 | 5.3 | 1.44 | 16.4 | 4.7 | " |
| O | Compound 13 (30) | N-37 (10) | 1.35 | 16.1 | 5.1 | 1.38 | 15.0 | 4.5 | " |
| P | Compound 20 (30) | N-67 (10) | 1.37 | 19.3 | 5.3 | 1.40 | 17.0 | 4.6 | " |
| Q | Compound 23 (30) | N-68 (10) | 1.38 | 19.6 | 5.2 | 1.42 | 17.5 | 4.5 | " |
| R | Compound 12 (10), Compound 23 (10) | N-69 (20) | 1.44 | 18.8 | 5.1 | 1.47 | 16.9 | 4.6 | " |

Specimens A, B, C and D can provide γ of not less than 10 even if processed with a developer having a pH of lower than 11.0 but exhibit a markedly low contrast and a practically unacceptable level of Dmax (4.0 or less) when processed with an aged developer. As in Specimens F, G, H, I, J and K, even when a known hydrazine derivative is used in combination provides no improvements in γ and Dmax.

The combined use of a hydrazine derivative according to the present invention and a highly active hydrazine derivative (e.g., N-37, N-67, N-68, N-69) can provide γ of more than 10 with a low pH developer and a markedly small change in γ and Dmax.

EXAMPLE 6

Developer

| | |
|---|---|
| Hydroquinone | 50.0 g |
| N-methyl-p-aminophenol | 0.3 g |
| Sodium hydroxide | 18.0 g |
| 5-Sulfosalicyclic acid | 55.0 g |
| Potassium sulfite | 110.0 g |
| Disodium ethylenediaminetetraacetate | 1.0 g |
| Potassium bromide | 10.0 g |
| 5-Methylbenzotriazole | 0.4 g |
| 2-Mercaptobenzimidazole-5-sulfonic acid | 0.3 g |
| Sodium 3-(5-mercaptotetrazole)benzene- | 0.2 g |

-continued

| | |
|---|---|
| sulfonate | |
| N-n-butyldiethanolamine | 15.0 g |
| N-n-dimethyl-n-hexanolamine | 1.0 g |
| Sodium toluenesulfonate | 8.0 g |
| Water to make | 1 l |
| (after adjustment of pH) | |
| Potassium hydroxide to make | pH 11.8 |

Preparation of emulsion for image-forming layer

Emulsion A was prepared in the following manner: Emulsion A: A 0.37M aqueous solution of silver nitrate and an aqueous halide solution of 0.16 mol of potassium bromide and 0.22 mol of sodium chloride and containing $K_2Rh(H_2O)Cl_5$ in an amount of $1\times10^{-7}$ mol per mol of silver and $K_3IrCl_6$ in an amount of $2\times10^{-7}$ mol per mol of silver were added to a 2% aqueous solution of gelatin containing 0.08 mol of sodium chloride and 1,3-dimethyl-2-imidazolithione (0.002%) at a temperature of 38° C. with stirring by double jet process spending 12 minutes to obtain silver bromochloride grains having an average grain size of 0.20 μm and a silver chloride content of 55 mol % by which nuclei were formed. Subsequently, a 0.63M aqueous solution of silver nitrate and an aqueous halide solution of 0.23 mol of potassium bromide and 0.43 mol of sodium chloride were added to the emulsion spending 20 minutes by double jet process. Thereafter, a potassium iodide solution having a concentration of $1\times10^{-3}$ mol per mol of silver was added to the emulsion to make conversion. The emulsion was then rinsed by an ordinary flocculation method. Gelatin was then added to the emulsion in an amount of 40 g per mol of silver, and the pH and pAg thereof were adjusted to 6.0 and 7.3, respectively. To the emulsion were then added sodium benzenethiosulfonate, benzenesulfinic acid, chloroauric acid and sodium thiosulfate in an amount of 7 mg, 2 mg, 10 mg and 5 mg, respectively. The emulsion was then heated to a temperature of 60° C. for 100 minutes so that it was subjected to chemical sensitization. To the emulsion were then added 150 mg of 4-hydroxy-6-methyl-1,3,3a,7-tetrazaindene as a stabilizer and proxel as a preservative. As a result, an emulsion of cubic silver bromochloride grains having an average grain size of 0.27 μm and a silver chloride content of 60 mol % (coefficient of variation: 10%) was obtained.

To the emulsion thus obtained were then added potassium salt of 5-[3-(4-sulfobutyl)-5-chloro-2-benzoxazolidilidene] ethylidene-1-hydroxyethoxyethyl-3-(2-pyridyl)-2-thiohydantoin in an amount of $7\times10^{-4}$ mol per mol of silver, the short wave cyanine dye represented by the structural formula (A) in an amount of $6\times10^{-4}$ mol per mol of silver, 1-phenyl-5-mercaptotetrazole in an amount of $3\times10^{-4}$ mol per mol of silver, the mercapto compound represented by the structural formula (B) in an amount of $4\times10^{-4}$ mol per mol of silver, the mercapto compound represented by the structural formula (C) in an amount of $3\times10^{-4}$ mol per mol of silver, the triazine compound represented by the structural formula (D) in an amount of $4\times10^{-4}$ per mol of silver, and 5-chloro-8-hydroxyquinoline in an amount of $9\times10^{-4}$ mol per mol of silver. To the emulsion were then added a hydrazine derivative according to the present invention and comparative compounds as disclosed in Example 5 as set forth in Table 6.

To the emulsion were further added sodium salt of N-oleyl-N-methyltaurine in an amount of 30 mg/m$^2$. To the emulsion were then added a polyethyl acrylate dispersion in an amount of 500 mg/M$^2$ and 1,2-bis (vinylsulfonylacetamido) ethane as a hardener in an amount of 40 mg/M$^2$. The pH of the emulsion was adjusted to 6.0 to prepare a coating solution for hydrazine-containing layer.

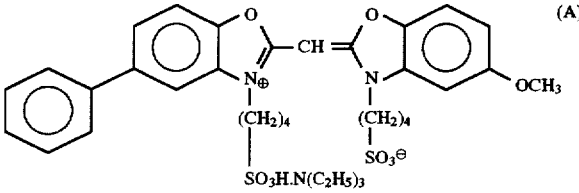

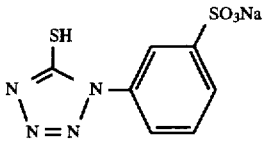

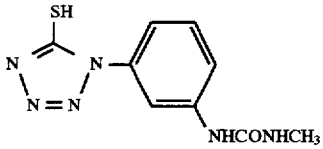

-continued

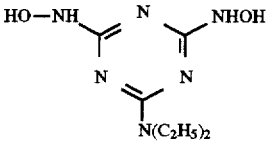

Preparation of emulsion for redox compound-containing layer

A 1.0M aqueous solution of silver nitrate and an aqueous halide solution of 0.3M of potassium bromide and 0.74 M of sodium chloride containing $(NH_4)_3RhCl_6$ in an amount of $3\times10^{-7}$ mol per mol of silver were added to a 2% aqueous solution of gelatin containing 0.08M of sodium chloride and 0.002% of 1,3-dimethyl-2-imidazolithione at a temperature of 45° C. with stirring spending 30 minutes by double jet process to obtain silver bromochloride grains having an average grain size of 0.30 μm and a silver chloride content of 70 mol %. Thereafter, a potassium iodide solution having a concentration of $1\times10^{-3}$ mol per mol of silver was added to the emulsion to make conversion. The emulsion was then rinsed by an ordinary flocculation method. Gelatin was then added to the emulsion in an amount of 40 g per mol of silver, and the pH and pAg thereof were adjusted to 6.0 and 7.6, respectively. To the emulsion were then added sodium benzenethiosulfonate, benzenesulfinic acid, chloroauric acid and sodium thiosulfate in an amount of 7 mg, 2 mg, 8 mg and 5 mg per mol of silver, respectively. The emulsion was then heated to a temperature of 60° C. for 60 minutes so that it was subjected to chemical sensitization. To the emulsion were then added 350 mg of 4-hydroxy-6-methyl-1,3,3a,7-tetrazaindene as a stabilizer and proxel as a preservative. As a result, an emulsion of cubic silver bromochloride grains having an average grain size of 0.30 μm and a silver chloride content of 70 mol % (coefficient of variation: 9%) was obtained.

To the emulsion thus obtained were then added as sensitizing dyes potassium salt of 5-[3-(4-sulfobutyl)-5-chloro-2-benzoxazolidilidene]ethylidene-1-hydroxyethoxyethyl-3-(2-pyridyl)-2-thiohydantoin in an amount of $5\times10^{-4}$ mol per mol of silver, a dye represented by the following structural formula (J) in an amount of 10 mg/m$^2$, a polyethylene acrylate dispersion in an amount of 250 mg/m$^2$, and a redox compound represented by the following structural formula (R) as set forth in Table 6.

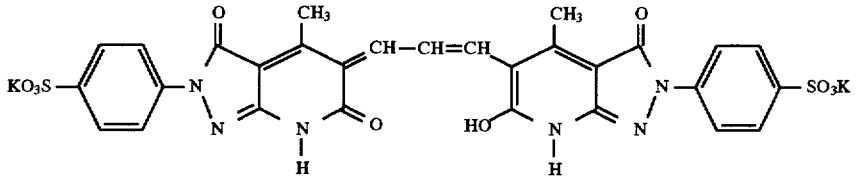

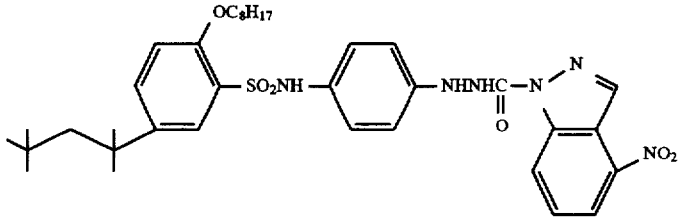

Preparation of interlayer coating solution

To a gelatin solution were added sodium ethanethiosulfonate in an amount of 5 mg/m $^2$, a dye represented by the following structural formula (K) in an amount of 100 mg/m$^2$, hydroquinone in an amount of 100 mg/m $^2$, a triol compound represented by the following structural formula (L) in an amount of 50 mg/m$^2$, and a polyethyl acrylate dispersion in an amount of 350 mg/m$^2$ to prepare a coating solution for interlayer.

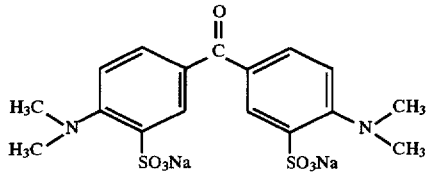

(K)

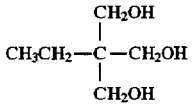

(L)

Onto a gelatin-undercoated polyethylene terephthalate film was coated a gelatin layer containing 40 mg/m$^2$ of bis(vinylsulfonyl)methane as a lowermost layer in an amount of 0.3 g/m$^2$. Onto the gelatin layer was then coated a redox compound-containing layer (Ag: 0.2 g/m$^2$; gelatin: 0.2 g/m$^2$) with an image-forming layer (Ag: 3.4 g/m$^2$; gelatin: 1.6 g/m$^2$) and an interlayer (gelatin: 1.0 g/m$^2$) interposed therebetween. Onto the redox compound-containing layer was then coated a protective layer in such an amount that the coated amount of gelatin, an amorphous $SiO_2$ matting agent having an average grain size of about 3.5 μm, a methanol silica, a liquid paraffin, a fluorinic surface active agent represented by the structural formula (F) as a coating aid and sodium p-dodecylbenzenesulfonate were 0.2 g/m$^2$, 60 mg/m$^2$, 0.1 g/m$^2$, 50 mg/m$^2$, 5 mg/m$^2$, and 20 mg/m$^2$, respectively.

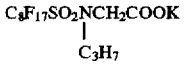

(F)

A backing layer was coated in the following formulations:

Backing layer

| | |
|---|---|
| Gelatin | 3.2 g/m$^2$ |
| Surface active agent (sodium p-dodecylbenzenesulfonate) | 40 g/m$^2$ |
| Sodium dihexyl-a-sulfosuccinate | 40 mg/m$^2$ |
| Gelatin hardener (1,3-divinylsulfonyl-2-propanol) | 200 mg/m$^2$ |
| Dye (mixture of Dye (M), Dye (H), Dye (I) and Dye (J)) | |

(M)

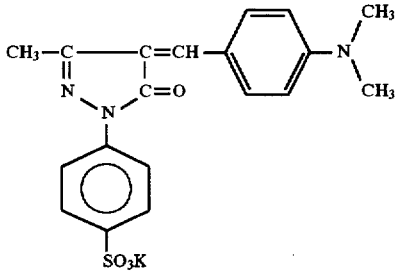

20 mg/m$^2$ (H)

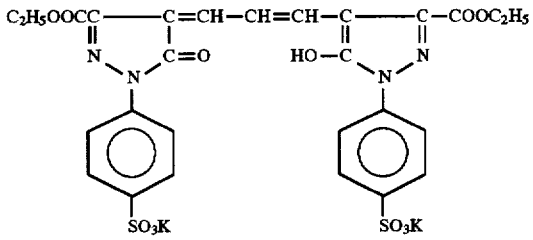

50 mg/m$^2$ (I)

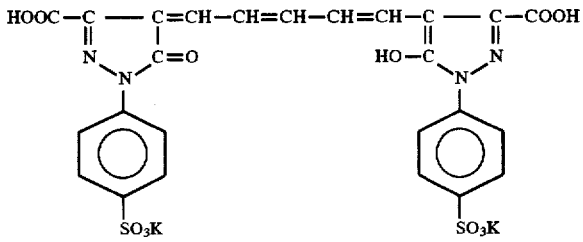

20 mg/m$^2$

-continued (J) 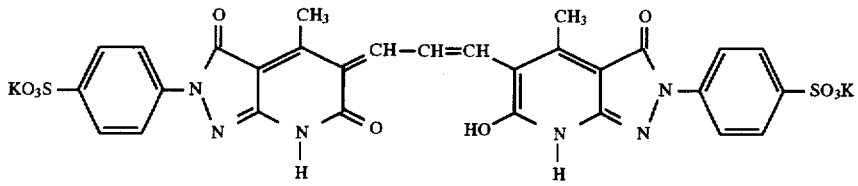 30 mg/m²

Proxel 4 mg/m²

Back protective layer

| | |
|---|---|
| Gelatin | 1.3 mg/m² |
| Finely divided polymethyl methacrylate grains (average grain diameter: 2.5 μm) | 20 mg/m² |
| Sodium p-dodecylbenzenesulfonate | 15 mg/m² |
| Sodium dihexyl-α-sulfosuccinate | 15 mg/m² |
| Sodium acetate | 60 mg/m² |

Evaluation

These specimens were each exposed to light from a tungsten lamp having 3,200° K through an optical wedge and a contact screen (150L chain dot type, available from Fuji Photo Film Co., Ltd.), and then processed with the foregoing developer at a temperature of 34° C. for 30 seconds by means of Type FG-710F automatic developing machine (available from Fuji Photo Film Co., Ltd.).

As the fixing solution there was used GR-F1 (available from Fuji Photo Film Co., Ltd.).

The evaluation of the photographic properties of these specimens was effected in the following manner.

The Photographic Properties 1 are results of the processing of these specimens with the foregoing developer at a temperature of 34° C. for 30 seconds by means of Type FG-710F automatic developing machine (available from Fuji Photo Film Co., Ltd.). As the fixing solution there was used GR-F1 (available from Fuji Photo Film Co., Ltd.).

The sensitivity and Dmax were determined in the same manner as in Example 5.

The dot gradation is represented by the following equation:

*Dot gradation=log E95%−log E5%

(wherein log E95% and log E5% are conventional logalithm of exposures which provide 95% and 5% of dot area ratios, respectively)

Photographic Properties 2 were determined for sensitivity and Dmax in the same manner as the Photographic Properties 1 except that a developer having the same formulations as the foregoing developer but having a potassium sulfite content of one third that of the foregoing developer and a pH of 0.2 higher than the foregoing developer was used as a simulation of aged developer.

The results are set forth in Table 6.

TABLE 6

| Specimen | Compound of Formula (1) or (2) or Comparative Comoound (mg/m²) | Compound of Formula (N) (mg/m²) | Amount of Redox Compound (mg/m²) | Photographic Properties 1 | | | Photographic Properties 2 | | Remarks |
|---|---|---|---|---|---|---|---|---|---|
| | | | | Sensitivity | Dmax | Dot Gradation | Sensitivity | Dmax | |
| A | — | N-5 (30) | 80 | 1.00 | 5.1 | 1.45 | 0.85 | 2.5 | Comparison |
| B | — | " | 40 | 1.16 | 5.2 | 1.32 | 1.09 | 3.6 | " |
| C | — | " | — | 1.30 | 5.3 | 1.20 | 1.35 | 5.2 | " |
| D | N-37 (1) | " | 80 | 1.07 | 5.1 | 1.38 | 0.95 | 2.9 | " |
| E | N-70 (30) | " | " | 1.02 | 5.1 | 1.43 | 0.87 | 2.8 | " |
| F | N-71 (30) | " | " | 1.01 | 5.2 | 1.41 | 0.88 | 2.7 | " |
| G | N-72 (30) | " | " | 1.03 | 5.2 | 1.42 | 0.88 | 2.8 | " |
| H | N-73 (30) | " | " | 1.03 | 5.1 | 1.42 | 0.89 | 2.6 | " |
| I | N-74 (30) | " | " | 1.01 | 5.2 | 1.43 | 0.88 | 2.7 | " |
| J | N-75 (30) | " | " | 1.02 | 5.2 | 1.41 | 0.89 | 2.7 | " |
| K | Compound 4 (30) | " | " | 1.02 | 5.1 | 1.42 | 1.04 | 4.5 | Invention |
| L | Compound 6 (30) | " | " | 1.01 | 5.2 | 1.42 | 1.02 | 4.5 | " |
| M | Compound 13 (30) | " | " | 1.02 | 5.1 | 1.43 | 1.04 | 4.7 | " |
| N | Compound 23 (30) | " | " | 1.02 | 5.2 | 1.41 | 1.04 | 4.6 | " |
| O | Compound 13 (30) | N-38 (10) | " | 1.03 | 5.1 | 1.41 | 1.04 | 4.4 | " |
| P | Compound 16 (30) | N-65 (40) | " | 1.02 | 5.0 | 1.40 | 1.03 | 4.3 | " |

The results of Specimens A, B and C show that the incorporation of a redox compound gives a markedly wide dot gradation but gives a paractically undesirable Dmax drop with an aged developer.

While the combined use of a known hydrazine derivative provides no improvements in Dmax, the combined use of a hydrazine derivative according to the present invention gives Dmax of 4.0 or more even with an aged developed. The use of a hydrazine derivative according to the present invention also allows the dot gradation to be kept at not less than 1.4 even with an aged developer.

The present invention provides a photographic light-sensitive material with a wide dot gradation and a small dependence on composition of processing solution.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one light-sensitive silver halide hydrophilic colloid emulsion layer containing at least 50 mol % AgCl, at least one light-insensitive hydrophilic layer interposed between said support and said at least one silver halide emulsion layer, and at least one hydrazine derivative selected from the group consisting of compounds represented by general formula (1) or (2) contained in at least one hydrophilic colloid layer provided on the same side of the support as that coated with the light-sensitive silver halide hydrophilic colloid emulsion layer:

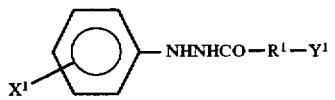

(1)

wherein $X^1$ represents an alkyl group, an alkoxy group, a substituted amino group, or an alkylthio group, and has 1–6 carbon atoms counting any substituents;

$Y^1$ represents an alkoxy group, an aryloxy group, a substituted amino group, an alkylthio group or an arylthio group; and R' represents an alkylene group;

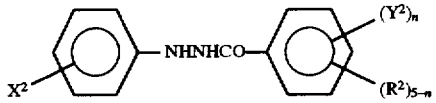

(2)

wherein $X^2$ has the same meaning as $X^1$ in the general formula (1); $Y^2$ represents an electron withdrawing group; $R^2$ represents a hydrogen atom, an alkyl group, an aryl group, an alkoxy group, an aryloxy group, a substituted amino group, an alkylthio group or an arylthio group; and n represents an integer of from 1 to 5, with the proviso that the plurality groups of $Y^2$ and/or $R^2$ may be the same or different;

wherein said silver halide photographic material is a black and white silver halide photographic material; and wherein said electron withdrawing group represented by $Y^2$ has a substitutent constant value $\sigma_m$ or $\sigma_p$ of at least 0.2.

2. The silver halide photographic material of claim 1, wherein $Y^1$ represents a substituted amino group substituted with a substituent selected from the group consisting of an alkyl group, an aryl group, an acyl group, an alkoxycarbonyl group, a carbamoyl group, a hydrazinocarbonyl group, an alkylsufonyl group, an arylsulfonyl group and a sulfamoyl group.

3. The silver halide photographic material of claim 1, wherein $R^2$ represents a substituted amino group substituted with a substituent selected from the group consisting of an alkyl group, an aryl group, an acyl group, an alkoxycarbonyl group, an aryloxycarbonyl group, a carbamoyl group, a hydrazinocarbonyl group, an alkylsufonyl group, an arylsulfonyl group and a sulfamoyl group.

4. The silver halide photographic material of claim 1, wherein $X^1$ represents a substituted amino group substituted with a substituent selected from the group consisting of an alkyl group, an aryl group, an acyl group, an alkoxycarbonyl group, a carbamoyl group, a hydrazinocarbonyl group, an alkylsufonyl group, an arylsulfonyl group and a sulfamoyl group.

5. The silver halide photographic material of claim 1, wherein $X^1$ and $X^2$ each is a substituted amino group.

6. The silver halide photographic material of claim 1, wherein the substitution positions of $X^1$ and $X^2$ on the phenyl group in general formulae (1) and (2), respectively, are the meta or para positions with respect to the hydrozino moiety in general formulae (1) and (2), respectively.

7. The silver halide photographic material of claim 1, wherein said alkylene group represented by $R^1$ is substituted with at least one group selected from the group consisting of an alkyl group, an aralkyl group, an alkenyl group, an alkinyl group, an alkoxy group, an aryl group, an amino group, a ureido group, an alkoxycarbonylamino group, an aryloxy group, a sulfamoyl group, a carbamoyl group, an alkylthio group, an arylthio group, an alkylsulfonyl group, an arylsulfonyl group, an alkylsulfinyl group, an arylsulfinyl group, a hydroxy group, a halogen atom, a cyano group, —$SO^3M$ (wherein M represents a hydrogen atom, or an alkali metal atom), an aryloxycarbonyl group, an acyl group, an alkoxycarbonyl group, an acyloxy group, a carbonamido group, a sulfonamido group, —COOM (wherein M represents a hydrogen atom, or an alkali metal atom), a phosphonamido group, a diacylamino group, and an imido group.

8. The silver halide photographic material of claim 1, wherein $Y^2$ is situated at the position meta to the carbonyl group in general formula (2) when it has a $\sigma_m$ value of at least 0.2 or situated at the position para to the carbonyl group when it has a $\sigma_p$ value of at least 0.2, and Y is situated at the positions meta and/or para to the carbonyl group when $\sigma_m$ and $\sigma_p$ values of $Y^2$ are both at least 0.2.

9. The silver halide photographic material of claim 1 wherein said electron withdrawing group represented by $Y^2$ is a group selected from the group consisting of a sulfamoyl group, a carbamoyl group, an alkylsulfonyl group, an arylsulfonyl group, an alkylsulfinyl group, an arylsulfinyl group, a halogen atom, a cyano group, an alkyloxycarbonyl group, an aryloxycarbonyl group, an acyl group, a polyfluoroalkyl group and a polyfluoroaryl group.

10. The silver halide photographic material of claim 9, wherein said electron withdrawing group represented by $Y^2$ has a substituent selected from the group consisting of an alkyl group, an aralkyl group, an alkenyl group, an alkinyl group, an alkoxy group, an aryl group, an amino group, an ureido group, an alkoxycarbonylamino group, an aryloxy group, a sulfamoyl group, a carbamoyl group, an alkylthio group, an arylthio group, an alkylsulfonyl group, an arylsulfonyl group, an alkylsulfinyl group, an arylsulfinyl group, a hydroxy group, a halogen atom, a cyano group, —$SO_3M$ (wherein M represents a hydrogen atom, or an alkali metal atom), an aryloxycarbonyl group, an acyl group, an alkoxycarbonyl group, an acyloxy group, a carbonamido group, a sulfonamido group, —COOM (wherein M represents a hydrogen atom, or an alkali metal atom), a phosphonamido group, a diacylamino group, and an imido group.

11. The silver halide photographic material of claim 1, wherein at least one hydrophilic colloid layer which is different from the light-sensitive silver halide emulsion layer contains at least one dispersed solid dye.

12. The silver halide photographic material of claim 1, wherein at least one hydrophilic colloid layer contains at least one redox compound which undergoes oxidation to release a development inhibitor.

13. The silver halide photographic material of claim 1, wherein silver halide in said silver halide emulsion layer contains at least one iridium compound in an amount of $1\times10^{-9}$ to $1\times10^{-3}$ mol per mol of silver.

14. The silver halide photographic material of claim 1, wherein said silver halide comprises silver halide grains having a silver chloride content of not less than 50 mol % and is spectrally sensitized with a sensitized with a sensitizing dye represented by the following general formula (S):

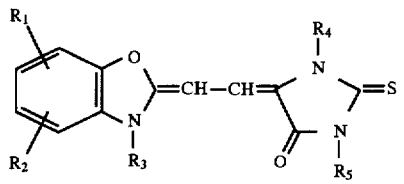

(S)

wherein $R^1$ and $R^2$ each represents a hydrogen atom, a halogen atom or a $C_{1-8}$ alkyl group, a hydroxyl group, an alkoxy group, a phenyl group, a naphthyl group, —$SO_3M$ (wherein M represents a hydrogen atom or an alkali metal atom), or —COOM (wherein M represents a hydrogen atom or an alkali metal atom); $R^1$ and $R_2$ may be connected to each other to form a 6-membered ring; $R_3$ represents an alkyl group or an allyl group which may be substituted; $R_4$ represents a hydrogen atom or a $C_{1-12}$ alkyl group; and $R_5$ represents a pyridyl or phenyl group.

15. The silver halide photographic material of claim 1, wherein said photographic material further comprises at least one hydrazine derivative represented by the general formula (N) in addition to said at least one hydrazine derivative represented by the general formula (1) or (2) in at least one of the hydrophilic colloid layers:

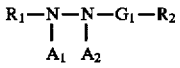

(N)

wherein $R^1$ represents an aliphatic group, an aromatic group or a heterocyclic group; $R_2$ represents a hydrogen atom, an alkyl group, an aryl group, an alkoxy group, an aryloxy group, an amino group or a hydrazino group; $G_1$ represents a —CO— group, a —$SO_2$— group, a —SO— group, a —$PO(R_3)$— group, a —CO—CO— group, a thiocarbonyl group, or an iminomethylene group; $A_1$ and $A_2$ each represent a hydrogen atom or one of $A_1$ and $A_2$ represents a hydrogen atom and the other represents an alkylsulfonyl, arylsulfonyl or acyl group; and $R_3$ has the same meaning as $R_2$.

16. The silver halide photographic material of claim 1, wherein said photographic material contains at least one hydrazine compound as a nucleating agent in an amount of from $1\times10^{-6}$ to $5\times10^{-2}$ mole per mole of silver halide in the photographic material.

17. The silver halide photographic material of claim 1, wherein said compound is incorporated into at least one of said emulsion layer and the hydrophilic colloid layer adjacent thereto.

18. The silver halide photographic material of claim 1, wherein said photographic material has at least one of a protective layer and an interlayer as a hydrophilic colloid layer.

19. The silver halide photographic material of claim 1 wherein said light-insensitive hydrophilic colloid layer has a thickness of from 0.1 to 2 μm.

20. The silver halide photographic material of claim 14 wherein the $C_{1-8}$ alkyl group is unsubstituted.

21. The silver halide photographic material of claim 14 wherein the $C_{1-8}$ alkyl group is substituted with a substituent selected from the group consisting of a halogen atom, a lower alkyl group, a hydroxyl group, a $C_{1-4}$ hydroxyalkyl group, a phenyl group, a $C_{1-4}$ alkoxy group, and a carboxy group.

22. The silver halide photographic material of claim 14 wherein the alkoxy group is unsubstituted.

23. The silver halide photographic material of claim 14 wherein the alkoxy group is substituted with a substituent selected from the group consisting of a halogen atom, a lower alkyl group, a hydroxyl group, a, $C_{1-4}$ hydroxyalkyl group, a phenyl group, a $C_{1-4}$ alkoxy group, and a carboxy group.

24. The silver halide photographic material of claim 14 wherein the $C_{1-12}$ alkyl group is unsubstituted.

25. The silver halide photographic material of claim 14 wherein the $C_{1-12}$ alkyl group is substituted with a substituent selected from the group consisting of a hydroxyl group and a carbamido group.

26. The silver halide photographic material of claim 14 wherein $R_5$ is unsubstituted.

27. The silver halide photographic material of claim 14 wherein $R_5$ is substituted with a substituent selected from the group consisting of a halogen atom, a $C_{1-4}$ alkyl group, a hydroxyl group, a $C_{1-4}$ hydroxyalkyl group, a $C_{1-4}$ alkoxy group, —$SO_3M$ (herein M represents a hydrogen atom or an alkali metal group), or —COOM (wherein M represents a hydrogen atom or an alkali metal atom).

* * * * *